US010295280B2

(12) United States Patent
Tsutsui et al.

(10) Patent No.: US 10,295,280 B2
(45) Date of Patent: May 21, 2019

(54) HEADER OF HEAT EXCHANGER

(71) Applicant: DAIKIN INDUSTRIES, LTD., Osaka-shi, Osaka (JP)

(72) Inventors: Masahiro Tsutsui, Sakai (JP); Motofumi Shimizu, Sakai (JP); Masanori Jindou, Sakai (JP); Junichi Hamadate, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 95 days.

(21) Appl. No.: 15/515,015

(22) PCT Filed: Sep. 24, 2015

(86) PCT No.: PCT/JP2015/076952
§ 371 (c)(1),
(2) Date: Mar. 28, 2017

(87) PCT Pub. No.: WO2016/052304
PCT Pub. Date: Apr. 7, 2016

(65) Prior Publication Data

US 2017/0219298 A1 Aug. 3, 2017

(30) Foreign Application Priority Data

Sep. 30, 2014 (JP) ..... 2014-202309

(51) Int. Cl.
*F24F 1/14* (2011.01)
*F28D 1/02* (2006.01)
(Continued)

(52) U.S. Cl.
CPC ..... *F28F 9/0207* (2013.01); *F28D 1/0435* (2013.01); *F28D 1/053* (2013.01);
(Continued)

(58) Field of Classification Search
CPC ..... F28F 9/0207; F28F 1/022; F28F 1/325; F28F 9/02; F28F 9/0204; F28F 9/0275;
(Continued)

(56) References Cited

U.S. PATENT DOCUMENTS 5,101,887 A * 4/1992 Kado ..... F28F 9/182 165/173
5,123,483 A * 6/1992 Tokutake ..... F28F 9/0212 165/174
(Continued)

FOREIGN PATENT DOCUMENTS

JP 3-30068 U 3/1991
JP 3-52563 U 5/1991
(Continued)

OTHER PUBLICATIONS

European Search Report of corresponding EP Application No. 15 84 6583.1 dated Sep. 27, 2017.
(Continued)

*Primary Examiner* — Justin M Jonaitis
(74) *Attorney, Agent, or Firm* — Global IP Counselors, LLP

(57) ABSTRACT

A cylindrical header of a heat exchanger includes a central member, front-side and rear-side members extending longitudinally on front and rear sides of the central member to form front-side and rear-side spaces along with the central member. The central member has a first flange covering a front-side-member-first-end part and a rear-side-member-first-end part from outside when viewed in cross-section, and a second flange covering a front-side-member-second-end part and a rear-side-member-second-end part from outside when viewed in cross-section. The front-side member is joined to the central member with the front-side-member-first-end part facing an inner surface of the first flange, and the front-side-member-second-end part facing an inner sur-
(Continued)

face of the second flange. The rear-side is joined to the central member with the rear-side-member-first-end part facing an inner surface of the first flange, and the rear-side-member-second-end part facing an inner surface of the second flange.

12 Claims, 23 Drawing Sheets

(51) Int. Cl.

| | |
|---|---|
| ***F28D 1/04*** | (2006.01) |
| ***F28F 1/02*** | (2006.01) |
| ***F28F 1/32*** | (2006.01) |
| ***F28F 9/02*** | (2006.01) |
| ***F28D 1/053*** | (2006.01) |
| ***F28D 21/00*** | (2006.01) |

(52) U.S. Cl.
CPC ..... *F28F 1/022* (2013.01); *F28F 1/325* (2013.01); *F28F 9/02* (2013.01); *F28F 9/0204* (2013.01); *F28F 9/0275* (2013.01); *F24F 1/14* (2013.01); *F28D 2001/0273* (2013.01); *F28D 2021/0068* (2013.01); *F28F 2215/12* (2013.01)

(58) Field of Classification Search
CPC .... F28F 2215/12; F28D 1/0435; F28D 1/053; F28D 2001/0273; F28D 2021/0068; F24F 1/14
USPC ..... 165/174, 173, 175
See application file for complete search history.

(56) References Cited

U.S. PATENT DOCUMENTS

| | | | | |
|---|---|---|---|---|
| 5,125,454 | A * | 6/1992 | Creamer | F28F 9/001 165/149 |
| 5,297,624 | A * | 3/1994 | Haussmann | F25B 39/04 165/173 |
| 5,307,870 | A * | 5/1994 | Kamiya | F28F 1/022 165/153 |
| 5,329,995 | A * | 7/1994 | Dey | F28F 9/0212 165/153 |
| 2003/0066633 | A1 | 4/2003 | Lee et al. | |
| 2004/0069476 | A1 | 4/2004 | Kitazaki | |
| 2012/0204595 | A1 * | 8/2012 | Tamaki | F28D 1/05391 62/498 |
| 2014/0338874 | A1 | 11/2014 | Jindou et al. | |

FOREIGN PATENT DOCUMENTS

| | | | |
|---|---|---|---|
| JP | 2002-48488 | A | 2/2002 |
| JP | 2003-121092 | A | 4/2003 |
| JP | 2003-130580 | A | 5/2003 |
| JP | 2009-97776 | A | 5/2009 |
| JP | 2013-130386 | A | 7/2013 |
| JP | 2013-249971 | A | 12/2013 |

OTHER PUBLICATIONS

International Search Report of corresponding PCT Application No. PCT/JP2015/076952 dated Nov. 17, 2015.
International Preliminary Report of corresponding PCT Application No. PCT/JP2015/076952 dated Sep. 24, 2015.

* cited by examiner 70
80
50
60
65
85
B
80
85
80
85
80
85
80
85
80
85
85
80
85
80
85
80
85
80
85
80
80
80

HEADER OF HEAT EXCHANGER

CROSS-REFERENCE TO RELATED APPLICATIONS

This U.S. National stage application claims priority under 35 U.S.C. § 119 (a) to Japanese Patent Application No. 2014-202309, filed in Japan on Sep. 30, 2014, the entire contents of which are hereby incorporated herein by reference.

TECHNICAL FIELD

The present invention relates to a header of a heat exchanger.

BACKGROUND ART

In the prior art, a space-forming member is provided in a header of a heat exchanger connected to a plurality of heat transfer tubes in order to form a plurality of spaces in the header.

A header of a heat exchanger disclosed in, e.g., Japanese Laid-open Patent Publication No. 2013-130386 has as a space-forming member in the header interior a vertical partition plate extending along a longitudinal direction of the header and a horizontal partition plate extending along a direction intersecting the vertical partition plate. In Japanese Laid-open Patent Publication No. 2013-130386, the vertical partition plate enters into a slit of the horizontal partition plate, and an end part of the vertical partition plate is made to contact the bottom surface of the header, whereby the vertical partition plate is held in position.

A header of a heat exchanger disclosed in Japanese Laid-open Patent Publication No. 2009-97776 has as a space-forming member a partition plate extending along a longitudinal direction of the header. The partition plate in Japanese Laid-open Patent Publication No. 2009-97776 is positioned between two outline members having a substantially E-shaped cross-section and is joined to an outer surface of one outline member and to an inner surface of the other outline member.

SUMMARY

Technical Problem

However, particularly in cases where the length in the longitudinal direction of the header in Japanese Laid-open Patent Publication No. 2013-130386 is great, installing the space-forming member is difficult, and assembly is troublesome.

The header in Patent Literature 2 has a divided structure, and is therefore thought to have superior ease of assembly. However, in Japanese Laid-open Patent Publication No 2009-97776, one outline member is joined so as to cover an end part of the partition plate from the outside. Therefore, pressure capacity is not adequately ensured, and instances of poor reliability can be assumed.

An object of the present invention is accordingly to provide a header of a heat exchanger having superior ease of assembly and reliability.

Solution to Problem

A header of a heat exchanger according to a first aspect of the present invention is a cylindrical header of a heat exchanger, the header extends along a longitudinal direction, and comprising a central member, a front-side member, and a rear-side member. The central member extends along the longitudinal direction. The front-side member extends along the longitudinal direction on a front side of the central member. The front-side member forms a front-side space along with the central member. The rear-side member extends along the longitudinal direction on a rear side of the central member. The rear-side member forms a rear-side space along with the central member. The central member includes a first flange and a second flange. The first flange covers a front-side-member-first-end part and a rear-side-member-first-end part from outside when viewed in cross-section. The front-side-member-first-end part is one end of the front-side member when viewed in cross-section. The rear-side-member-first-end part is one end of the rear-side member when viewed in cross-section. The second flange covers a front-side-member-second-end part and a rear-side-member-second-end part from outside when viewed in cross-section. The front-side-member-second-end part is another end of the front-side member when viewed in cross-section. The rear-side-member-second-end part is another end of the rear-side member when viewed in cross-section. The front-side member is joined to the central member in a state where the front-side-member-first-end part faces an inner surface of the first flange, and the front-side-member-second-end part faces an inner surface of the second flange. The rear-side member is joined to the central member in a state where the rear-side-member-first-end part faces an inner surface of the first flange, and the rear-side-member-second-end part faces an inner surface of the second flange.

In the header of a heat exchanger according to the first aspect of the present invention, the front-side member, which extends along the longitudinal direction and forms the front-side space along with the central member, and the rear-side member, which extends along the longitudinal direction and forms the rear-side space along with the central member, are joined to the central member, which extends along the longitudinal direction. In other words, the header of a heat exchanger is assembled by joining the front-side member and the rear-side member to the central member, which is a space-forming member extending along the longitudinal direction. In other words, the header of a heat exchanger is assembled centered around the central member, which is a space-forming member. Assembly in the header of a heat exchanger, which header extends along the longitudinal direction, is thereby facilitated while the space-forming member that extends along the longitudinal direction is installed.

Also, in the header of a heat exchanger according to the first aspect of the present invention, the central member includes the first flange, which covers the front-side-member-first-end part and the rear-side-member-first-end part from outside when viewed in cross-section, and the second flange, which covers the front-side-member-second-end part and the rear-side-member-second-end part from outside when viewed in cross-section. The front-side member and the rear-side member are joined to the central member in a state where the front-side-member-first-end part and the rear-side-member-first-end part face an inner surface of the first flange, and the front-side-member-second-end part and the rear-side-member-second-end part face an inner surface of the second flange. A joining portion of the central member with the front-side member and the rear-side member is thereby covered from the outside by the first flange or the second flange of the central member. As a result, pressure resistance strength with respect to the pressure in the front-side space and the rear-side space is improved in the joining portion of the central member with the front-side member and the rear-side member. In other words, the pressure resistance strength of the header with respect to the pressure in the header is improved.

Therefore, in the header of a heat exchanger according to the first aspect, ease of assembly and reliability are improved.

A header of a heat exchanger according to a second aspect of the present invention is the header of a heat exchanger according to the first aspect, wherein the respective inner surfaces of the first flange and the second flange are flat surfaces. The front-side-member-first-end part, the front-side-member-second-end part, the rear-side-member-first-end part, and the rear-side-member-second-end part are flat surfaces.

In the header of a heat exchanger according to the second aspect of the present invention, the inner surfaces of the first flange and the second flange, which surfaces are joining portions of the central member with the front-side member and the rear-side member, as well as the front-side-member-first-end part, the front-side-member-second-end part, the rear-side-member-first-end part, and the rear-side-member-second-end part, which are joining portions of the front-side member and the rear-side member with the central member, are all flat surfaces. In other words, the front-side member and the rear-side member are both joined to the central member at flat surfaces. A large joining area can thereby be realized between the central member and the front-side member as well as the rear-side member, and the joining is stable. Therefore, ease of assembly and reliability are further improved.

A header of a heat exchanger according to a third aspect of the present invention is the header of a heat exchanger according to the first or second aspect, the central member further having a first convex part, a second convex part, a third convex part, and a fourth convex part. The first convex part forms a first entry part along with the inner surface of the first flange. The front-side-member-first-end part enters into the first entry part. A second convex part forms a second entry part along with the inner surface of the second flange. The front-side-member-second-end part enters into the second entry part. A third convex part forms a third entry part along with the inner surface of the first flange. The rear-side-member-first-end part enters into the third entry part. A fourth convex part forms a fourth entry part along with the inner surface of the second flange. The rear-side-member-second-end part enters into the fourth entry part.

In the header of a heat exchanger according to the third aspect of the present invention, the central member further includes the first convex part, the second convex part, the third convex part, and the fourth convex part. A first entry part into which the front-side-member-first-end part enters, a second entry part into which the front-side-member-second-end part enters, a third entry part into which the rear-side-member-first-end part enters, and fourth entry part into which the rear-side-member-second-end part enters are thereby formed in the central member. As a result, assembly is facilitated when joining the front-side member and the rear-side member to the central member, and ease of assembly is further improved.

A header of a heat exchanger according to a fourth aspect of the present invention is the header of a heat exchanger according to the third aspect, wherein the first convex part, the second convex part, the third convex part, and the fourth convex part become narrower toward a distal end. The front-side-member-first-end part, the front-side-member-second-end part, the rear-side-member-first-end part, and the rear-side-member-second-end part can thereby readily enter the entry parts of the central member. Ease of assembly is thereby further improved.

A header of a heat exchanger according to a fifth aspect of the present invention is the header of a heat exchanger according to any of first through fourth aspects, wherein a cross-sectional shape of the central member has axial symmetry with respect to an axis extending from the first flange to the second flange. Assembly error is thereby restrained when the central member is joined to the front-side member and the rear-side member. Ease of assembly is thereby further improved.

A header of a heat exchanger according to a sixth aspect of the present invention is the header of a heat exchanger according to any of first through fifth aspects, wherein cross-sectional shapes of the front-side member and the rear-side member curve into an arch shape. The pressure resistance strength of the header with respect to pressure in the header is thereby further improved. Reliability is therefore further improved.

A header of a heat exchanger according to a seventh aspect of the present invention is the header of a heat exchanger according to any of first through sixth aspects, wherein a plurality of insertion holes formed in the front-side member. The insertion hole is an aperture in order to insert a flat tube into the front-side member. Ease of assembly and reliability can thereby be improved in a heat exchanger including a plurality of flat tubes in the heat-exchanging part.

A header of a heat exchanger according to an eighth aspect of the present invention is the header of a heat exchanger according to any of first through seventh aspects, wherein the front-side member and the rear-side member are joined by brazing to the central member. Brazing material is positioned on outer surfaces of the front-side-member-first-end part, the front-side-member-second-end part, the rear-side-member-first-end part, and the rear-side-member-second-end part. Thereby, brazeability is improved when joining, and the front-side member and the rear-side member are stably joined to the central member. Ease of assembly and reliability are thereby further improved.

A header of a heat exchanger according to a ninth aspect is the header of a heat exchanger according to the third or fourth aspect, further comprising a plurality of partitioning members. The plurality of the partitioning members extend along a direction intersecting the longitudinal direction between an inner surface of the front-side member and an inner surface of the rear-side member. A plurality of through-holes are formed in the central member. The through-hole is an aperture formed to enable passage of the partitioning members. The first convex part, the second convex part, the third convex part, and the fourth convex part are configured continuously along the longitudinal direction so as to be interrupted at locations where the through-holes are formed.

In the header of a heat exchanger according to the ninth aspect of the present invention, a plurality of through-holes are formed in the central member. The plurality of the partitioning members that extend along the direction intersecting the longitudinal direction thereby pass through the central member via the through-holes and are positioned. As a result, in a header of a heat exchanger including a space-forming member extending along the longitudinal direction, the plurality of the partitioning members that extend along the direction intersecting the longitudinal direction are readily positioned. In other words, a more numerous plurality of spaces can be readily formed in the header.

Also, in the header of a heat exchanger according to the ninth aspect of the present invention, the first convex part, the second convex part, the third convex part, and the fourth convex part are configured continuously along the longitudinal direction so as to be interrupted at locations where the through-holes are formed. The partitioning member thereby readily passes through the central member, and ease of assembly is further improved.

Advantageous Effects of Invention

In the header of a heat exchanger according to the first aspect of the present invention, assembly in the header of a heat exchanger, which header extends along the longitudinal direction, is facilitated while the space-forming member that extends along the longitudinal direction is installed. Also, the pressure resistance strength of the header with respect to the pressure in the header is improved. Therefore, ease of assembly and reliability are improved.

In the header of a heat exchanger according to the second aspect of the present invention, ease of assembly and reliability are further improved.

In the header of a heat exchanger according to the third, fourth, and fifth aspects of the present invention, ease of assembly is further improved.

In the header of a heat exchanger according to the sixth aspect of the present invention, reliability is further improved.

In the header of a heat exchanger according to the seventh aspect of the present invention, ease of assembly and reliability are further improved in a heat exchanger including a plurality of flat tubes in the heat-exchanging part.

In the header of a heat exchanger according to the eighth aspect of the present invention, ease of assembly and reliability are further improved.

In the header of a heat exchanger according to the ninth aspect of the present invention, a more numerous plurality of spaces are readily formed in the header. Also, ease of assembly is further improved.

DESCRIPTION OF EMBODIMENTS

A second header collection tube 50 according to an embodiment of the present invention will be described below with reference to the drawings. The second header collection tube 50 in the present embodiment is applied to an outdoor heat exchanger 13 included in an air-conditioning apparatus 100. The embodiments below are specific examples of the present invention and do not limit the technical scope of the present invention. Appropriate modifications are possible in a scope that does not deviate from the substance of the invention. The directions "up", "down", "left", "right", "front" ("forward"), and "back" ("rear") in the embodiments below refer to the direction shown in FIGS. 2-8, 13-15, and 17-23.

(1) Air-conditioning Apparatus 100

Figure 1:
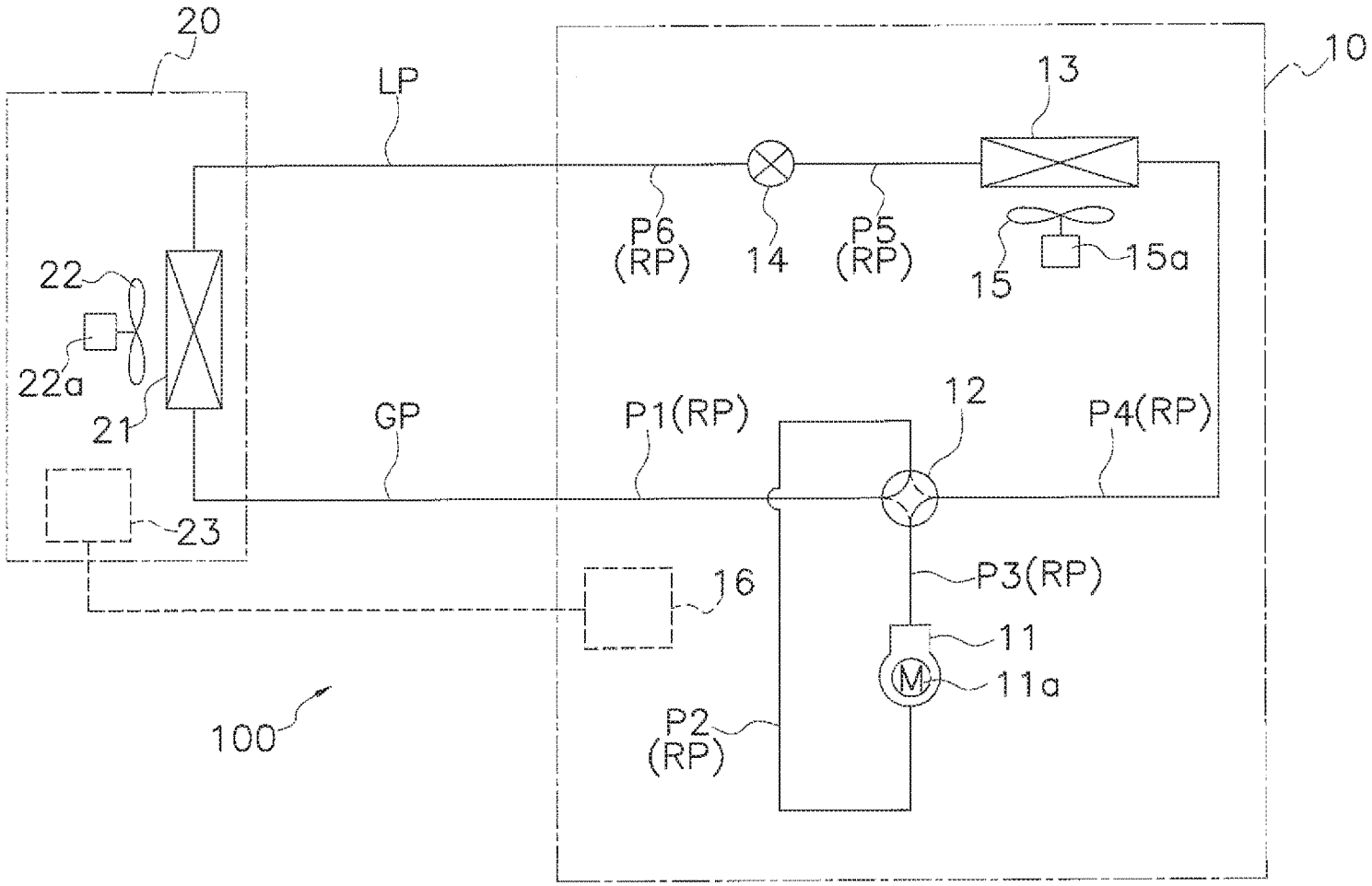
FIG. 1 is a summary block diagram of an air-conditioning apparatus that includes an outdoor heat exchanger having a second header collection tube according to an embodiment of the present invention.

FIG. 1 is a summary block diagram of the air-conditioning apparatus 100 that includes the outdoor heat exchanger 13 in which the header according to the embodiment of the present invention is applied.

The air-conditioning apparatus 100 performs cooling and heating operation and implements air conditioning for a target space. Specifically, the air-conditioning apparatus 100 performs a vapor-compression refrigeration cycle. The air-conditioning apparatus 100 primarily has an outdoor unit 10, which acts as a heat-source-side unit, and an indoor unit 20, which acts as a use-side unit. The outdoor unit 10 and the indoor unit 20 in the air-conditioning apparatus 100 are connected by a gas refrigerant communication pipe GP and a liquid refrigerant communication pipe LP, whereby a refrigerant circuit is configured.

(1-1) Outdoor Unit 10

Figure 2:
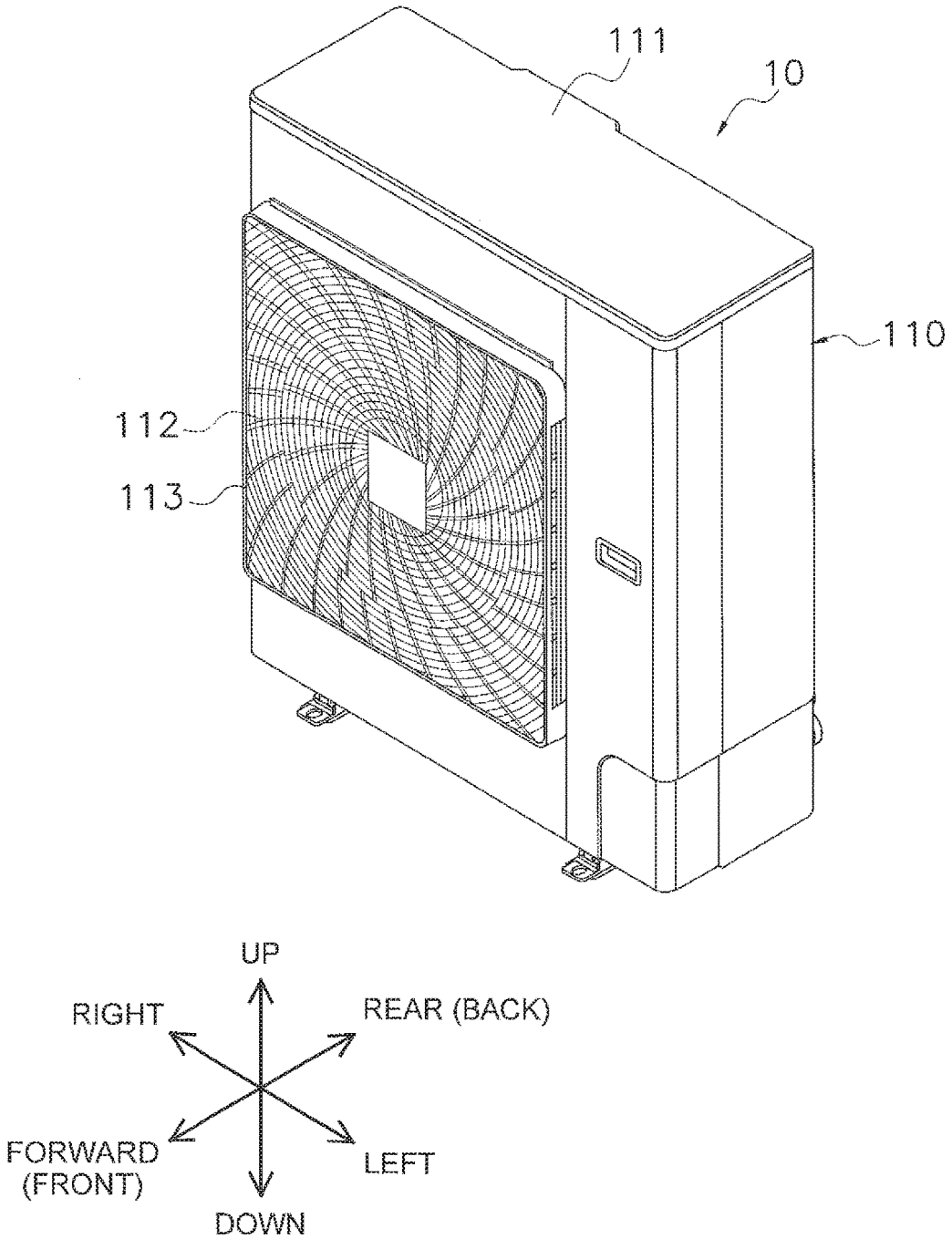
FIG. 2 is an external perspective view of the outdoor unit.

FIG. 2 is an external perspective view of the outdoor unit 10. The outdoor unit 10 is installed outdoors. The outdoor unit 10 has a unit casing 110. The unit casing 110 has a vertically long and substantially rectangular solid shape and includes a top plate 111 on a top surface. An intake port (not shown) that is an entrance for taking air flow into a unit casing 110 is formed on the back and side of the unit casing 110. The unit casing 110 is also formed having an exhaust port 112 that is an exit for air flow taken in. The exhaust port 112 is covered by a front-surface grill 113.

Figure 3:
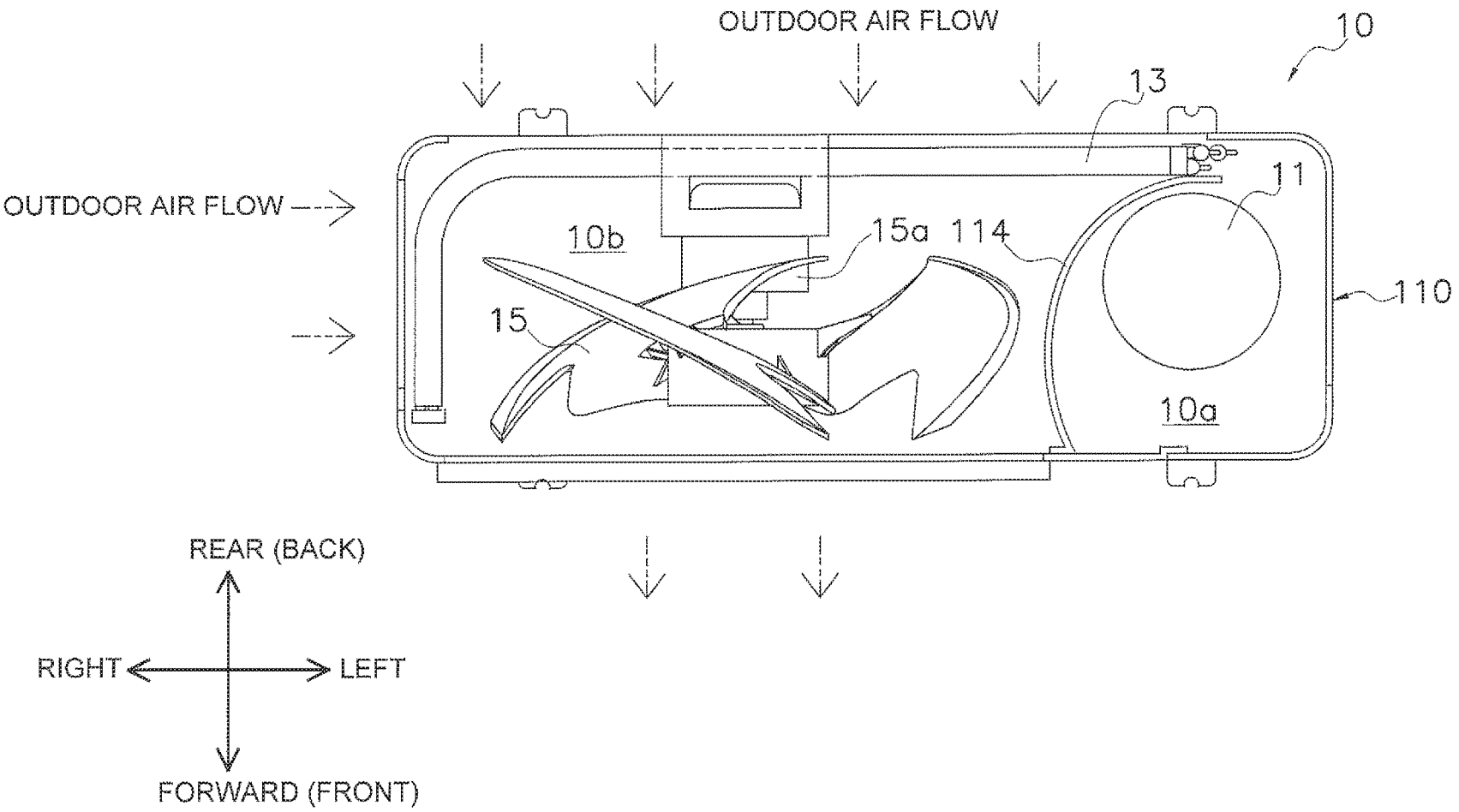
FIG. 3 is a plan view of the outdoor unit in a state in which the top plate has been removed.

FIG. 3 is a plan view of the outdoor unit 10 in a state in which the top plate 111 has been removed. A casing partition plate 114 to partition the internal space of the unit casing 110 into right space and left space is positioned within the unit casing 110. The positioning of the casing partition plate 114 enables a machine compartment 10*a* and a blower compartment 10*b* to be formed within the unit casing 110.

The outdoor unit 10 primarily has within the unit casing 110 refrigerant pipe RP that configures a refrigerant circuit, a compressor 11, a four-way valve 12, the outdoor heat exchanger 13, an expansion valve 14, an outdoor fan 15, and an outdoor control part 16. The compressor 11, the four-way valve 12, the expansion valve 14, and the outdoor control part 16 are positioned within the machine compartment 10*a*. The outdoor heat exchanger 13 and the outdoor fan 15 are positioned within the blower compartment 10*b*.

Refrigerant flows in the interior of the refrigerant pipe RP. Specifically, the refrigerant pipe RP includes a first refrigerant pipe P1, a second refrigerant pipe P2, a third refrigerant pipe P3, a fourth refrigerant pipe P4, a fifth refrigerant pipe P5, and a sixth refrigerant pipe P6.

One end of the first refrigerant pipe P1 is connected to the gas refrigerant communication pipe GP, and the other end is connected to the four-way valve 12. One end of the second refrigerant pipe P2 is connected to the four-way valve 12, and the other end is connected to an intake port of the compressor 11. One end of the third refrigerant pipe P3 is connected to a discharge port of the compressor 11, and the other end is connected to the four-way valve 12. One end of the fourth refrigerant pipe P4 is connected to the four-way valve 12, and the other end is connected to the outdoor heat exchanger 13. One end of the fifth refrigerant pipe P5 is connected to the outdoor heat exchanger 13, and the other end is connected to the expansion valve 14. One end of the sixth refrigerant pipe P6 is connected to the expansion valve 14, and the other end is connected to the liquid refrigerant communication pipe LP.

The compressor 11 is a mechanism to take in low-pressure gaseous refrigerant and then compressing and discharging the refrigerant. The compressor 11 is a hermetic electric compressor having a built-in compressor motor 11*a*. Rotary-type, scroll-type, or other types of compression elements (not shown) that are accommodated within the casing (not shown) in the compressor 11 is driven by the compressor motor 11*a* that is a drive source. While in operation, the compressor motor 11*a* is inverter-controlled by the outdoor control part 16, and the rotation speed is adjusted according to the circumstances. In other words, the compressor 11 has a variable capacity.

The four-way valve 12 switches the direction in which refrigerant flows upon switching between cooling operation and heating operation. The outdoor control part 16 causes the four-way valve 12 to switch the refrigerant flow channel. During cooling operation, the four-way valve 12 connects the first refrigerant pipe P1 with the second refrigerant pipe P2 and the third refrigerant pipe P3 with the fourth refrigerant pipe P4 (see the solid line of the four-way valve 12 in FIG. 1). During heating operation, the four-way valve 12 connects the first refrigerant pipe P1 with the third refrigerant pipe P3 and the second refrigerant pipe P2 with the fourth refrigerant pipe P4 (see the broken line of the four-way valve 12 in FIG. 1).

The outdoor heat exchanger 13 functions as a refrigerant condenser during cooling operation and functions as a refrigerant evaporator during heating operation. The outdoor heat exchanger 13 is connected to the expansion valve 14 on the liquid side via the fifth refrigerant pipe P5 and is connected to the four-way valve 12 on the gas side via the fourth refrigerant pipe P4. During cooling operation, primarily high-pressure gaseous refrigerant that has been compressed by the compressor 11 flows into the outdoor heat exchanger 13. During heating operation, primarily low-pressure liquid refrigerant that has been decompressed by the expansion valve 14 flows into the outdoor heat exchanger 13. The details of the outdoor heat exchanger 13 are explained in "(3) Details of the outdoor heat exchanger 13" below.

The expansion valve 14 is an electric valve for decompressing inflowing high-pressure refrigerant. The opening degree of the expansion valve 14 is appropriately adjusted by the outdoor control part 16 according to operational circumstances.

The outdoor fan 15 is a blower for generating outdoor air flow (see the double-dotted arrow in FIGS. 3, 4, and 6) which passes through the outdoor heat exchanger 13 after flowing to the interior of the outdoor unit 10 from the outside, and then flows to the outside of the outdoor unit 10. The outdoor fan 15 is, e.g., a propeller fan. The outdoor fan 15 is driven by an outdoor fan motor 15*a* that is a drive source. During operation, the driving of the outdoor fan motor 15*a* is controlled and the rotation speed is appropriately adjusted by the outdoor control part 16.

The outdoor control part 16 is a function part that controls the action of the actuators included in the outdoor unit 10. The outdoor control part 16 includes a microcomputer configured from a CPU, memory, and/or the like.

(1-2) Indoor Unit 20

The indoor unit 20 is installed indoors. The indoor unit 20 is of, e.g., a wall-hanging, a ceiling-embedded, or ceiling-pendant form. The indoor unit 20 primarily has an indoor heat exchanger 21, an indoor fan 22, and an indoor control part 23.

The indoor heat exchanger 21 functions as a refrigerant evaporator during cooling operation and functions as a refrigerant condenser during heating operation. The indoor heat exchanger 21 has a plurality of heat transfer tubes (not shown) and a plurality of fins (not shown). The indoor heat exchanger 21 is connected to the gas refrigerant communication pipe GP at the gas side and is connected to the liquid refrigerant communication pipe LP at the liquid side.

The indoor fan 22 is a blower configured to generate indoor air flow which passes through the indoor heat exchanger 21 after flowing to the interior of the indoor unit 20 from the outside, and then flows to the outside of the indoor unit 20. The indoor fan 22 is driven by an indoor fan motor 22*a* that is a drive source. During operation, the driving of the indoor fan motor 22*a* is controlled, and the rotation speed is appropriately adjusted, by the indoor control part 23.

The indoor control part 23 is a function part that controls the action of the actuators included in the indoor unit 20. The indoor control part 23 includes a microcomputer configured from a CPU, memory, and/or the like. The indoor control part 23 is connected to the outdoor control part 16 via a cable, and signals are sent and received therebetween at a predetermined timing.

(2) Flow of Refrigerant in the Air-conditioning Apparatus 100

(2-1) During Cooling Operation

During cooling operation, the four-way valve 12 assumes a state shown by the solid line in FIG. 1. The discharge side of the compressor 11 is connected to the gas side of the outdoor heat exchanger 13 via the third refrigerant pipe P3 and the fourth refrigerant pipe P4, and the intake side of the compressor 11 is connected to the gas refrigerant communication pipe GP via the first refrigerant pipe P1 and the second refrigerant pipe P2.

Upon driving of the compressor 11, low-pressure gaseous refrigerant is compressed into high-pressure gaseous refrigerant by the compressor 11. The high-pressure gaseous refrigerant is sent to the outdoor heat exchanger 13 by way of the third refrigerant pipe P3, the four-way valve 12, and the fourth refrigerant pipe P4. The high-pressure gaseous refrigerant then exchanges heat with the outdoor air flow in the outdoor heat exchanger 13 and thereby condenses into high-pressure liquid refrigerant. The high-pressure liquid refrigerant flowing out from the outdoor heat exchanger 13 is sent to the expansion valve 14 by way of the fifth refrigerant pipe P5. Low-pressure refrigerant that is decompressed in the expansion valve 14 is sent to the indoor heat exchanger 21 by way of the sixth refrigerant pipe P6 and the liquid refrigerant communication pipe LP, exchanges heat with the indoor air flow, and thereby evaporates into low-pressure gaseous refrigerant. The low-pressure gaseous refrigerant flows through the gas refrigerant communication pipe GP, the first refrigerant pipe P1, and the second refrigerant pipe P2 and is taken into the compressor 11.

The opening degree of the expansion valve 14 and the rotation rate of the compressor 11 are adjusted as appropriate during cooling operation. The refrigerant flowing through the refrigerant circuit circulates at greater rates at certain times, and at lower rates at others.

(2-2) During Heating Operation

During heating operation, the four-way valve 12 assumes a state shown by the broken line in FIG. 1. The discharge side of the compressor 11 is connected to the gas side of the indoor heat exchanger 21 via the first refrigerant pipe P1 and the third refrigerant pipe P3, and the intake side of the compressor 11 is connected to the gas side of the outdoor heat exchanger 13 via the second refrigerant pipe P2 and the fourth refrigerant pipe P4.

Upon driving of the compressor 11, the low-pressure gaseous refrigerant is compressed into high-pressure gaseous refrigerant by the compressor 11 and sent to the indoor heat exchanger 21 by way of the third refrigerant pipe P3, the four-way valve 12, the first refrigerant pipe P1, and the gas refrigerant communication pipe GP. The high-pressure gaseous refrigerant sent to the indoor heat exchanger 21 exchanges heat with the indoor air flow and thereby condenses into high-pressure liquid refrigerant, which is then sent to the expansion valve 14 by way of the liquid refrigerant communication pipe LP and the sixth refrigerant pipe P6. When the high-pressure gaseous refrigerant sent to the expansion valve 14 passes through the expansion valve 14, the refrigerant is decompressed according to the opening degree of the expansion valve 14. The low-pressure refrigerant that has passed through expansion valve 14 flows through the fifth refrigerant pipe P5 and into the outdoor heat exchanger 13. The low-pressure refrigerant that has flowed into the outdoor heat exchanger 13 exchanges heat with the outdoor air flow, evaporates, becomes low-pressure gaseous refrigerant, and is taken into the compressor 11 by way of the fourth refrigerant pipe P4, the four-way valve 12, and the second refrigerant pipe P2.

The opening degree of the expansion valve 14 and the rotation rate of the compressor 11 are adjusted as appropriate during heating operation. The refrigerant flowing through the refrigerant circuit circulates at greater rates at certain times, and at lower rates at others.

(3) Details of the Outdoor Heat Exchanger 13

Figure 4:
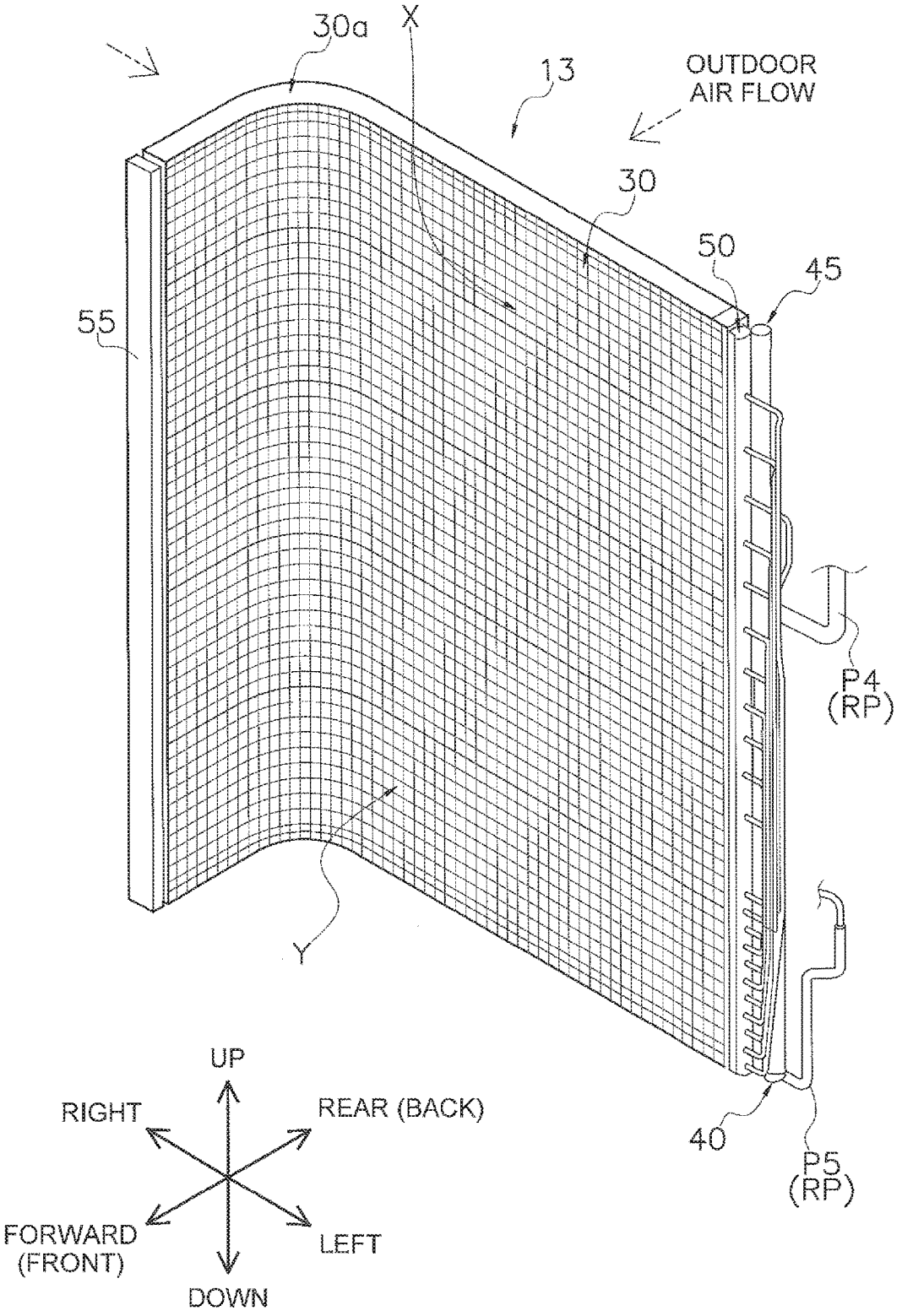
FIG. 4 is an external perspective view of the outdoor heat exchanger.
Figure 5:
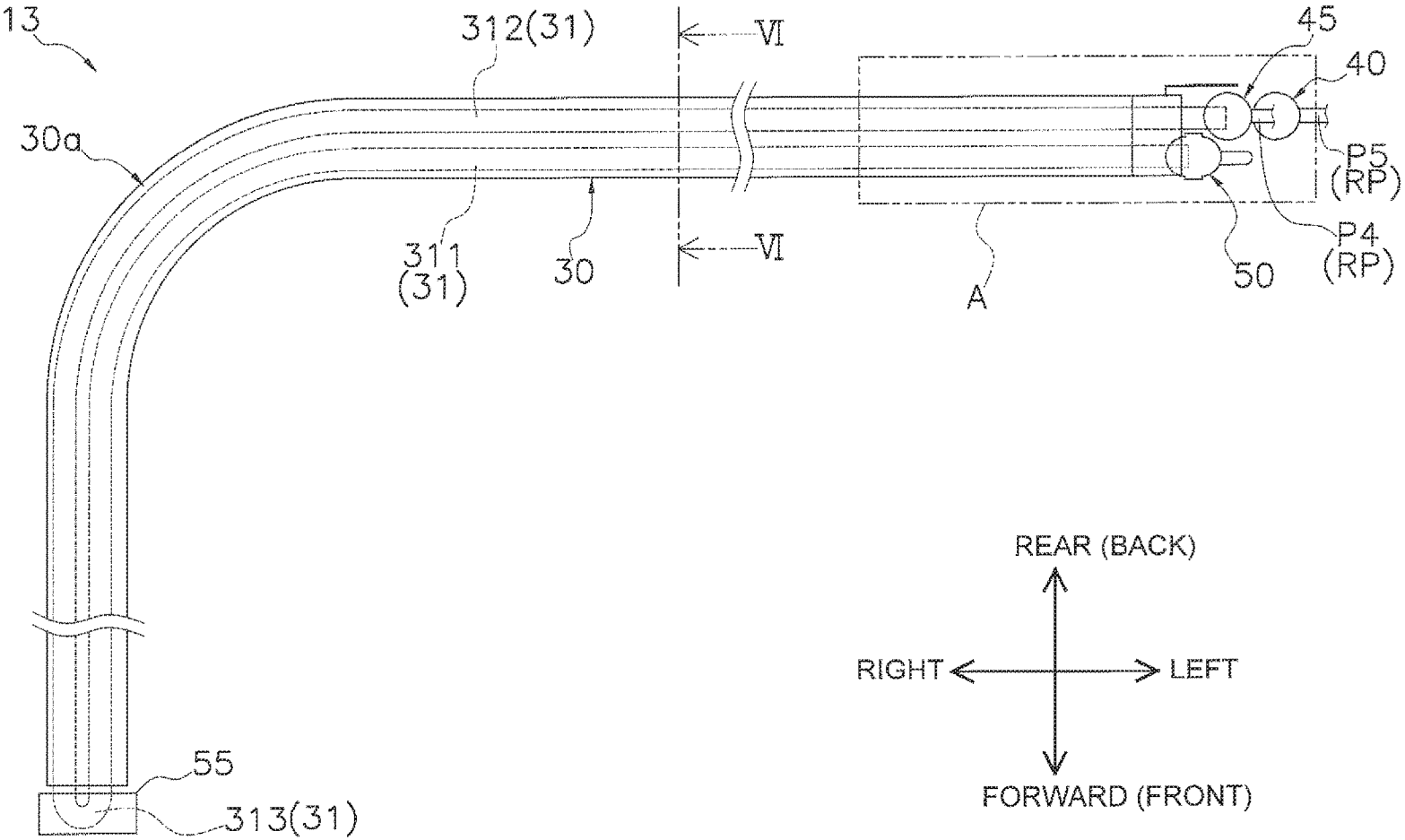
FIG. 5 is a plan view of the outdoor heat exchanger.

FIG. 4 is an external perspective view of the outdoor heat exchanger 13. FIG. 5 is a plan view of the outdoor heat exchanger 13.

The outdoor heat exchanger 13 primarily includes a heat-exchanging part 30, a distributor 40 which is provided to one end (the left end) of the heat-exchanging part 30, a first header collection tube 45 and the second header collection tube 50.

(3-1) The Heat-exchanging Part 30

Figure 6:
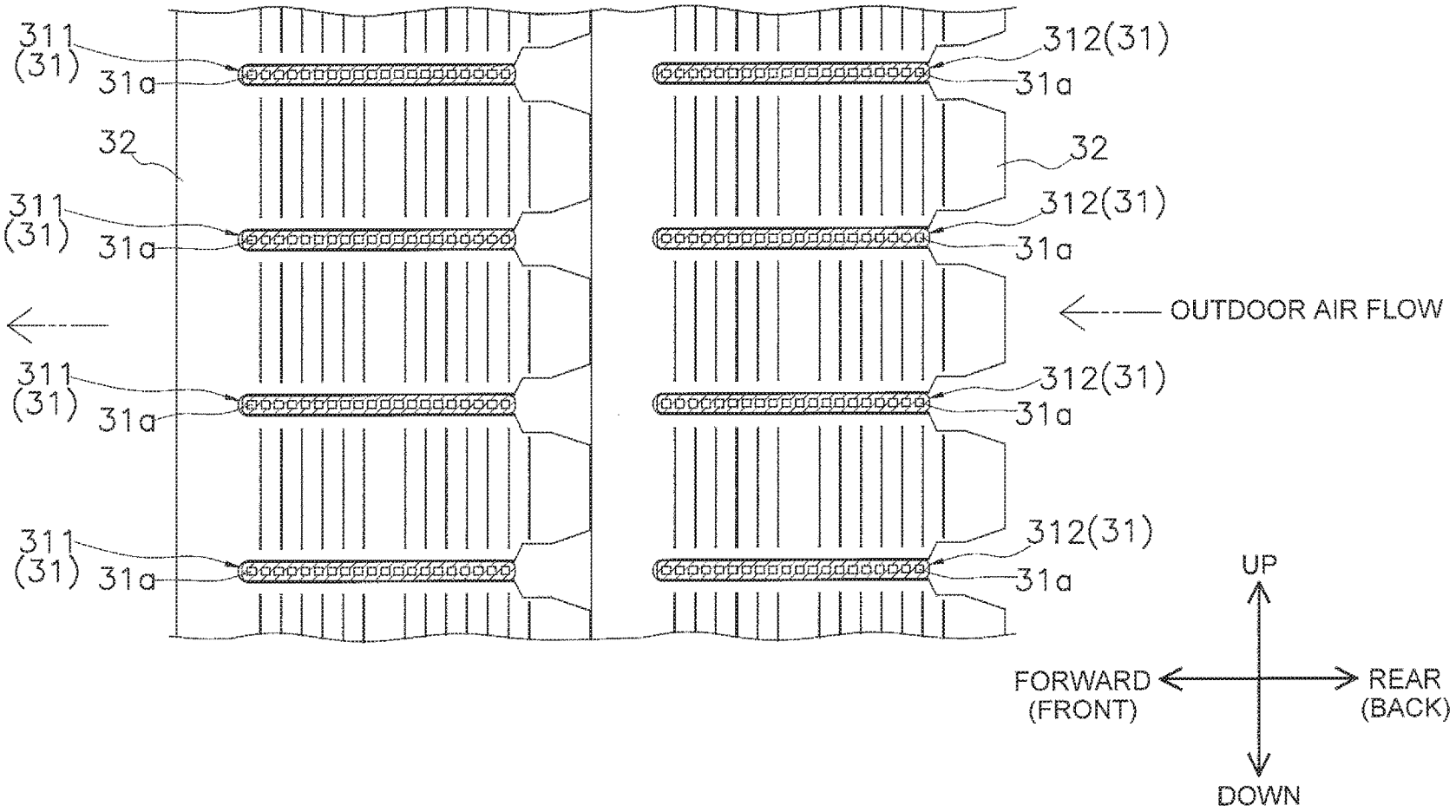
FIG. 6 is a partial enlarged view of the cross-section at line VI-VI of FIG. 5.

FIG. 6 is partial enlarged view of the cross-section at line VI-VI of FIG. 5. The heat-exchanging part 30 is a region where outdoor air flow and the refrigerant that has passed through the outdoor heat exchanger 13 exchange heat. Specifically, the heat-exchanging part 30 is a region that expands in a direction that intersects a flowing direction of the outdoor air flow in a center portion of the outdoor heat exchanger 13, and occupies a majority of the outdoor heat exchanger 13. The heat-exchanging part 30 is substantially L-shaped when viewed from above and has a curved part 30*a* from one end to the other. The heat-exchanging part 30 primarily includes a plurality of heat transfer tubes 31 (corresponding to the "flat tube" described in the claims) and a plurality of heat transfer fins 32.

The heat transfer tubes 31 are flat, perforated tubes inside of which are formed a plurality of flow channels 31*a*. The heat transfer tubes 31 are made of aluminum or aluminum alloy. In the present embodiment, seventy-two the heat transfer tubes 31 are aligned in an up-and-down (vertical) direction in the heat-exchanging part 30. However, the number of the heat transfer tubes 31 included in the heat-exchanging part 30 can be changed as appropriate. The heat transfer tubes 31 extend along the horizontal direction while curving at the curved part 30*a*. One end of the heat transfer tubes 31 is connected to the first header collection tube 45, and the other end is connected to the second header collection tube 50. The widthwise length of the heat transfer tubes 31 extends to a forward-and-backward direction at the left of the curved part 30*a* (toward the first header collection tube 45 and the second header collection tube 50). The widthwise length of the heat transfer tubes 31 extends to the left-and-right direction at the front of the curved part 30*a*.

The heat transfer tubes 31 primarily have a first part 311, a second part 312, and a turn part 313 that links the first part 311 and the second part 312. One end of the first part 311 is connected to the second header collection tube 50. After extending along the left-and-right direction, the first part 311 curves at the curved part 30*a* and then extends along the forward-and-back direction. The other end of the first part 311 is connected to the turn part 313. One end of the second part 312 is connected to the first header collection tube 45. After extending along the left-and-right direction, the second part 312 curves at the curved part 30*a* and then extends along the forward-and-back direction. The other end of the second part 312 is connected to the turn part 313. The turn part 313 is curved in a U-shape. One end of the turn part 313 is connected to the first part 311, and the other end is connected to the second part 312. The turn part 313 is covered by a cover 55 that extends along the up-and-down direction.

The heat transfer fins 32 are flat members that increase the heat-transfer area between the heat transfer tubes 31 and the outdoor air flow. The heat transfer fins 32 are made of aluminum or aluminum alloy. The heat transfer fins 32 extend along the up-and-down direction in the heat-exchanging part 30 so as to intersect with the heat transfer tubes 31. A plurality of notches are formed aligned in the up-and-down direction in the heat transfer fins 32. The heat transfer tubes 31 are inserted into these notches.

Figure 7:
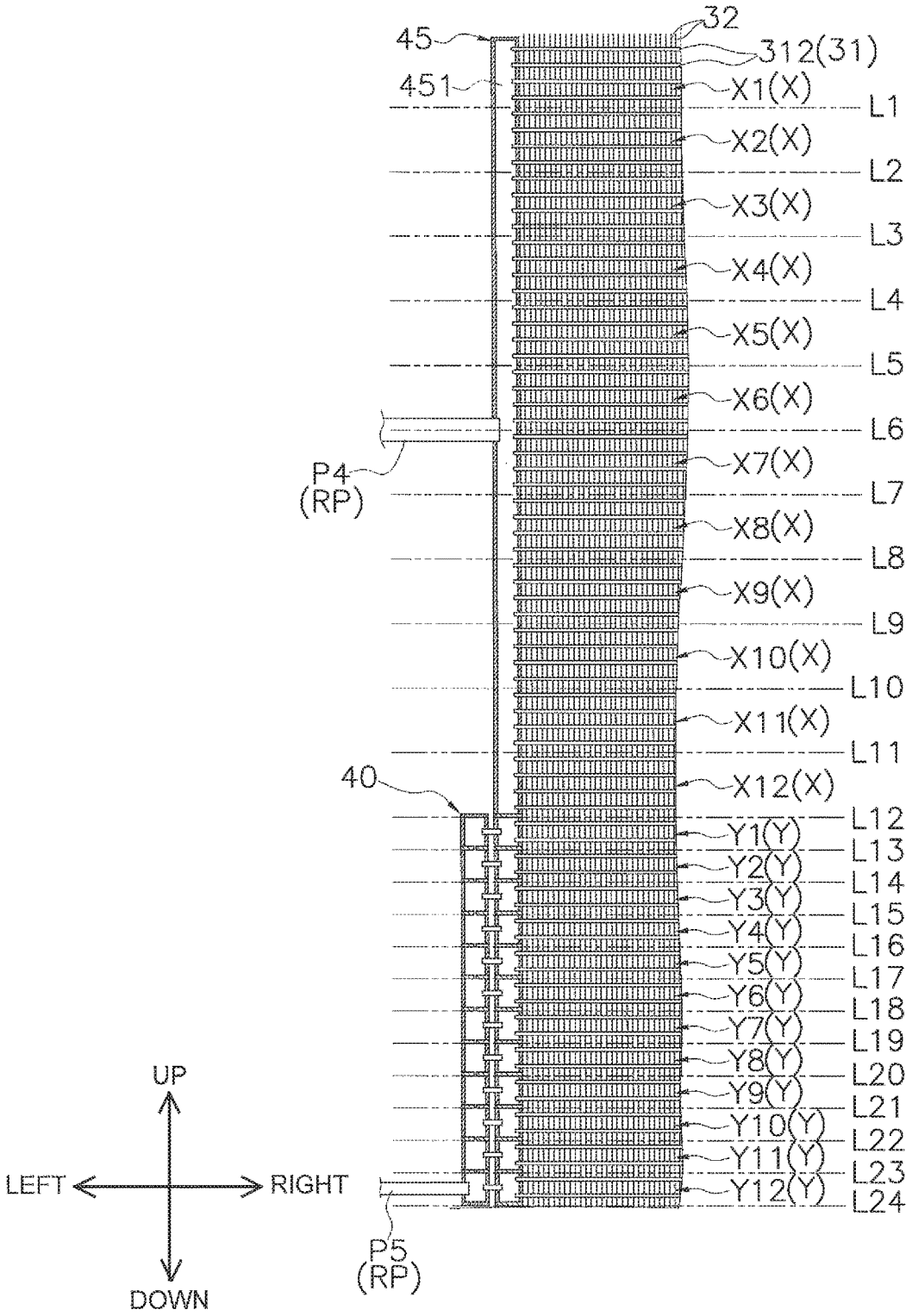
FIG. 7 is a cross-sectional view of the A portion of FIG. 5 viewed from the back.
Figure 8:
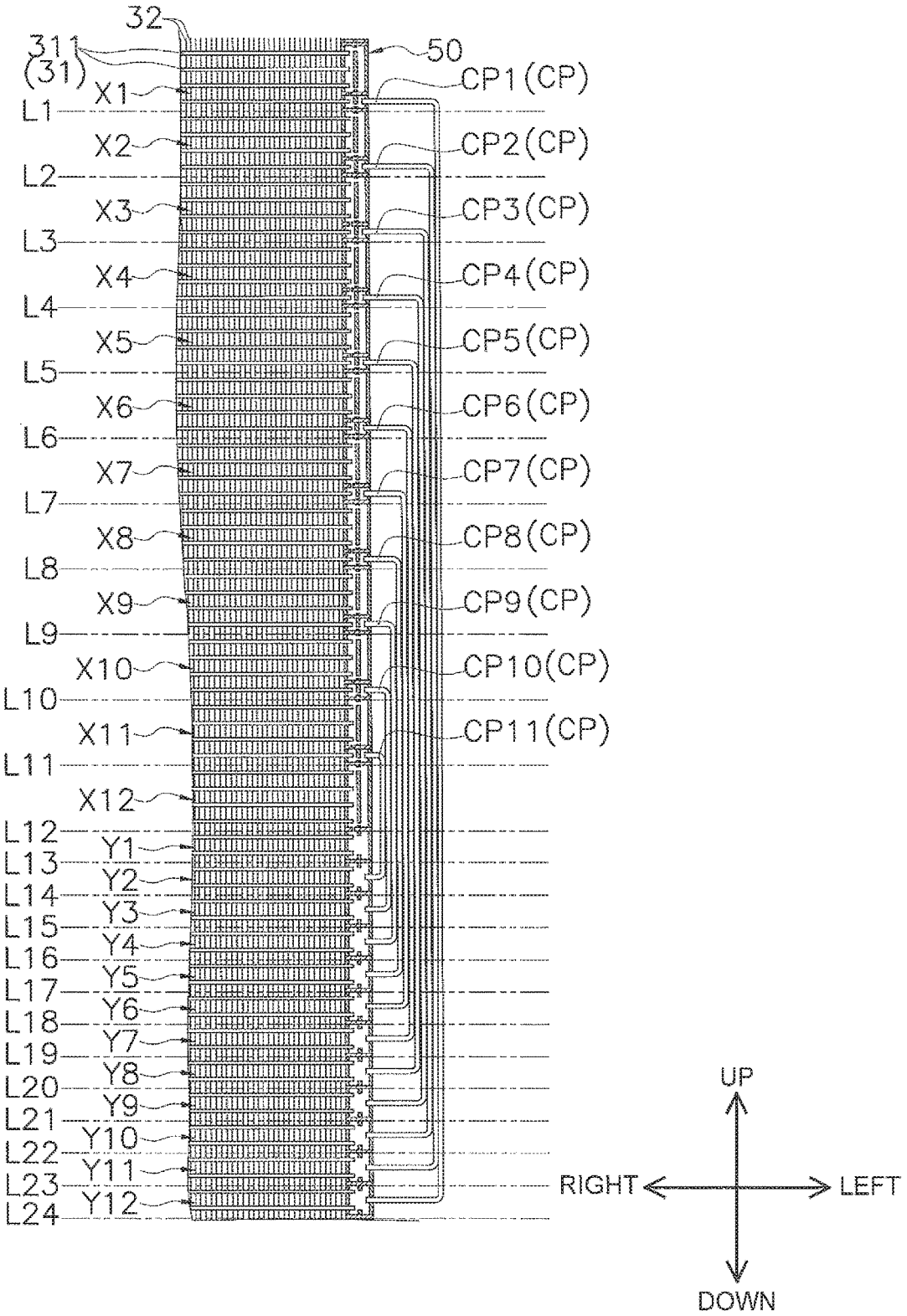
FIG. 8 is a cross-sectional view of the A portion of FIG. 5 viewed from the front.

FIG. 7 is a cross-sectional view of the A portion of FIG. 5 viewed from the back. FIG. 8 is a cross-sectional view of the A portion of FIG. 5 viewed from the front. The double-dotted lines L1 to L24 in FIG. 7 correspond respectively to the double-dotted lines L1 to L24 in FIG. 8.

The heat-exchanging part 30 is primarily divided into an upper-side heat-exchanging part X, which is positioned on the upper side, and a lower-side heat-exchanging part Y, which is positioned below the upper-side heat-exchanging part X.

In order from the top, the upper-side heat-exchanging part X has a first upper-side heat-exchanging part X1, a second upper-side heat-exchanging part X2, a third upper-side heat-exchanging part X3, a fourth upper-side heat-exchanging part X4, a fifth upper-side heat-exchanging part X5, a sixth upper-side heat-exchanging part X6, a seventh upper-side heat-exchanging part X7, an eighth upper-side heat-exchanging part X8, a ninth upper-side heat-exchanging part X9, a tenth upper-side heat-exchanging part X10, an eleventh upper-side heat-exchanging part X11, and a twelfth upper-side heat-exchanging part X12.

The first upper-side heat-exchanging part X1 is a region positioned above the double-dotted line L1 (see FIGS. 7 and 8). The second upper-side heat-exchanging part X2 is a region positioned below the double-dotted line L1 and above the double-dotted line L2 (see FIGS. 7 and 8). The third upper-side heat-exchanging part X3 is a region positioned below the double-dotted line L2 and above the double-dotted line L3 (see FIGS. 7 and 8). The fourth upper-side heat-exchanging part X4 is a region positioned below the double-dotted line L3 and above the double-dotted line L4 (see FIGS. 7 and 8). The fifth upper-side heat-exchanging part X5 is a region positioned below the double-dotted line L4 and above the double-dotted line L5 (see FIGS. 7 and 8). The sixth upper-side heat-exchanging part X6 is a region positioned below the double-dotted line L5 and above the double-dotted line L6 (see FIGS. 7 and 8). The seventh upper-side heat-exchanging part X7 is a region positioned below the double-dotted line L6 and above the double-dotted line L7 (see FIGS. 7 and 8). The eighth upper-side heat-exchanging part X8 is a region positioned below the double-dotted line L7 and above the double-dotted line L8 (see FIGS. 7 and 8). The ninth upper-side heat-exchanging part X9 is a region positioned below the double-dotted line L8 and above the double-dotted line L9 (see FIGS. 7 and 8). The tenth upper-side heat-exchanging part X10 is a region positioned below the double-dotted line L9 and above the double-dotted line L10 (see FIGS. 7 and 8). The eleventh upper-side heat-exchanging part X11 is a region positioned below the double-dotted line L10 and above the double-dotted line L11 (see FIGS. 7 and 8). The twelfth upper-side heat-exchanging part X12 is a region positioned below the double-dotted line L11 and above the double-dotted line L12 (see FIGS. 7 and 8).

Each of the first upper-side heat-exchanging part X1 through the twelfth upper-side heat-exchanging part X12 includes four of the heat transfer tubes 31.

In order from the top, the lower-side heat-exchanging part Y has a first lower-side heat-exchanging part Y1, a second lower-side heat-exchanging part Y2, a third lower-side heat-exchanging part Y3, a fourth lower-side heat-exchanging part Y4, a fifth lower-side heat-exchanging part Y5, a sixth lower-side heat-exchanging part Y6, a seventh lower-side heat-exchanging part Y7, an eighth lower-side heat-exchanging part Y8, a ninth lower-side heat-exchanging part Y9, a tenth lower-side heat-exchanging part Y10, an eleventh lower-side heat-exchanging part Y11, and a twelfth lower-side heat-exchanging part Y12.

The first lower-side heat-exchanging part Y1 is a region positioned below the double-dotted line L12 and above the double-dotted line L13 (see FIGS. 7 and 8). The second lower-side heat-exchanging part Y2 is a region positioned below the double-dotted line L13 and above the double-dotted line L14 (see FIGS. 7 and 8). The third lower-side heat-exchanging part Y3 is a region positioned below the double-dotted line L14 and above the double-dotted line L15 (see FIGS. 7 and 8). The fourth lower-side heat-exchanging part Y4 is a region positioned below the double-dotted line L15 and above the double-dotted line L16 (see FIGS. 7 and 8). The fifth lower-side heat-exchanging part Y5 is a region positioned below the double-dotted line L16 and above the double-dotted line L17 (see FIGS. 7 and 8). The sixth lower-side heat-exchanging part Y6 is a region positioned below the double-dotted line L17 and above the double-dotted line L18 (see FIGS. 7 and 8). The seventh lower-side heat-exchanging part Y7 is a region positioned below the double-dotted line L18 and above the double-dotted line L19 (see FIGS. 7 and 8). The eighth lower-side heat-exchanging part Y8 is a region positioned below the double-dotted line L19 and above the double-dotted line L20 (see FIGS. 7 and 8). The ninth lower-side heat-exchanging part Y9 is a region positioned below the double-dotted line L20 and above the double-dotted line L21 (see FIGS. 7 and 8). The tenth lower-side heat-exchanging part Y10 is a region positioned below the double-dotted line L21 and above the double-dotted line L22 (see FIGS. 7 and 8). The eleventh lower-side heat-exchanging part Y11 is a region positioned below the double-dotted line L22 and above the double-dotted line L23 (see FIGS. 7 and 8). The twelfth lower-side heat-exchanging part Y12 is a region positioned below the double-dotted line L23 and above the double-dotted line L24 (see FIGS. 7 and 8).

Each of the first lower-side heat-exchanging part Y1 through the twelfth lower-side heat-exchanging part Y12 each include two of the heat transfer tubes 31.

(3-2) The Distributor 40

Figure 9:
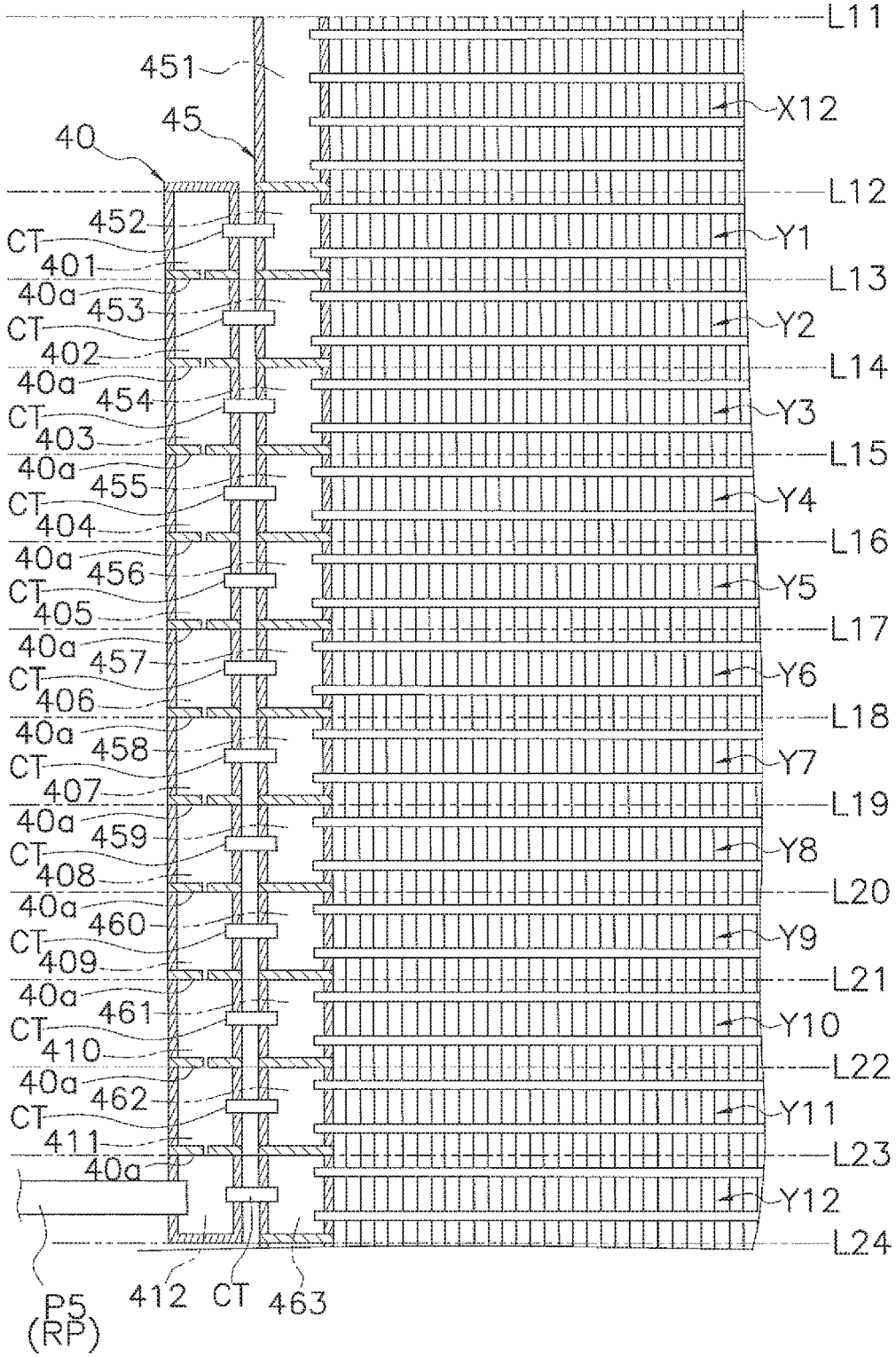
FIG. 9 is an enlargement of the portion below the double-dotted line L11 in FIG. 7.

FIG. 9 is an enlargement of the portion below the double-dotted line L1 in FIG. 7.

The distributor 40 is a cylindrical tube extending along the vertical direction. The distributor 40 connects to the fifth refrigerant pipe P5 in the vicinity of a lower end. The distributor 40 adjoins the left side of the first header collection tube 45. The distributor 40 communicates with the first header collection tube 45 via a plurality (twelve in the present embodiment) of communication tubes CT. During heating operation, the distributor 40 divides the flow of inflowing refrigerant and sends the refrigerant to the first header collection tube 45 so that the refrigerant flows at an appropriate rate in the various parts of the first upper-side heat-exchanging part X1 to the twelfth upper-side heat-exchanging part X12 or the first lower-side heat-exchanging part Y1 to the twelfth lower-side heat-exchanging part Y12 of the heat-exchanging part 30.

A plurality of partition plates 40*a* (eleven in the present embodiment) are arranged in the interior of the distributor 40, as shown in FIG. 9. A plurality of spaces (twelve in the present embodiment) are thereby formed within the distributor 40. For ease of description, hereinafter the spaces formed within the distributor 40 will be referred to, in order from the top to the bottom, as a first distributing chamber 401, a second distributing chamber 402, a third distributing chamber 403, a fourth distributing chamber 404, a fifth distributing chamber 405, a sixth distributing chamber 406, a seventh distributing chamber 407, an eighth distributing chamber 408, a ninth distributing chamber 409, a tenth distributing chamber 410, an eleventh distributing chamber 411, and a twelfth distributing chamber 412.

The communication tubes CT are connected to each of the first distributing chamber 401 through the twelfth distributing chamber 412, and each of the flow chambers communicates with the first header collection tube 45. The fifth refrigerant pipe P5 is connected to the twelfth distributing chamber 412. A communication port is formed in the partition plates 40*a*, and each of the first distributing chamber 401 to the twelfth distributing chamber 412 communicates with the other adjoining distributing chambers above and below via these communication ports.

During cooling operation, refrigerant flows into the various distributing chambers within the distributor 40, which is arranged in such a format, via the communication tubes CT from the first header collection tube 45. The refrigerant that has flowed into the distributing chambers (excluding the twelfth distributing chamber 412) flows, via the communication port, toward the distributing chamber positioned below. The refrigerant that has flowed into the twelfth distributing chamber 412 flows out into the fifth refrigerant pipe P5.

During heating operation, refrigerant flows into the twelfth distributing chamber 412 from the fifth refrigerant pipe P5. One part of the refrigerant that has flowed into the various distributing chambers (excluding the first distributing chamber 401) flows out to the first header collection tube 45 via the communication tubes CT, and the other part flows toward the distributing chambers positioned above via the communication port. The refrigerant that has flowed into the first distributing chamber 401 flows out to the first header collection tube 45 via the communication tubes CT.

(3-3) First Header Collection Tube 45

The first header collection tube 45 is a cylindrical tube extending along the vertical direction. The first header collection tube 45 adjoins the right side of the distributor 40. The height (length in the up-and-down direction) of the first header collection tube 45 is greater than that of the distributor 40, as shown in FIG. 7.

The first header collection tube 45 is connected to the fourth refrigerant pipe P4. The first header collection tube 45 is also connected to the heat transfer tubes 31 of the heat-exchanging part 30. The first header collection tube 45 is also connected to the plurality of the communication tubes CT.

A plurality of spaces (thirteen in the present embodiment) are formed in the interior of the first header collection tube 45, as shown in FIG. 9. For ease of description, hereinafter the spaces formed within the first header collection tube 45 will be referred to, in order from the top to the bottom, as a first section 451, a second section 452, a third section 453, a fourth section 454, a fifth section 455, a sixth section 456, a seventh section 457, an eighth section 458, a ninth section 459, a tenth section 460, an eleventh section 461, a twelfth section 462, and a thirteenth section 463.

Excluding the first section 451, the sections have substantially the same volume. The first section 451 has a larger volume than the other sections and occupies the majority of the space within the first header collection tube 45. The fourth refrigerant pipe P4 is connected to the first section 451 (see FIG. 7).

Excluding the first section 451, the sections communicate with the distributing chambers of the distributor 40 via the communication tubes CT. Specifically, the second section 452 communicates with the first distributing chamber 401. The third section 453 communicates with the second distributing chamber 402. The fourth section 454 communicates with the third distributing chamber 403. The fifth section 455 communicates with the fourth distributing chamber 404. The sixth section 456 communicates with the fifth distributing chamber 405. The seventh section 457 communicates with the sixth distributing chamber 406. The eighth section 458 communicates with the seventh distributing chamber 407. The ninth section 459 communicates with the eighth distributing chamber 408. The tenth section 460 communicates with the ninth distributing chamber 409. The eleventh section 461 communicates with the tenth distributing chamber 410. The twelfth section 462 communicates with the eleventh distributing chamber 411. The thirteenth section 463 communicates with the twelfth distributing chamber 412.

Each section is connected to the heat transfer tubes 31 (i.e., to one end of the second part 312) of the heat-exchanging parts (X or Y) included in the heat-exchanging part 30. Specifically, the first section 451 is connected to the heat transfer tubes 31 of the upper-side heat-exchanging part X (X1-X12). The second section 452 is connected to the heat transfer tubes of the first lower-side heat-exchanging part Y1. The third section 453 is connected to the heat transfer tubes of the second lower-side heat-exchanging part Y2. The fourth section 454 is connected to the heat transfer tubes of the third lower-side heat-exchanging part Y3. The fifth section 455 is connected to the heat transfer tubes of the fourth lower-side heat-exchanging part Y4. The sixth section 456 is connected to the heat transfer tubes of the fifth lower-side heat-exchanging part Y5. The seventh section 457 is connected to the heat transfer tubes of the sixth lower-side heat-exchanging part Y6. The eighth section 458 is connected to the heat transfer tubes of the seventh lower-side heat-exchanging part Y7. The ninth section 459 is connected to the heat transfer tubes of the eighth lower-side heat-exchanging part Y8. The tenth section 460 is connected to the heat transfer tubes of the ninth lower-side heat-exchanging part Y9. The eleventh section 461 is connected to the heat transfer tubes of the tenth lower-side heat-exchanging part Y10. The twelfth section 462 is connected to the heat transfer tubes of the eleventh lower-side heat-exchanging part Y11. The thirteenth section 463 is connected to the heat transfer tubes of the twelfth lower-side heat-exchanging part Y12.

During cooling operation, the refrigerant flows from the fourth refrigerant pipe P4 into the first section 451 within the first header collection tube 45 arranged in such a format. The refrigerant that has flowed into the first section 451 flows out to the heat transfer tubes 31 (the second part 312) of the upper-side heat-exchanging part X (X1 through X12). The refrigerant also flows into each of the second section 452 through the thirteenth section 463 from the heat transfer tubes 31 (the second part 312) of the lower-side heat-exchanging part Y. The refrigerant that has flowed into each of the second section 452 through the thirteenth section 463 flows out to the corresponding distributing chambers (any of 401 through 412) of the distributor 40 via the communication tubes CT.

During heating operation, the refrigerant flows into each of the second section 452 through the thirteenth section 463 from the corresponding distributing chambers of the distributor 40. The refrigerant that has flowed into each of the second section 452 through the thirteenth section 463 flows out to the corresponding heat transfer tubes 31 (the second part 312) of the lower-side heat-exchanging part Y. The refrigerant also flows into the first section 451 from the heat transfer tubes 31 (the second part 312) of the upper-side heat-exchanging part X (X1 through X12). The refrigerant that has flowed into the first section 451 flows out to the fourth refrigerant pipe P4.

(3-4) Second Header Collection Tube 50

(3-4-1) Inner Space of the Second Header Collection Tube 50

Figure 10:
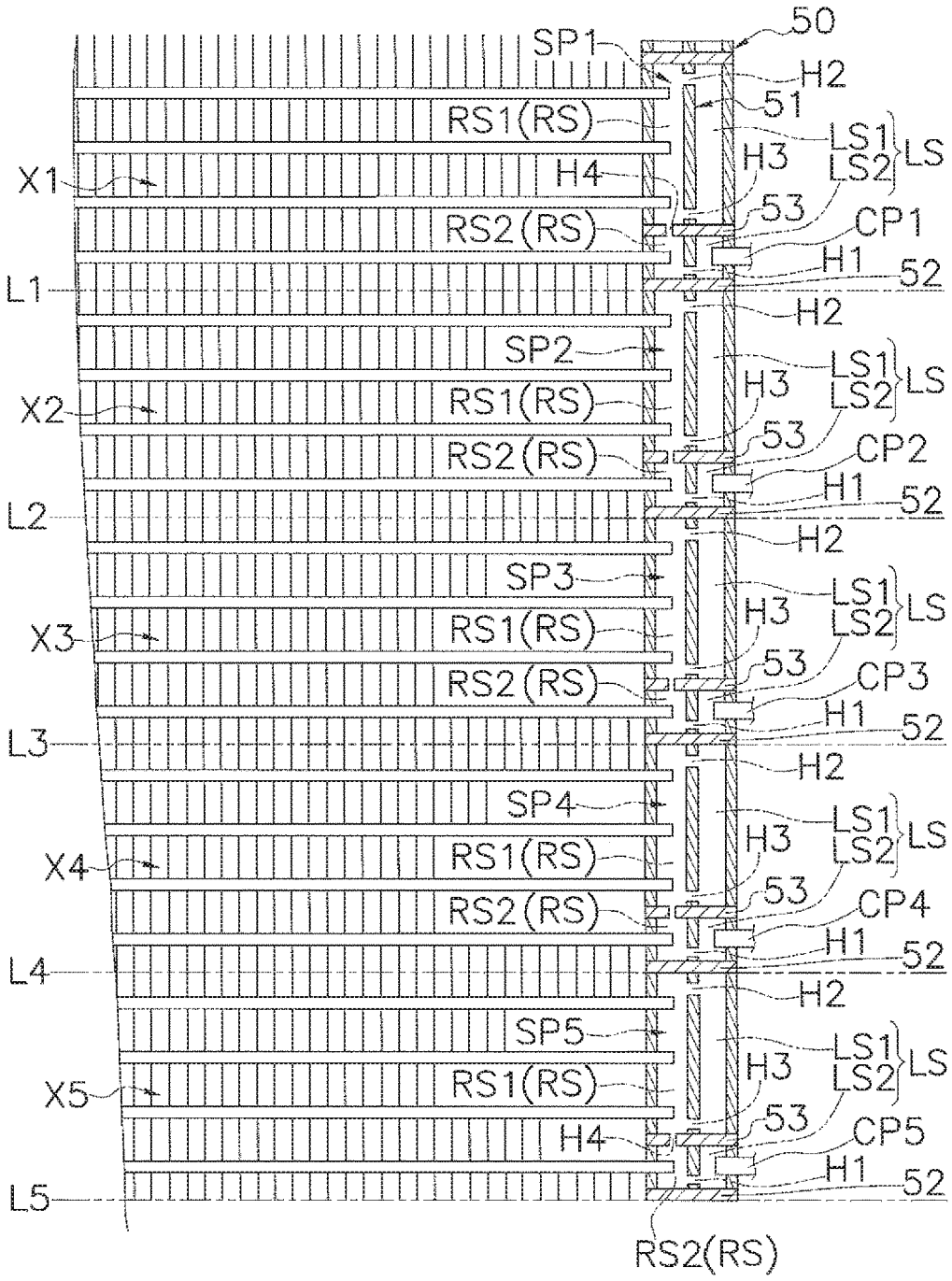
FIG. 10 is an enlargement of the portion above the double-dotted line L5 in FIG. 8.
Figure 11:
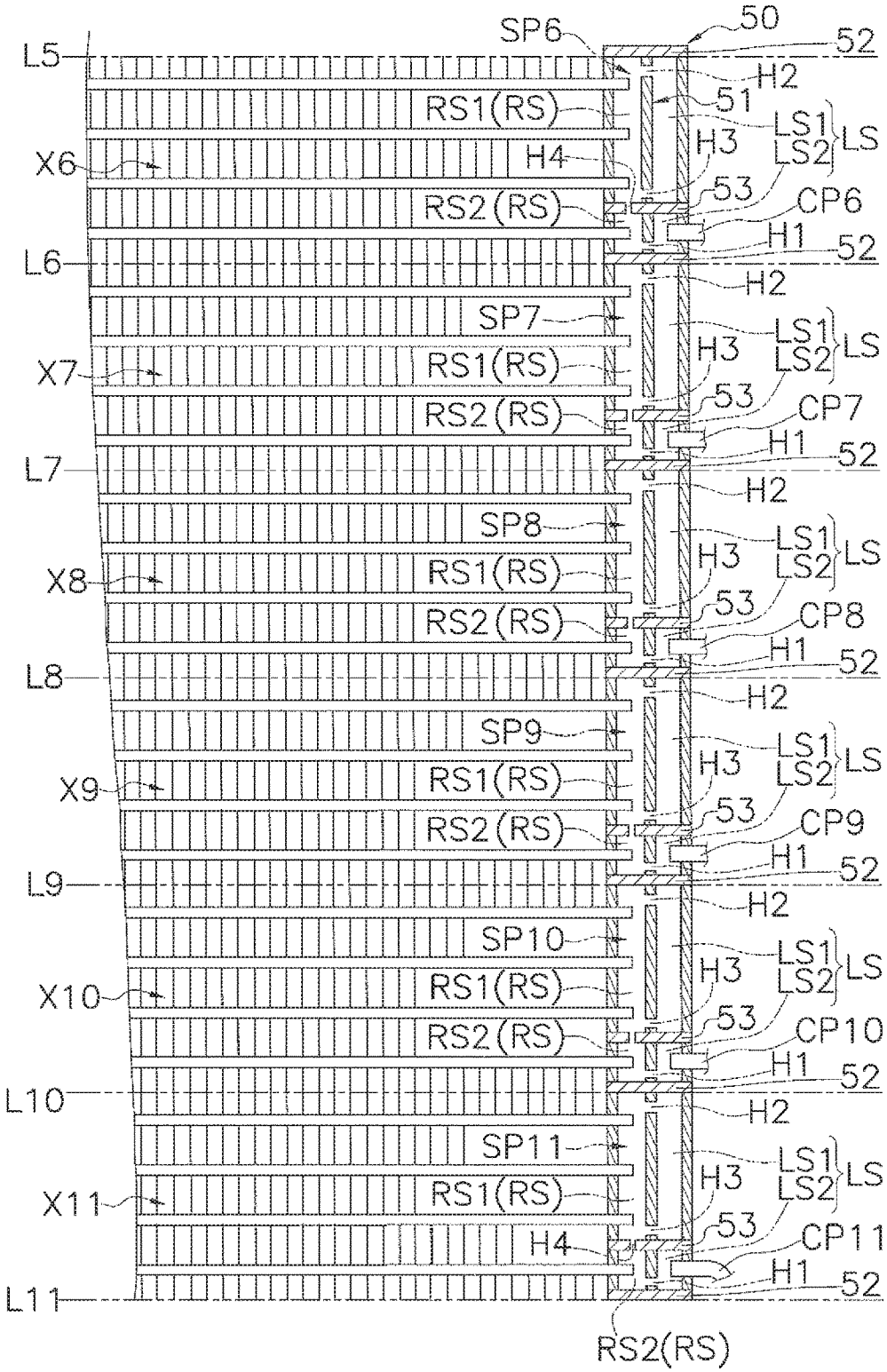
FIG. 11 is an enlargement of the portion above the double-dotted line L11 in FIG. 8, which is the portion below the double-dotted line L5.
Figure 12:
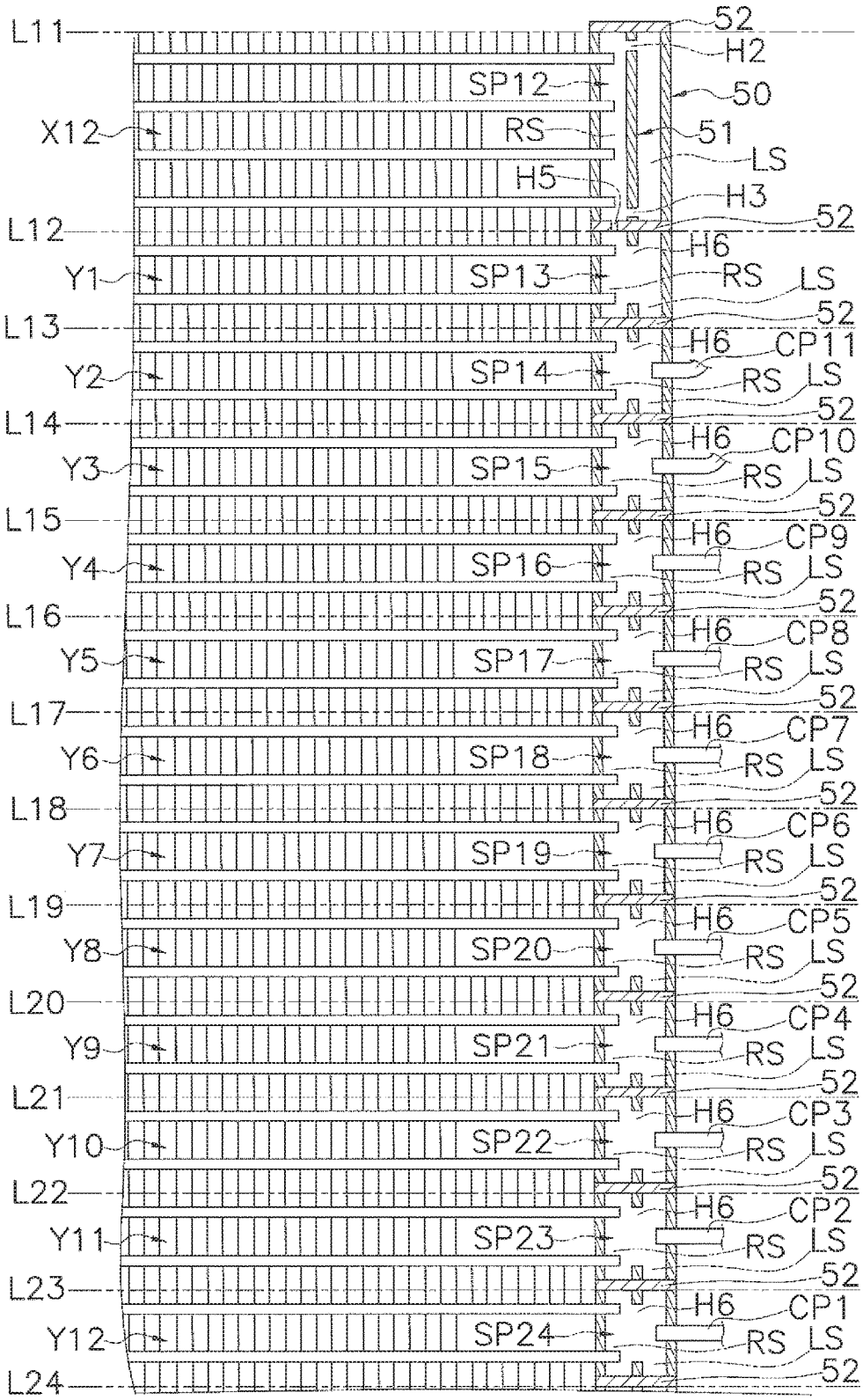
FIG. 12 is an enlargement of the portion above the double-dotted line L24 in FIG. 8, which is the portion below the double-dotted line L11.

FIG. 10 is an enlargement of the portion above the double-dotted line L5 in FIG. 8. FIG. 11 is an enlargement of the portion above the double-dotted line L11 in FIG. 8, which is the portion below the double-dotted line L5. FIG. 12 is an enlargement of the portion above the double-dotted line L24 in FIG. 8, which is the portion below the double-dotted line L11.

The second header collection tube 50 is a cylindrical tube that extends along the vertical direction. The second header collection tube 50 adjoins the forward side of the first header collection tube 45. The second header collection tube 50 is connected to the heat transfer tubes 31 of the heat-exchanging part 30.

A plurality of partitioning parts are provided inside the second header collection tube 50, as shown in FIGS. 10-12, whereby a plurality of spaces are formed.

Specifically, a plurality of first horizontal partitioning parts 52 extending along the horizontal direction are provided inside the second header collection tube 50. The first horizontal partitioning parts 52 partition the space within the second header collection tube 50 into top and bottom. Providing a plurality of the first horizontal partitioning parts 52 enables a plurality of spaces (twenty-four in the present embodiment) aligned in the up-and-down direction to be formed in the interior of the second header collection tube 50. In order from the top to the bottom as shown in FIGS. 10-12, the spaces within the second header collection tube 50 are referred to as a first space SP1, a second space SP2, a third space SP3, on through a twenty-fourth space SP24.

These spaces are connected to the heat transfer tubes 31 (i.e., one end of the first part 311) of the heat-exchanging parts (X or Y) included in the heat-exchanging part 30. Specifically, the first space SP1 is connected to the heat transfer tubes 31 of the first upper-side heat-exchanging part X1. The second space SP2 is connected to the heat transfer tubes of the second upper-side heat-exchanging part X2. The third space SP3 is connected to the heat transfer tubes of the third upper-side heat-exchanging part X3. The fourth space SP4 is connected to the heat transfer tubes of the fourth upper-side heat-exchanging part X4. The fifth space SP5 is connected to the heat transfer tubes of the fifth upper-side heat-exchanging part X5. The sixth space SP6 is connected to the heat transfer tubes of the sixth upper-side heat-exchanging part X6. The seventh space SP7 is connected to the heat transfer tubes of the seventh upper-side heat-exchanging part X7. The eighth space SP8 is connected to the heat transfer tubes of the eighth upper-side heat-exchanging part X8. The ninth space SP9 is connected to the heat transfer tubes of the ninth upper-side heat-exchanging part X9. The tenth space SP10 is connected to the heat transfer tubes of the tenth upper-side heat-exchanging part X10. The eleventh space SP11 is connected to the heat transfer tubes of the eleventh upper-side heat-exchanging part X11. The twelfth space SP12 is connected to the heat transfer tubes of the twelfth upper-side heat-exchanging part X12. The thirteenth space SP13 is connected to the heat transfer tubes 31 of the first lower-side heat-exchanging part Y1. The fourteenth space SP14 is connected to the heat transfer tubes of the second lower-side heat-exchanging part Y2. The fifteenth space SP15 is connected to the heat transfer tubes of the third lower-side heat-exchanging part Y3. The sixteenth space SP16 is connected to the heat transfer tubes of the fourth lower-side heat-exchanging part Y4. The seventeenth space SP17 is connected to the heat transfer tubes of the fifth lower-side heat-exchanging part Y5. The eighteenth space SP18 is connected to the heat transfer tubes of the sixth lower-side heat-exchanging part Y6. The nineteenth space SP19 is connected to the heat transfer tubes of the seventh lower-side heat-exchanging part Y7. The twentieth space SP20 is connected to the heat transfer tubes of the eighth lower-side heat-exchanging part Y8. The twenty-first space SP21 is connected to the heat transfer tubes of the ninth lower-side heat-exchanging part Y9. The twenty-second space SP22 is connected to the heat transfer tubes of the tenth lower-side heat-exchanging part Y10. The twenty-third space SP23 is connected to the heat transfer tubes of the eleventh lower-side heat-exchanging part Y11. The twenty-fourth space SP24 is connected to the heat transfer tubes of the twelfth lower-side heat-exchanging part Y12.

The number of the connected heat transfer tubes 31 in each of the first space SP1 through the twelfth space SP12 are the same in the present embodiment. The number of the connected heat transfer tubes 31 in each of the thirteenth space SP13 through the twenty-fourth space SP24 are also the same. However, the number of the heat transfer tubes 31 connected to these spaces can be set to a different number for each space appropriately in consideration of improving the flow speed of the refrigerant or the distributing performance during operation of the outdoor heat exchanger 13.

A vertical partitioning part 51 that extends along the vertical direction (the up-and-down direction) is also provided inside the second header collection tube 50. The vertical partitioning part 51 extends from the upper end to the lower end of the second header collection tube 50. Each of the first space SP1 through the twenty-fourth space SP24 is therefore laterally partitioned and are divided into a left-side space LS (corresponding to the "rear-side space" described in Claims) and a right-side space RS (corresponding to the "front-side space" described in Claims).

A plurality of second horizontal partitioning parts 53 extending along the horizontal direction are also provided in each of the first space SP1 through eleventh space SP11. Providing the second horizontal partitioning parts 53 enables each of the first space SP1 through the eleventh space SP11 to be partitioned into top and bottom. In other words, the interior of each of the first space SP1 through the eleventh space SP11 is partitioned by the vertical partitioning part 51 and the second horizontal partitioning parts 53. Therefore, in the interior of each of the first space SP1 through the eleventh space SP11, the left-side space LS is further partitioned into top and bottom, and the right-side space RS is further partitioned into top and bottom. As a result, an upper-left-side space LS1, a lower-left-side space LS2, an upper-right-side space RS1, and a lower-right-side space RS2 are formed inside each of the first space SP1 through the eleventh space SP11, as shown in FIGS. 10 and 11. The upper-left-side space LS is positioned on the left side of the vertical partitioning part 51 and above the second horizontal partitioning part 53. The lower-left-side space LS2 is positioned on the left side of the vertical partitioning part 51 and below the second horizontal partitioning part 53. The upper-right-side space RS1 is positioned on the right side of the vertical partitioning part 51 and above the second horizontal partitioning part 53. The lower-right-side space RS2 is positioned on the right side of the vertical partitioning part 51 and below the second horizontal partitioning part 53.

A first through-hole H1 is formed in the vertical partitioning part 51 within each of the first space SP1 through the eleventh space SP11. The first through-hole H1 is formed at a boundary portion of the lower-left-side space LS2 and the lower-right-side space RS2. As a result, the lower-left-side space LS2 and the lower-right-side space RS2 are in communication via the first through-hole H1.

A second through-hole H2 and a third through-hole H3 are formed in the vertical partitioning part 51 within each of the first space SP1 through the twelfth space SP12. The second through-hole H2 is formed at an upper part of a boundary portion of the upper-left-side space LS1 (or the left-side space LS) and the upper-right-side space RS1 (or the right-side space RS). As a result, the vicinity of the upper end of the upper-left-side space LS1 (or the left-side space LS) and the vicinity of the upper end of the upper-right-side space RS1 (or the right-side space RS) are in communication via the second through-hole H2. The third through-hole H3 is formed at a lower part of a boundary portion of the upper-left-side space LS1 (or the left-side space LS) and the upper-right-side space RS1 (or the right-side space RS). As a result, the vicinity of the lower end of the upper-left-side space LS1 (or the left-side space LS) and the vicinity of the lower end of the upper-right-side space RS1 (or the right-side space RS) are in communication via the third through-hole H3.

A fourth through-hole H4 is formed in the second horizontal partitioning parts 53 within each of the first space SP1 through the eleventh space SP11. The fourth through-hole H4 is formed at a boundary portion of the upper-right-side space RS1 and the lower-right-side space RS2. As a result, the upper-right-side space RS1 and the lower-right-side space RS2 are in communication via the fourth through-hole H4. A part of the fourth through-hole H4 is superimposed on the heat transfer tubes 31 when viewed from above.

A fifth through-hole H5 is formed in the twelfth space SP12 in the first horizontal partitioning part 52 that partitions the twelfth space SP12 and the thirteenth space SP13. As a result, the twelfth space SP12 and the thirteenth space SP13 are in communication via the fifth through-hole H5.

A sixth through-hole H6 is formed in the vertical partitioning part 51 in the interior of each of the thirteenth space SP13 through the twenty-fourth space SP24. The sixth through-hole H6 is formed at a boundary portion of the left-side space LS and the right-side space RS. As a result, the left-side space LS and the right-side space RS are in communication via the sixth through-hole H6.

The sixth through-hole H6 is formed for the reasons below.

In cases where the sixth through-hole H6 is not formed in the vertical partitioning part 51 in the thirteenth space SP13 through the twenty-fourth space SP24, and the right-side space RS and the left-side space LS are not in communication, when the difference in pressure between the interior of the right-side space RS and the interior of the left-side space LS has grown large as a result of increasing inflow rate of the refrigerant, upon which the vertical partitioning part 51 could deform or break. Should such an event occur, the performance of the heat exchanger may decline.

To avoid such an event, the large sixth through-hole H6 is formed in the vertical partitioning part 51 in the present embodiment. The pressures in the interior of the right-side space RS and the interior of the left-side space LS are thereby readily held in equilibrium. As a result, deformation or breakage of the vertical partitioning part 51 is restrained. In other words, during operation, the sixth through-hole H6 functions as an aperture to suppress growth in the pressure difference between the interior of the right-side space RS and the interior of the left-side space LS.

One end of connecting pipes (CP1 through CP11) is connected to each of the first space SP1 through the eleventh space SP11 (i.e., to the lower-left-side space LS2), and the other end of the connecting pipes is connected to each of the fourteenth space SP14 through the twenty-fourth space SP24 (i.e., to the left-side space LS). As a result, each of the first space SP1 through the eleventh space SP11 communicates with one of the fourteenth space SP14 through the twenty-fourth space SP24 via the connecting pipe.

Specifically, the first space SP1 communicates with the twenty-fourth space SP24 via the first connecting pipe CP1. The second space SP2 communicates with the twenty-third space SP23 via the second connecting pipe CP2. The third space SP3 communicates with the twenty-second space SP22 via the third connecting pipe CP3. The fourth space SP4 communicates with the twenty-first space SP21 via the fourth connecting pipe CP4. The fifth space SP5 communicates with the twentieth space SP20 via the fifth connecting pipe CP5. The sixth space SP6 communicates with the nineteenth space SP19 via the sixth connecting pipe CP6. The seventh space SP7 communicates with the eighteenth space SP18 via the seventh connecting pipe CP7. The eighth space SP8 communicates with the seventeenth space SP17 via the eighth connecting pipe CP8. The ninth space SP9 communicates with the sixteenth space SP16 via the ninth connecting pipe CP9. The tenth space SP10 communicates with the fifteenth space SP15 via the tenth connecting pipe CP10. The eleventh space SP11 communicates with the fourteenth space SP14 via the eleventh connecting pipe CP11.

In the explanations below, the first connecting pipe CP1 through the eleventh connecting pipe CP1 will be referred to as connecting pipes CP.

As described above, the twelfth space SP12 and the thirteenth space SP13 are in communication not by the connecting pipes CP but by the fifth through-hole H5. In other words, the connecting pipes CP do not connect with the twelfth space SP12 and the thirteenth space SP13.

(3-4-2) Flow of Refrigerant within the Second Header Collection Tube 50

Figure 13:
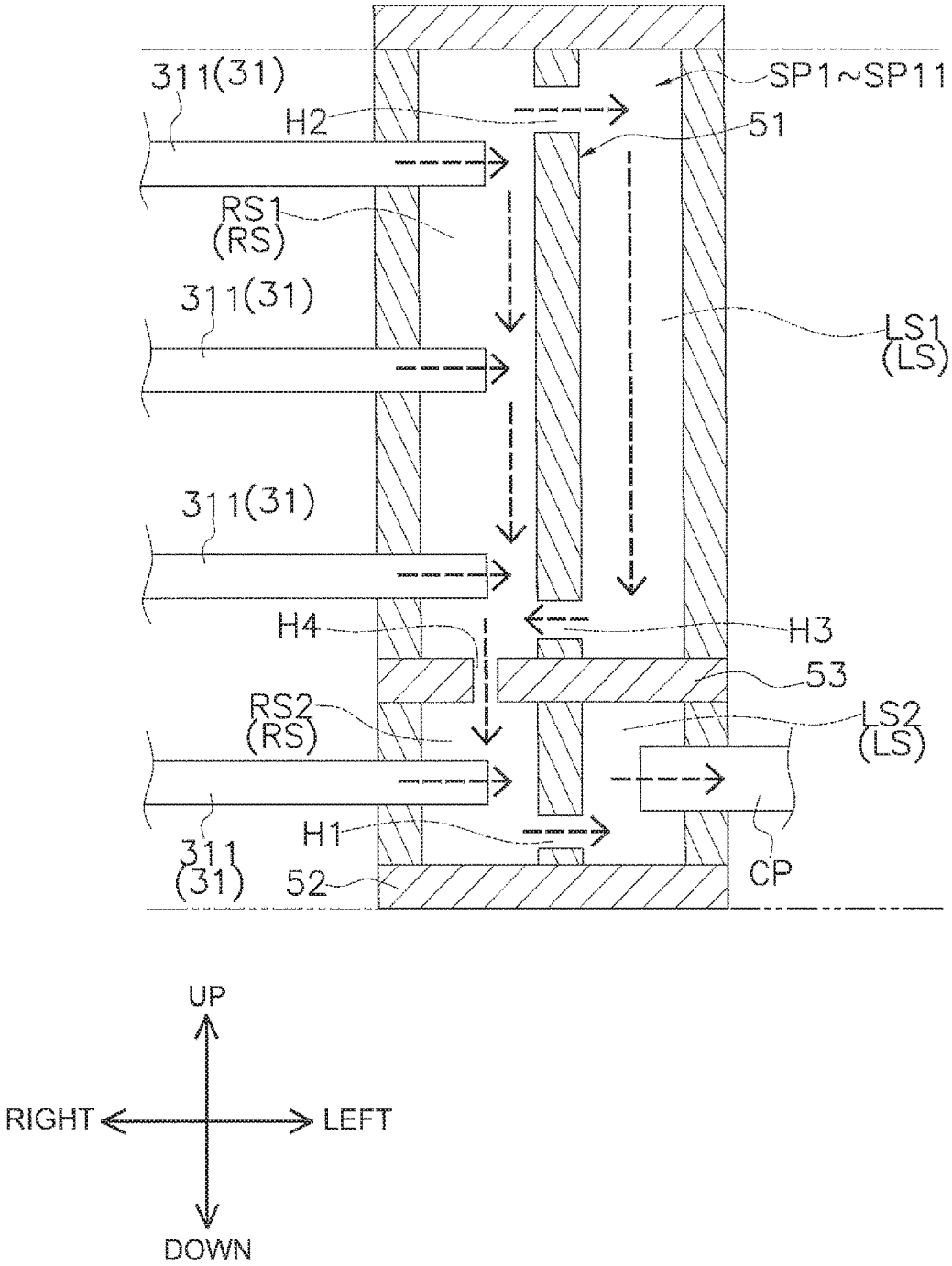
FIG. 13 is a schematic diagram showing the flow of refrigerant during cooling operation in each of the first space through the eleventh space.
Figure 14:
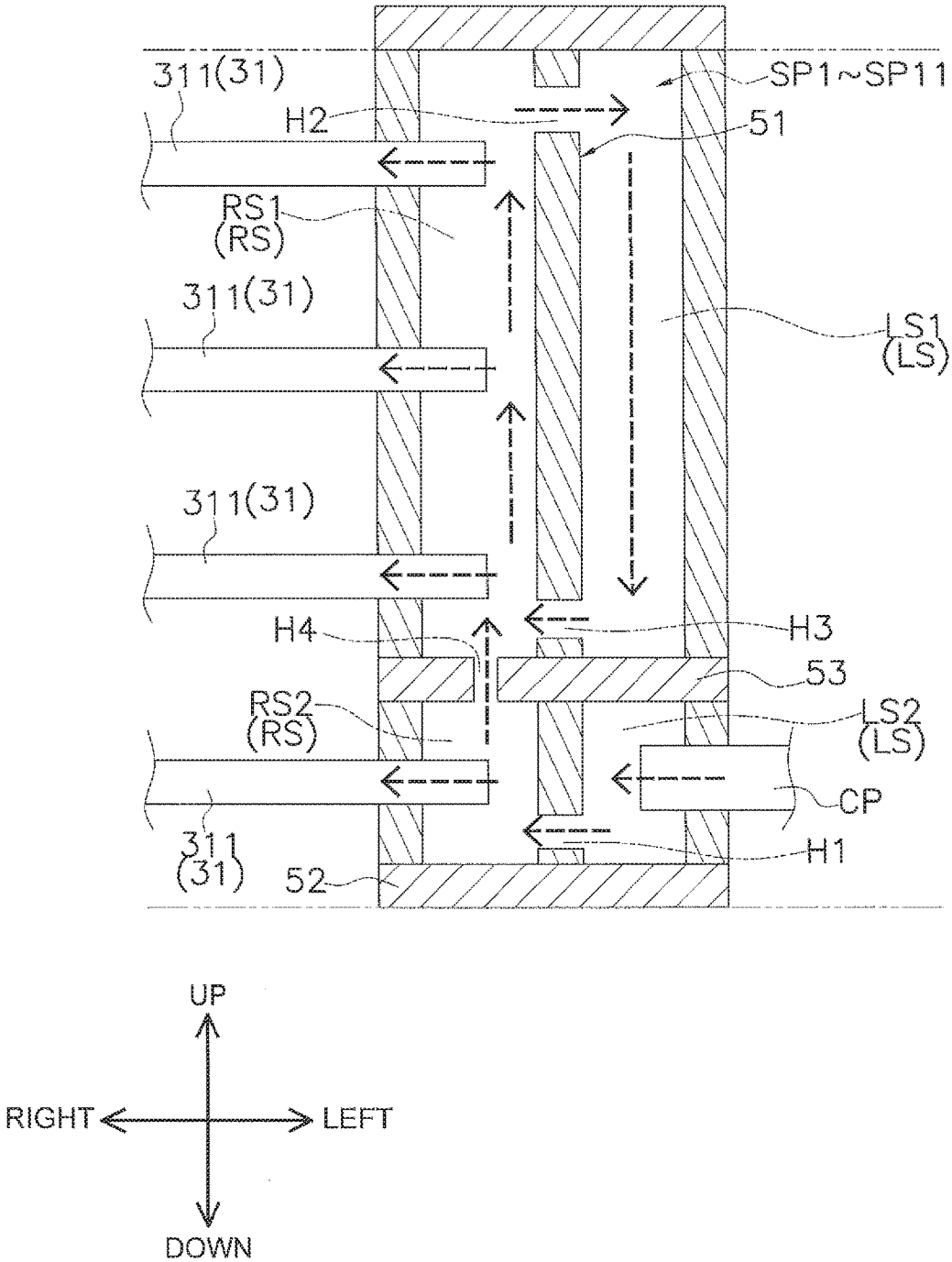
FIG. 14 is a schematic diagram showing the flow of refrigerant during heating operation in each of the first space through the eleventh space.

The flow of refrigerant within the second header collection tube 50 during cooling operation or heating operation will now be described. FIG. 13 is a schematic diagram showing the flow of refrigerant during cooling operation in each of the first space SP1 through the eleventh space SP11. FIG. 14 is a schematic diagram showing the flow of refrigerant during heating operation in each of the first space SP1 through the eleventh space SP11. The broken-line arrows in FIGS. 13 and 14 indicate the direction in which the refrigerant flows.

(3-4-2-1) During Cooling Operation

During cooling operation, the refrigerant flows into each of the first space SP1 through the twelfth space SP12 from the heat transfer tubes 31 (first part 311) of the corresponding upper-side heat-exchanging part X (X1 through X12). The refrigerant also flows into each of the thirteenth space SP13 through the twenty-fourth space SP24 from any of the first space SP1 through the twelfth space SP12 via the corresponding connecting pipes CP (or the fifth through-hole H5).

In the each of the first space SP1 through the eleventh space SP11, the refrigerant flows into the upper-right-side space RS1 and the lower-right-side space RS2 from the heat transfer tubes 31, as shown in FIG. 13. One part of the refrigerant that has flowed into the upper-right-side space RS1 flows toward the fourth through-hole H4 (downward) and flows out to the lower-right-side space RS2 via the fourth through-hole H4. The other part of the refrigerant that has flowed into the upper-right-side space RS1 flows toward the second through-hole H2 (upward) and flows out to the upper-left-side space LS1 via the second through-hole H2. The refrigerant that has flowed into the upper-left-side space LS1 flows toward the third through-hole H3 (downward) and again flows into the upper-right-side space RS1 via the third through-hole H3. The refrigerant that has flowed again into the upper-right-side space RS1 joins the refrigerant flowing toward the fourth through-hole H4 (downward) and flows out to the lower-right-side space RS2 via the fourth through-hole H4.

Meanwhile, the refrigerant that has flowed into the lower-right-side space RS2 from the heat transfer tubes 31 or the fourth through-hole H4 flows toward the first through-hole H1 and flows out to the lower-left-side space LS2 via the first through-hole H1. The refrigerant that has flowed into the lower-left-side space LS2 flows out to the connecting pipes CP.

As described above, the second through-hole H2 and the third through-hole H3 are formed in the vertical partitioning part 51 in each of the first space SP1 through the eleventh space SP11, whereby one part of the refrigerant that has flowed into the upper-right-side space RS1 during cooling operation flows out to the upper-left-side space LS1 via the second through-hole H2 and the third through-hole H3.

In the twelfth space SP12, the refrigerant flows into the right-side space RS from the heat transfer tubes 31 of the twelfth upper-side heat-exchanging part X12. One part of the refrigerant that has flowed into the right-side space RS flows toward the fifth through-hole H5 (downward) and flows out to the thirteenth space SP13 via the fifth through-hole H5. The other part of the refrigerant that has flowed into the right-side space RS flows toward the second through-hole H2 (upward) and flows out to the left-side space LS via the second through-hole H2. The refrigerant that has flowed into the left-side space LS flows toward the third through-hole H3 (downward) and again flows into the right-side space RS via the third through-hole H3. One part of the refrigerant that again has flowed into the right-side space RS joins the refrigerant flowing toward the fifth through-hole H5 (downward) and flows out to the thirteenth space SP13 via the fifth through-hole H5, and the other part joins the refrigerant flowing toward the second through-hole H2 (upward) and again flows to the left-side space LS via the second through-hole H2.

As described above, the second through-hole H2 and the third through-hole H3 are formed in the vertical partitioning part 51 in the twelfth space SP12, whereby one part of the refrigerant that has flowed into the right-side space RS during cooling operation flows out to the left-side space LS via the second through-hole H2 and the third through-hole H3.

In the thirteenth space SP13, the refrigerant flows into the right-side space RS from the twelfth space SP12 via the fifth through-hole H5. The refrigerant that has flowed into the right-side space RS flows out to the heat transfer tubes 31 of the first lower-side heat-exchanging part Y1.

In each of the fourteenth space SP14 through the twenty-fourth space SP24, the refrigerant flows into the left-side space LS from any of the first space SP1 through the eleventh space SP11 via any of the connecting pipes CP. The refrigerant that has flowed into the left-side space LS flows out to the right-side space RS via the sixth through-hole H6. The refrigerant that has flowed into the right-side space RS flows out to the heat transfer tubes 31 of the corresponding lower-side heat-exchanging part Y (Y2-Y12).

As described above, during cooling operation in each of the first space SP1 through the twelfth space SP12, the refrigerant flows out from the upper-right-side space RS1 (or the right-side space RS) to the upper-left-side space LS1 (or the left-side space LS). Reasons therefor are given below.

In cases where the second through-hole H2 and the third through-hole H3 are not formed in the vertical partitioning part 51 in the first space SP1 through the twelfth space SP12, and the upper-right-side space RS1 (or the right-side space RS) and the upper-left-side space LS1 (or the left-side space LS) are not in communication, when the difference in pressure between the interior of the upper-right-side space RS1 (or the right-side space RS) and the interior of the upper-left-side space LS1 (or the left-side space LS) has grown large as a result of increasing inflow rate of the refrigerant, the vertical partitioning part 51 could deform or break. Should such an event occur, the performance of the heat exchanger may decline.

To avoid such an event, the second through-hole H2 and the third through-hole H3 are formed in the vertical partitioning part 51 in the present embodiment. When the refrigerant pressure within the upper-right-side space RS1 (or the right-side space RS) increases, and the difference with the pressure in the upper-left-side space LS1 (or the left-side space LS) has grown large, the refrigerant flows out from the upper-right-side space RS1 (or the right-side space RS) and into the upper-left-side space LS1 (or the left-side space LS). As a result, the pressures in the interior of the upper-right-side space RS1 (or the right-side space RS) and the interior of the upper-left-side space LS1 (or the left-side space LS) are readily held in equilibrium. Deformation or breakage of the vertical partitioning part 51 is therefore restrained.

In other words, during cooling operation, the second through-hole H2 and the third through-hole H3 function as apertures to suppress growth in the pressure difference between the interior of the upper-right-side space RS1 (or the right-side space RS) and the interior of the upper-left-side space LS1 (or the left-side space LS).

(3-4-2-2) During Heating Operation

During heating operation, the refrigerant flows into each of the thirteenth space SP13 through the twenty-fourth space SP24 from the heat transfer tubes 31 (the first part 311) of the corresponding lower-side heat-exchanging part Y (Y1-Y12). The refrigerant also flows into each of the first space SP1 through the twelfth space SP12 from any of the thirteenth space SP13 through the twenty-fourth space SP24 via the corresponding connecting pipes CP (or the fifth through-hole H5).

In the thirteenth space SP13, the refrigerant flows into the right-side space RS from the heat transfer tubes 31 of the first lower-side heat-exchanging part Y1. The refrigerant that has flowed into the right-side space RS flows out to the twelfth space SP12 via the fifth through-hole H5.

In each of the fourteenth space SP14 through the twenty-fourth space SP24, the refrigerant flows into the right-side space RS from the heat transfer tubes 31 of the corresponding lower-side heat-exchanging part Y (Y2-Y12). The refrigerant that has flowed into the right-side space RS flows out to the left-side space LS via the sixth through-hole H6. The refrigerant that has flowed into the left-side space LS flows out to the connected connecting pipe CP.

In each of the first space SP1 through the eleventh space SP11, the refrigerant flows into the lower-left-side space LS2 from any of the fourteenth space SP14 through the twenty-fourth space SP24 via the corresponding connecting pipes CP, as shown in FIG. 14. One part of the refrigerant that has flowed into the lower-left-side space LS2 flows toward the first through-hole H1 and flows out to the lower-right-side space RS2 via the first through-hole H1. One part of the refrigerant that has flowed into the lower-right-side space RS2 flows out to the heat transfer tubes 31 (the first part 311) connected to the lower-right-side space RS2. The other part of the refrigerant that has flowed into the lower-right-side space RS2 flows toward the fourth through-hole H4 (upward) and flows out to the upper-right-side space RS1 via the fourth through-hole H4.

A part of the fourth through-hole H4 is superimposed on the heat transfer tubes 31 when viewed from above, and therefore one part of the refrigerant that has flowed into the upper-right-side space RS1 from the fourth through-hole H4 collides with the heat transfer tubes 31. The flow rate of the refrigerant can thereby be restrained from growing too large, and biasing of the liquid-phase components and gas-phase components in the refrigerant is restrained.

One part of the refrigerant flowing into the upper-right-side space RS1 flows out to the heat transfer tubes 31 (the first part 311) connected to the upper-right-side space RS1, and the other part flows toward the second through-hole H2 (upward) and flows out to the upper-left-side space LS1 via the second through-hole H2. The refrigerant that has flowed into the upper-left-side space LS1 flows toward the third through-hole H3 (downward) and again flows into the upper-right-side space RS1 via the third through-hole H3. One part of the refrigerant that has flowed again into the upper-right-side space RS1 flows out to the heat transfer tubes 31 (the first part 311), and the other part flows toward the second through-hole H2 (upward) and again flows out to the upper-left-side space LS1 via the second through-hole H2. In other words, during heating operation, one part of the refrigerant that has flowed into each of the first space SP1 through the eleventh space SP11 loops between the upper-right-side space RS1 and the upper-left-side space LS1 via the second through-hole H2 and the third through-hole H3.

In the twelfth space SP12, the refrigerant flows into the right-side space RS from the thirteenth space SP13 via the fifth through-hole H5. One part of the refrigerant that has flowed into the right-side space RS flows out to the heat transfer tubes 31 (the first part 311) connected to the twelfth space SP12. The other part of the refrigerant that has flowed into the right-side space RS flows toward the second through-hole H2 (upward) and flows out to the left-side space LS via the second through-hole H2. The refrigerant that has flowed into the left-side space LS flows toward the third through-hole H3 (downward) and again flows into the right-side space RS via the third through-hole H3. One part of the refrigerant that again has flowed into the right-side space RS flows out to the heat transfer tubes 31 (the first part 311), and the other part flows toward the second through-hole H2 (upward) and again flows out to the left-side space LS via the second through-hole H2. In other words, during heating operation, one part of the refrigerant that has flowed into the twelfth space SP12 loops between the right-side space RS and the left-side space LS via the second through-hole H2 and the third through-hole H3.

As described above, during heating operation in each of the first space SP1 through the twelfth space SP12, the refrigerant is made to loop between the upper-right-side space RS1 (or the right-side space RS) and upper-left-side space LS1 (or the left-side space LS). Reasons therefor are given below.

In cases where the second through-hole H2 and the third through-hole H3 are not formed in the vertical partitioning part 51 in the first space SP1 through the twelfth space SP12, and the upper-right-side space RS1 (or the right-side space RS) and the upper-left-side space LS1 (or the left-side space LS) are not in communication, when the difference in pressure between the interior of the upper-right-side space RS1 (or the right-side space RS) and the interior of the upper-left-side space LS1 (or the left-side space LS) has grown large as a result of increasing inflowing rate of the refrigerant, the vertical partitioning part 51 could deform or break. Should such an event occur, the performance of the heat exchanger may decline.

To avoid such an event, the second through-hole H2 and the third through-hole H3 are formed in the vertical partitioning part 51 in the present embodiment. When the refrigerant pressure within the upper-right-side space RS1 (or the right-side space RS) increases, and the difference with the pressure in the upper-left-side space LS1 (or the left-side space LS) has grown large, the refrigerant flows out to the upper-left-side space LS1 (or the left-side space LS) from the upper-right-side space RS1 (or the right-side space RS) and loops between the upper-right-side space RS1 (or the right-side space RS) and the upper-left-side space LS1 (or the left-side space LS) until the pressure difference is relieved. As a result, the pressures in the interior of the upper-right-side space RS1 (or the right-side space RS) and the interior of the upper-left-side space LS1 (or the left-side space LS) are readily held in equilibrium. Deformation or breakage of the vertical partitioning part 51 is therefore restrained.

In other words, during heating operation, the second through-hole H2 and the third through-hole H3 function as apertures to suppress growth in the pressure difference between the interior of the upper-right-side space RS1 (or the right-side space RS) and the interior of the upper-left-side space LS1 (or the left-side space LS).

(4) Details of the Second Header Collection Tube 50

Figure 15:
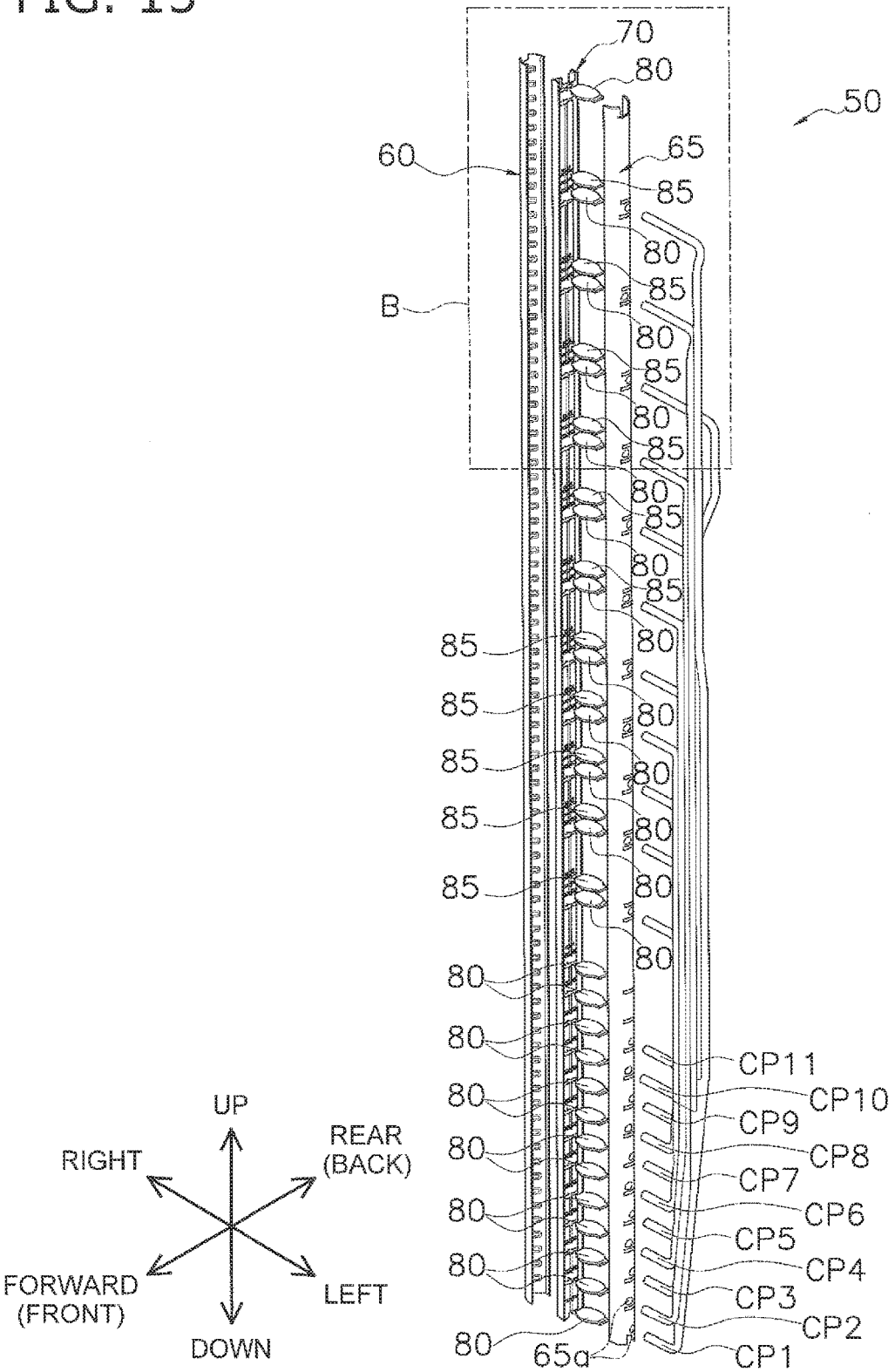
FIG. 15 is an exploded view of the second header collection tube.
Figure 16:
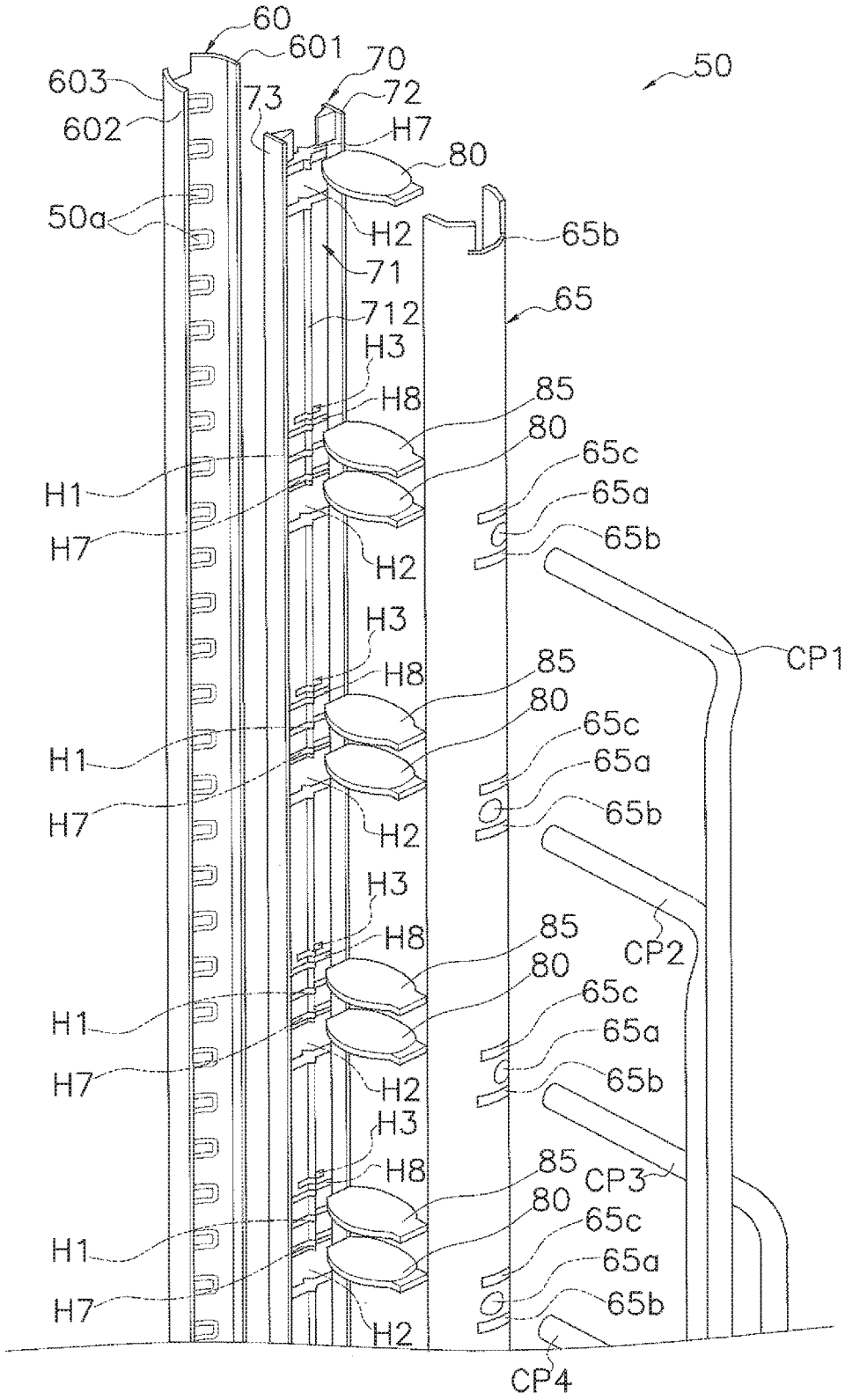
FIG. 16 is an enlarged view of the B portion in FIG. 15.
Figure 17:
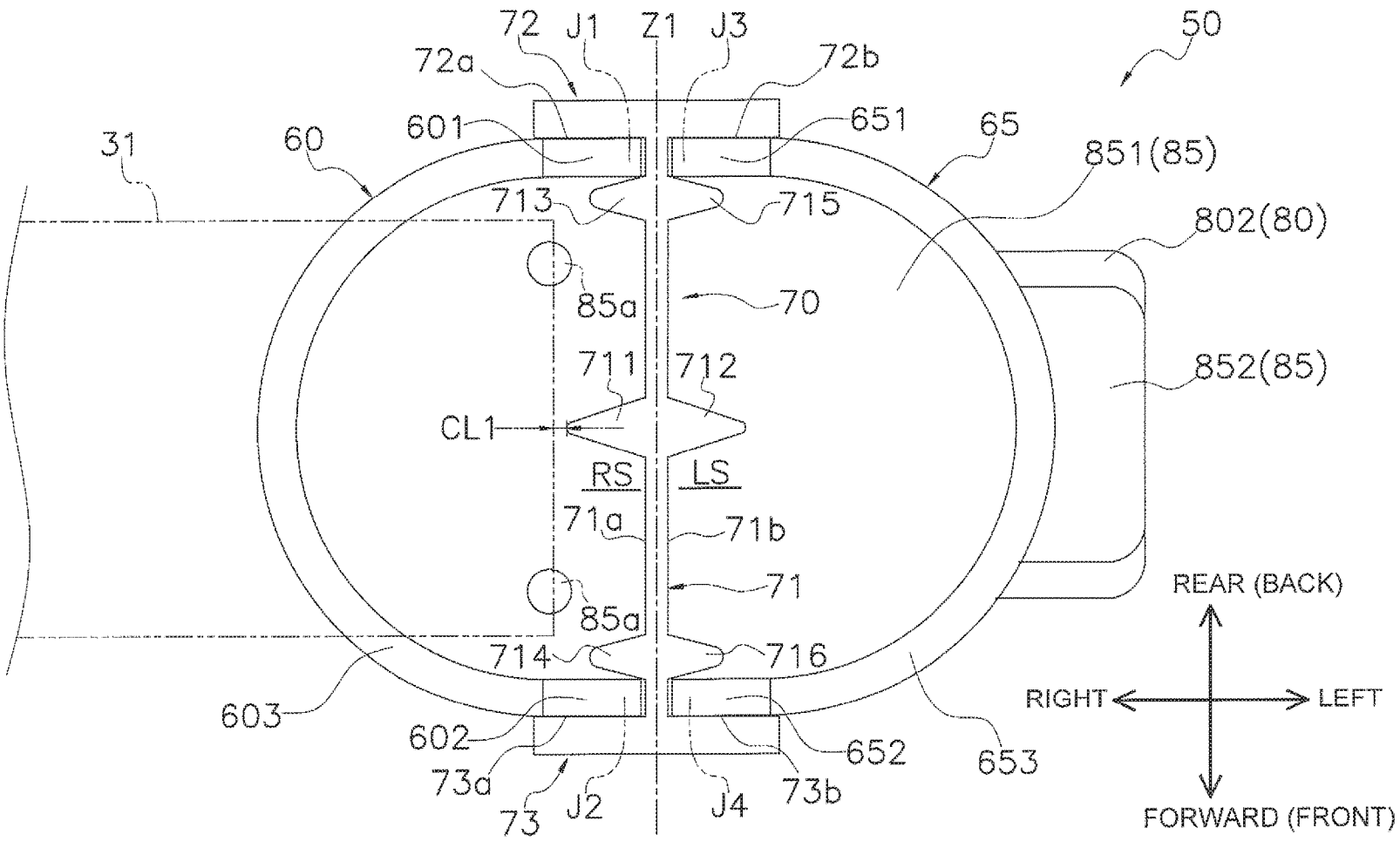
FIG. 17 is a cross-sectional view of the second header collection tube.

FIG. 15 is an exploded view of the second header collection tube 50. FIG. 16 is an enlarged view of the B portion in FIG. 15. FIG. 17 is a cross-sectional view of the second header collection tube 50.

The second header collection tube 50 is configured from the joining of a plurality of members. Specifically, the second header collection tube 50 has a right-side outline member 60 (corresponding to the "front-side member" described in Claims), a left-side outline member 65 (corresponding to the "rear-side member" described in Claims), a central vertical member 70 (corresponding to the "central member" described in Claims), a plurality (twenty-five in the present embodiment) of first baffles 80 (corresponding to the "partitioning members" described in Claims), a plurality (eleven in the present embodiment) of second baffles 85 (corresponding to the "partitioning members" described in Claims), and the eleven connecting pipes CP (CP1-CP11). These members are brazed together and thereby configured integrally.

(4-1) The Right-side Outline Member 60

The right-side outline member 60 configures an outline of the right side (the side of the heat transfer tubes 31) of the second header collection tube 50. The right-side outline member 60 extends from the upper end to the lower end of the second header collection tube 50. The right-side outline member 60 has a cross-section that curves in an arch shape. One part at the upper-end portion of the right-side outline member 60 is cut out.

The right-side outline member 60 primarily includes a right-side-outline-member-trailing-end part 601 (corresponding to the "front-side-member-first-end part" described in Claims), a right-side-outline-member-leading-end part 602 (corresponding to the "front-side-member-second-end part" described in Claims), and a right-side-outline-member-intermediate part 603.

The right-side-outline-member-trailing-end part 601 configures one end of the right-side outline member 60 and faces the back-surface side. The right-side-outline-member-trailing-end part 601 extends from the upper end to the lower end of the right-side outline member 60. An outer surface and an inner surface of the right-side-outline-member-trailing-end part 601 are of a flat configuration. The outer surface of the right-side-outline-member-trailing-end part 601 faces a first-flange-right-side-inner surface 72*a* (described hereinbelow) of a first flange 72 of the central vertical member 70.

The right-side-outline-member-leading-end part 602 configures the other end of the right-side outline member 60 and faces the front-surface side. The right-side-outline-member-leading-end part 602 extends from the upper end to the lower end of the right-side outline member 60. An outer surface and an inner surface of the right-side-outline-member-leading-end part 602 are of a flat configuration. The outer surface of the right-side-outline-member-leading-end part 602 faces a second-flange-right-side-inner surface 73*a* (described hereinbelow) of a second flange 73 of the central vertical member 70. The inner surface of the right-side-outline-member-leading-end part 602 faces the inner surface of the right-side-outline-member-trailing-end part 601.

The right-side-outline-member-intermediate part 603 is a portion linking the right-side-outline-member-trailing-end part 601 and the right-side-outline-member-leading-end part 602. The right-side-outline-member-intermediate part 603 extends from the upper end to the lower end of the right-side outline member 60. The cross-section of the right-side-outline-member-intermediate part 603 is configured to be arcuate and curves so as to bulge out to the right. A plurality of heat-transfer-tube-inserting holes 50*a* (corresponding to the "insertion holes" described in the claims) are formed to insert the heat transfer tubes 31 in the right-side-outline-member-intermediate part 603. The heat-transfer-tube-inserting holes 50*a* are formed in the same numbers as the heat transfer tubes 31 (seventy-two in the present embodiment).

The right-side outline member 60 is formed using extrusion molding. The right-side-outline-member-trailing-end part 601, the right-side-outline-member-leading-end part 602, and the right-side-outline-member-intermediate part 603 are configured integrally.

(4-2) The Left-side Outline Member 65

The left-side outline member 65 configures an outline of the left side (the side of the connecting pipes CP) of the second header collection tube 50. The left-side outline member 65 extends from the upper end to the lower end of the second header collection tube 50. One part at the upper-end portion of the left-side outline member 65 is cut out. The left-side outline member 65 has a cross-section that curves into an arch shape.

The left-side outline member 65 primarily includes a left-side-outline-member-trailing-end part 651 (corresponding to the "rear-side-member-first-end part" described in Claims), a left-side-outline-member-leading-end part 652 (corresponding to the "rear-side-member-second-end part" described in Claims), and a left-side-outline-member-intermediate part 653.

The left-side-outline-member-trailing-end part 651 configures one end of the left-side outline member 65 and faces the back-surface side. The left-side-outline-member-trailing-end part 651 extends from the upper end to the lower end of the left-side outline member 65. An outer surface and an inner surface of the left-side-outline-member-trailing-end part 651 are of a flat configuration. The outer surface of the left-side-outline-member-trailing-end part 651 faces a first-flange-left-side-inner surface 72*b* (described hereinbelow) of the first flange 72 of the central vertical member 70.

The left-side-outline-member-leading-end part 652 configures the other end of the left-side outline member 65 and faces the front-surface side. The left-side-outline-member-leading-end part 652 extends from the upper end to the lower end of the left-side outline member 65. An outer surface and an inner surface of the left-side-outline-member-leading-end part 652 are of a flat configuration. The outer surface of the left-side-outline-member-leading-end part 652 faces a second-flange-left-side-inner surface 73*b* (described hereinbelow) of the second flange 73 of the central vertical member 70. The inner surface of the left-side-outline-member-leading-end part 652 faces the inner surface of the left-side-outline-member-trailing-end part 651.

The left-side-outline-member-intermediate part 653 is a portion linking the left-side-outline-member-trailing-end part 651 and the left-side-outline-member-leading-end part 652. The left-side-outline-member-intermediate part 653 extends from the upper end to the lower end of the left-side outline member 65. The cross-section of the left-side-outline-member-intermediate part 653 is configured to be arcuate and curves so as to bulge out to the left.

A plurality of connecting-pipe-inserting holes 65*a* are formed to insert one end or the other end of the connecting pipes CP in the left-side-outline-member-intermediate part 653. The connecting-pipe-inserting holes 65*a* are formed at double the number of the connecting pipes CP (twenty-two in the present embodiment).

The connecting-pipe-inserting holes 65*a* are vertically aligned in a staggered fashion. More specifically, the connecting-pipe-inserting holes 65*a* that adjoin vertically are laterally offset with respect to the axis extending along the vertical direction.

A plurality of first rib entry holes 65*b*, into which a first rib 802 (described hereinafter) of the first baffle 80 enters, and a plurality of second rib entry holes 65*c*, into which a second rib 852 (described hereinafter) of the second baffle enters, are formed in the left-side-outline-member-intermediate part 653.

The first rib entry holes 65*b* and the second rib entry holes 65*c* are formed so as to be vertically aligned from the upper end to the lower end of the left-side-outline-member-intermediate part 653. The first rib entry holes 65*b* are formed in the same numbers as the first baffles 80 (twenty-five in the present embodiment). The second rib entry holes 65*c* are formed in the same numbers as the second baffles 85 (eleven in the present embodiment).

Though described hereinafter, the sizes of the first ribs 802 and the second ribs 852 differ from each other in a forward-and-back direction, and, correspondingly, the lengths of the first rib entry holes 65*b* and the second rib entry holes 65*c* in the forward-and-back direction differ. More specifically, the first rib entry holes 65*b* are formed to be longer in the forward-and-back direction than the second rib entry holes 65*c*.

(4-3) The Central Vertical Member 70

The central vertical member 70 is a member plate-shaped and extends along the vertical direction. The central vertical member 70 extends from the upper end to the lower end of the second header collection tube 50. The central vertical member 70 has a cut-out part at a portion near the top end.

The central vertical member 70 has a cross-section configured to be substantially I-shaped or H-shaped, as shown in FIG. 17. The central vertical member 70 is configured to have axial symmetry with respect to an axis Z1 (see FIG. 17) extending along the forward-and-back direction. Assembly error can therefore be restrained when temporarily affixing the right-side outline member 60 and the left-side outline member 65 to the central vertical member 70 during the process for manufacturing the second header collection tube 50.

The central vertical member 70 primarily includes a vertical plate 71, the first flange 72 positioned at the backward end of the vertical plate 71, and the second flange 73 positioned at the forward end of the vertical plate 71. The vertical plate 71, the first flange 72, and the second flange 73 are configured integrally.

(4-3-1) The Vertical Plate 71

The vertical plate 71 is configured in a plate shape. The vertical plate 71 is provided upright so that the thickness thereof extends along the left-and-right direction. The vertical plate 71 extends from the upper end to the lower end of the second header collection tube 50. The vertical plate 71 has a right-side surface 71*a* which faces the right side (i.e., toward the heat transfer tubes 31), and a left-side surface 71*b* which faces the left side.

The vertical plate 71 functions as the aforedescribed vertical partitioning part 51 (see FIGS. 10-14) in the installation state. In other words, the vertical plate 71 can be said to be interchangeable with the vertical partitioning part 51. A plurality of the first through-holes H1, a plurality of the second through-holes H2, and a plurality of the third through-holes H3 are formed from the top end to the bottom end in the vertical plate 71. These first through-holes H1, second through-holes H2, and third through-holes H3 correspond respectively to the aforedescribed first through-hole H1, the second through-hole H2, and the third through-hole H3 (see FIGS. 10-14).

A plurality of first baffle entry holes H7 (corresponding to the "through-hole" described in Claims), which enable the first baffles 80 to pass, and a plurality of second baffle entry holes H8 (corresponding to the "through-hole" described in Claims), which enable the second baffles 85 to pass, are formed from the upper end to the lower end of the vertical plate 71. The first baffle entry holes H7 are formed in the same numbers as the first baffles 80 (twenty-five in the present embodiment). The second baffle entry holes H8 are formed in the same numbers as the second baffles 85 (eleven in the present embodiment).

The vertical plate 71 has a right-side central protruding part 711 which protrudes rightward from the right-side surface 71*a*, and a left-side central protruding part 712 which protrudes leftward from the left-side surface 71*b*. The right-side central protruding part 711 is provided to a central portion of the right-side surface 71*a*. The left-side central protruding part 712 is provided to a central portion of the left-side surface 71*b*.

The right-side central protruding part 711 and the left-side central protruding part 712 are configured to have the same shape. The right-side central protruding part 711 and the left-side central protruding part 712 both assume a substantially triangular shape and are configured to become narrower toward a distal end. The right-side central protruding part 711 and the left-side central protruding part 712 extend continuously from the upper end to the lower end of the vertical plate 71. However, the right-side central protruding part 711 and the left-side central protruding part 712 are interrupted so as to not be provided to portions where the first through-holes H1, the second through-holes H2, the third through-holes H3, the first baffle entry holes H7, and the second baffle entry holes H8 are formed.

Further, the function of the right-side central protruding part 711 and the left-side central protruding part 712 is described in "(6) Function of the right-side central protruding part 711 and the left-side central protruding part 712 in the central vertical member 70".

The vertical plate 71 has a right-back protruding part 713 (corresponding to the "first convex part" in Claims), a right-front protruding part 714 (corresponding to the "second convex part" in Claims), a left-back protruding part 715 (corresponding to the "third convex part" in Claims), and a left-front protruding part 716 (corresponding to the "fourth convex part" in Claims).

The right-back protruding part 713 protrudes rightward from the vicinity of a trailing-end part of the right-side surface 71*a* (in the vicinity of the first flange 72). Along with the first flange 72, the right-back protruding part 713 forms a first entry part J1 for entry of the right-side-outline-member-trailing-end part 601 during assembly.

The right-front protruding part 714 protrudes rightward from the vicinity of a leading-end part of the right-side surface 71*a* (in the vicinity of the second flange 73). Along with the second flange 73, the right-front protruding part 714 forms a second entry part J2 for entry of the right-side-outline-member-leading-end part 602 during assembly.

The left-back protruding part 715 protrudes leftward from the vicinity of a trailing-end part of the left-side surface 71*b* (in the vicinity of the first flange 72). Along with the first flange 72, the left-back protruding part 715 forms a third entry part J3 for entry of the left-side-outline-member-trailing-end part 651 during assembly.

The left-front protruding part 716 protrudes leftward from the vicinity of a leading-end part of the left-side surface 71*b* (in the vicinity of the second flange 73). Along with the second flange 73, the left-front protruding part 716 forms a fourth entry part J4 for entry of the left-side-outline-member-leading-end part 652 during assembly.

The right-back protruding part 713, the right-front protruding part 714, the left-back protruding part 715, and the left-front protruding part 716 are configured to have the same shape and all assume a substantially triangular shape. In other words, the right-back protruding part 713, the right-front protruding part 714, the left-back protruding part 715, and the left-front protruding part 716 are configured to become narrower toward a distal end. A distal portion of the right-back protruding part 713, the right-front protruding part 714, the left-back protruding part 715, and the left-front protruding part 716 is a curved surface.

The right-back protruding part 713, the right-front protruding part 714, the left-back protruding part 715, and the left-front protruding part 716 extend continuously from the upper end to the lower end of the vertical plate 71. However, the right-back protruding part 713, the right-front protruding part 714, the left-back protruding part 715, and the left-front protruding part 716 are interrupted so as to not be formed at portions where the first through-holes H1, the second through-holes H2, the first baffle entry holes H7, and the second baffle entry holes H8 are formed.

(4-3-2) The First Flange 72 and the Second Flange 73

The first flange 72 extends along the left-and-right direction at a backward end of the vertical plate 71. The second flange 73 extends along the left-and-right direction at the forward end of the vertical plate 71. Further, the first flange 72 and the second flange 73 extend continuously in the vertical direction from the upper end to the lower end of the vertical plate 71. The first flange 72 and the second flange 73 are configured to have a rectangular cross-section.

The first flange 72 has the first-flange-right-side-inner surface 72*a* and the first-flange-left-side-inner surface 72*b*, which face forward. The second flange 73 has the second-flange-right-side-inner surface 73*a* and the second-flange-left-side-inner surface 73*b*, which face rearward. The first-flange-right-side-inner surface 72*a* and the second-flange-right-side-inner surface 73*a* are positioned further right side than the vertical plate 71, and the first-flange-left-side-inner surface 72*b* and the second-flange-left-side-inner surface 73*b* are positioned further left side than the vertical plate 71. The first-flange-right-side-inner surface 72*a*, the first-flange-left-side-inner surface 72*b*, the second-flange-right-side-inner surface 73*a*, and the second-flange-left-side-inner surface 73*b* are all flat surfaces.

Along with the right-back protruding part 713, the first-flange-right-side-inner surface 72*a* forms the first entry part J1 to the right of the vertical plate 71. Along with the left-back protruding part 715, the first-flange-left-side-inner surface 72*b* forms the third entry part J3 to the left of the vertical plate 71. In other words, the right-side-outline-member-trailing-end part 601 enters between the first-flange-right-side-inner surface 72*a* and the right-back protruding part 713, and the left-side-outline-member-trailing-end part 651 enters between the first-flange-left-side-inner surface 72*b* and the left-back protruding part 715.

Along with the right-front protruding part 714, the second-flange-right-side-inner surface 73*a* forms the second entry part J2 to the right of the vertical plate 71. Along with the left-front protruding part 716, the second-flange-left-side-inner surface 73*b* forms the fourth entry part J4 to the left of the vertical plate 71. In other words, the right-side-outline-member-leading-end part 602 enters between the second-flange-right-side-inner surface 73*a* and the right-front protruding part 714, and the left-side-outline-member-leading-end part 652 enters between the second-flange-left-side-inner surface 73*b* and the left-front protruding part 716.

The inner surfaces of the first flange 72 (the first-flange-right-side-inner surface 72*a* and the first-flange-left-side-inner surface 72*b*) face the outer surfaces of the right-side-outline-member-trailing-end part 601 and the left-side-outline-member-trailing-end part 651 and are joined to the outer surfaces of the right-side-outline-member-trailing-end part 601 and the left-side-outline-member-trailing-end part 651. In other words, the first flange 72 covers the outer surface of the right-side-outline-member-trailing-end part 601 and the left-side-outline-member-trailing-end part 651 from the outside. The first flange 72 could also be said to cover a joining portion of the second header collection tube 50 from the outside.

The inner surfaces of the second flange 73 (the second-flange-right-side-inner surface 73*a* and the second-flange-left-side-inner surface 73*b*) face the outer surfaces of the right-side-outline-member-leading-end part 602 and the left-side-outline-member-leading-end part 652 and are joined to the outer surfaces of the right-side-outline-member-leading-end part 602 and the left-side-outline-member-leading-end part 652. In other words, the second flange 73 covers the outer surface of the right-side-outline-member-leading-end part 602 and the left-side-outline-member-leading-end part 652 from the outside. The second flange 73 could also be said to cover a joining portion of the second header collection tube 50 from the outside.

The first flange 72 and the second flange 73 thus cover the joining portion of the second header collection tube 50 from the outside, thereby improving pressure resistance strength with respect to the refrigerant pressure within the second header collection tube 50.

In other words, in cases where the second header collection tube 50 is not covered from the outside, there could be instances where the joining portion could fail to resist pressure from the inside and break when the refrigerant pressure within the second header collection tube 50 becomes large.

In the present embodiment, in order to restrain the occurrence of such events, the first flange 72 which covers the right-side-outline-member-trailing-end part 601 and the left-side-outline-member-trailing-end part 651 from the outside are provided, and the second flange 73 which covers the right-side-outline-member-leading-end part 602 and the left-side-outline-member-leading-end part 652 from outside are provided. The pressure resistance strength of the joining portion of the second header collection tube 50 is thereby improved. As a result, the second header collection tube 50 does not readily break during operations and the like even when the refrigerant pressure within the second header collection tube 50 exceeds normally assumed values.

The first flange 72 and the second flange 73 are joined along with the right-side outline member 60 and the left-side outline member 65 at the respective flat surfaces, whereby the brazed surfaces can be stably realized during brazing. As a result, the quality of the brazing of the right-side outline member 60 and the left-side outline member 65 to the central vertical member 70 is improved, and both are stably joined.

(4-4) The First Baffle 80 and the Second Baffle 85

Figure 18:
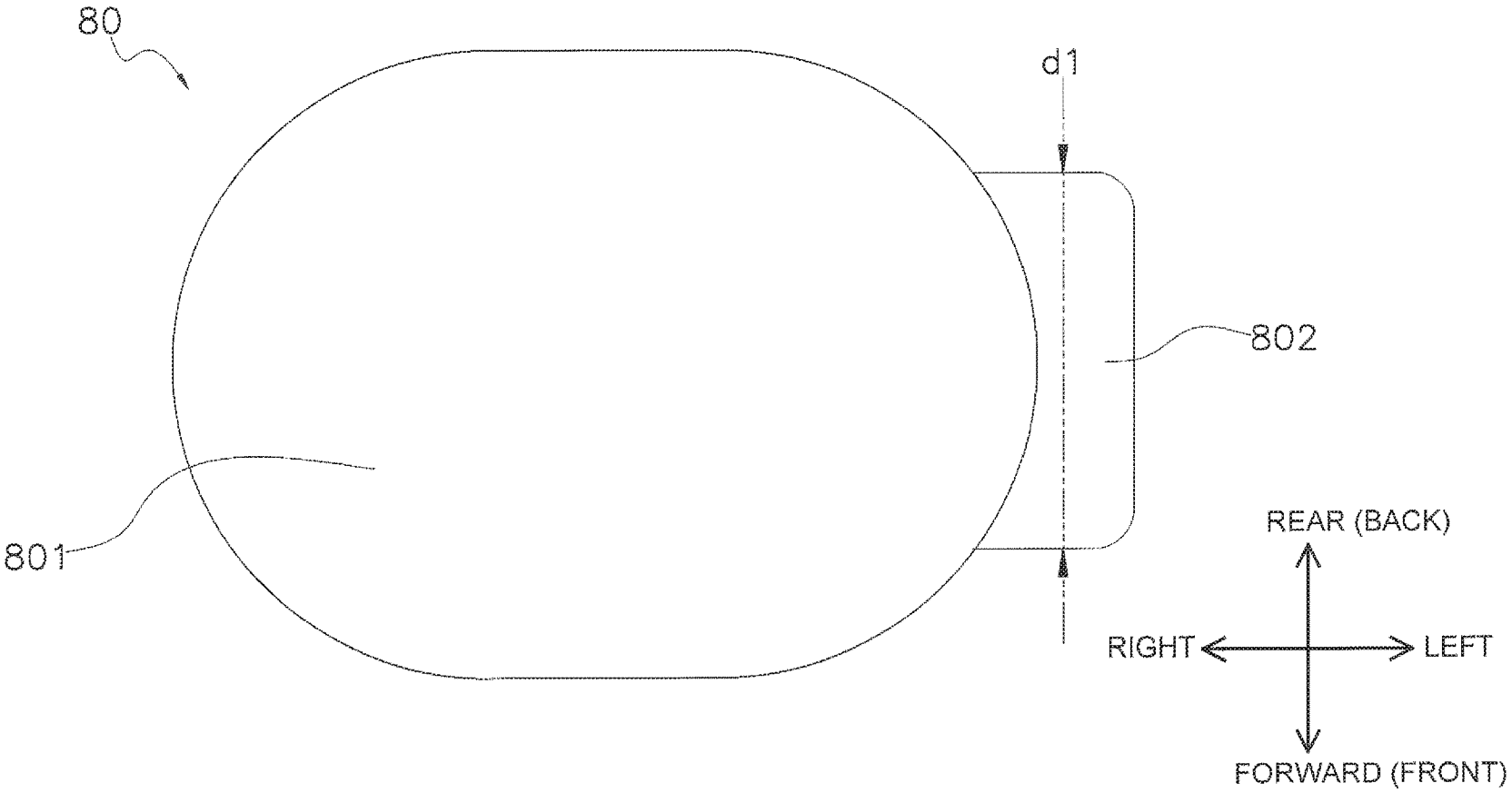
FIG. 18 is a plan view of the first baffle.
Figure 19:
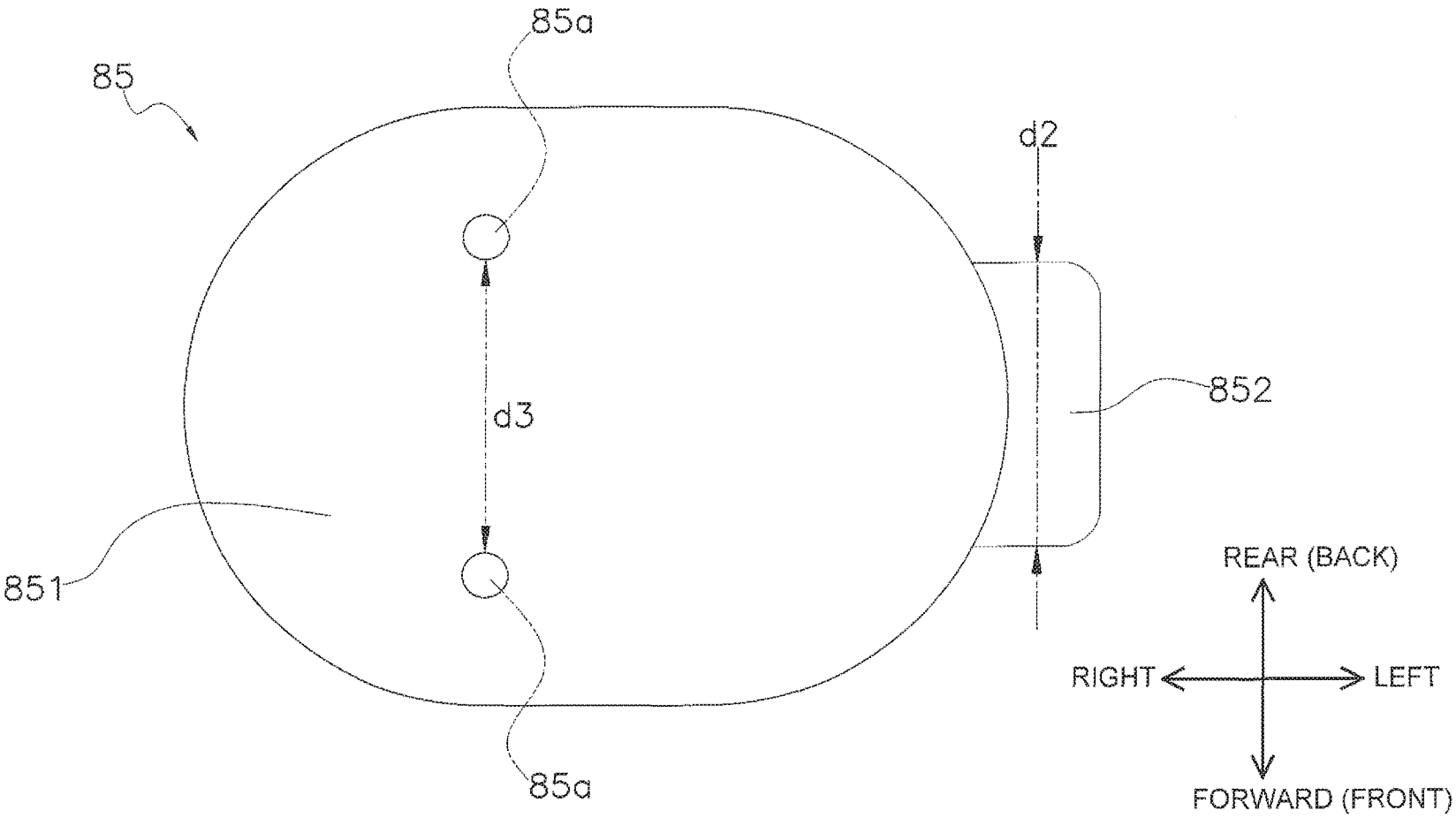
FIG. 19 is a plan view of the second baffle.

FIG. 18 is a plan view of the first baffle 80. FIG. 19 is a plan view of the second baffle 85.

The first baffle 80 and the second baffle 85 are members that extend horizontally within the second header collection tube 50. The first baffle 80 primarily has a first horizontal part 801 and the first rib 802. The second baffle 85 primarily has a second horizontal part 851 and the second rib 852.

The first horizontal part 801 and the second horizontal part 851 are configured to have an ellipsoid shape. The first horizontal part 801 and the second horizontal part 851 have an area adequate to horizontally partition the interior of the second header collection tube 50. The first horizontal part 801 and the second horizontal part 851 pass through the vertical plate 71 from the inner periphery of the right-side outline member 60 and extend to the inner periphery of the left-side outline member 65 in the interior of the second header collection tube 50. The first horizontal part 801 and the second horizontal part 851 partition the right-side space RS and the left-side space LS into top and bottom in the interior of the second header collection tube 50.

Specifically, the first horizontal part 801 configures a ceiling part in each of the first space SP1 through the twenty-fourth space SP24 (excluding the thirteenth space SP13). The first horizontal part 801 also configures a bottom part in each of the first space SP1 through the twenty-fourth space SP24 (excluding the twelfth space SP12). In other words, the first horizontal part 801 configures the top surface and bottom surface of the second header collection tube 50 and configures the ceiling and bottom part of the plurality of spaces within the second header collection tube 50. In other words, the first horizontal part 801 functions as the first horizontal partitioning part 52 (see FIGS. 10-14) in each of the first space SP1 through the twenty-fourth space SP24 (excluding the twelfth space SP12).

The second horizontal part 851 partitions the right-side space RS into the upper-right-side space RS1 and the lower-right-side space RS2 and partitions the left-side space LS into the upper-left-side space LS1 and the lower-left-side space LS2 in each of the first space SP1 through the eleventh space SP11. In other words, the second horizontal part 851 functions as the second horizontal partitioning part 53 (see FIGS. 10-14) in each of the first space SP1 through the eleventh space SP11.

The second horizontal part 851 partitions the twelfth space SP12 and the thirteenth space SP13. In other words, the second horizontal part 851 functions as the first horizontal partitioning part 52 (see FIG. 12) in the twelfth space SP12.

Two apertures 85*a* are formed in the second horizontal part 851. The apertures 85*a* are positioned at the front and back.

During operation, the apertures 85*a* function as nozzles that send refrigerant present in one vertically adjoining space to other spaces. Specifically, the apertures 85*a* function as the fourth through-hole H4 (see FIGS. 10, 11, 13, and 14) in each of the first space SP1 through the eleventh space SP11 and function as the fifth through-hole H5 (see FIG. 12) in the twelfth space SP12.

A forward-to-back linear distance d3 between the apertures 85*a* is greater than the length of the third through-hole H3 in the forward-and-back direction. The refrigerant that has flowed out from the apertures 85*a* (i.e., the fourth through-hole H4 or the fifth through-hole H5) during operation thereby do not likely to flow into the third through-hole H3.

The first rib 802 extends leftward from a left-side end part of the first horizontal part 801. The first rib 802 is a portion that enters into the first rib entry hole 65*b* from the inner-surface side of the left-side outline member 65 during assembly of the second header collection tube 50. A size d1 in the forward-and-back direction of the first rib 802 is substantially the same as the size of the first rib entry hole 65*b* in the forward-and-back direction. The size of the first rib 802 in the up-and-down direction is also substantially the same as the size of the first rib entry hole 65*b* in the up-and-down direction. Providing the first rib 802 in this manner enables the first baffle 80 to be readily installed when assembling the second header collection tube 50 before brazing.

The second rib 852 extends leftward from a left-side end part of the second horizontal part 851. The second rib 852 is a portion that enters into the second rib entry hole 65*c* from the inner-surface side of the left-side outline member 65 during assembly of the second header collection tube 50. A size d2 in the forward-and-back direction of the second rib 852 is substantially the same as the size of the second rib entry hole 65*c* in the forward-and-back direction. The size of the second rib 852 in the up-and-down direction is also substantially the same as the size of the second rib entry hole 65*c* in the up-and-down direction. Providing the second rib 852 in this manner enables the second baffle 85 to be readily installed when assembling the second header collection tube 50 before brazing.

The size d2 in the forward-and-back direction of the second rib 852 is smaller than the size d1 in the forward-and-back direction of the first rib 802. Due to this, the first rib entry hole 65*b* and the second rib entry hole 65*c* differ in length in the forward-and-back direction. Errors in the assembly of the first baffle 80 and the second baffle 85 therefore do not readily occur during assembly of the second header collection tube 50.

(4-5) The Connecting Pipe CP

The connecting pipes CP (CP1 through CP11) communicatingly connect any of the spaces (SP1 through SP24) to other spaces within the second header collection tube 50. The connecting pipes CP extend along the horizontal direction, then curve and extend along the vertical direction, and then curve further and extend along the horizontal direction. The first connecting pipe CP1 through the eleventh connecting pipe CP11 shown in FIG. 15 correspond to the first connecting pipe CP1 through the eleventh connecting pipe CP11 shown in FIG. 8 and FIGS. 10-14.

Each of the first connecting pipe CP1 through the eleventh connecting pipe CP11 differ in piping length (length in the vertical direction). Specifically, the first connecting pipe CP1 is the longest, and then the order by piping length is the second connecting pipe CP2, the third connecting pipe CP3, the fourth connecting pipe CP4, the fifth connecting pipe CP5, the sixth connecting pipe CP6, the seventh connecting pipe CP7, the eighth connecting pipe CP8, the ninth connecting pipe CP9, the tenth connecting pipe CP10, and the eleventh connecting pipe CP11.

The two ends of each connecting pipe CP are inserted into the respective connecting-pipe-inserting holes 65*a* formed in the left-side outline member 65.

Specifically, one end of the first connecting pipe CP1 is inserted into the uppermost connecting-pipe-inserting hole 65*a*. One end of the second connecting pipe CP2 is inserted into the second uppermost connecting-pipe-inserting hole 65*a*. One end of the third connecting pipe CP3 is inserted into the third uppermost connecting-pipe-inserting hole 65*a*. One end of the fourth connecting pipe CP4 is inserted into the fourth uppermost connecting-pipe-inserting hole 65*a*. One end of the fifth connecting pipe CP5 is inserted into the fifth uppermost connecting-pipe-inserting hole 65*a*. One end of the sixth connecting pipe CP6 is inserted into the sixth uppermost connecting-pipe-inserting hole 65*a*. One end of the seventh connecting pipe CP7 is inserted into the seventh uppermost connecting-pipe-inserting hole 65*a*. One end of the eighth connecting pipe CP8 is inserted into the eighth uppermost connecting-pipe-inserting hole 65*a*. One end of the ninth connecting pipe CP9 is inserted into the ninth uppermost connecting-pipe-inserting hole 65*a*. One end of the tenth connecting pipe CP10 is inserted into the tenth uppermost connecting-pipe-inserting hole 65*a*. One end of the eleventh connecting pipe CP11 is inserted into the eleventh uppermost connecting-pipe-inserting hole 65*a*.

The other end of the first connecting pipe CP1 is inserted into the lowest connecting-pipe-inserting hole 65*a*. The other end of the second connecting pipe CP2 is inserted into the second lowest connecting-pipe-inserting hole 65*a*. The other end of the third connecting pipe CP3 is inserted into the third lowest connecting-pipe-inserting hole 65*a*. The other end of the fourth connecting pipe CP4 is inserted into the fourth lowest connecting-pipe-inserting hole 65*a*. The other end of the fifth connecting pipe CP5 is inserted into the fifth lowest connecting-pipe-inserting hole 65*a*. The other end of the sixth connecting pipe CP6 is inserted into the sixth lowest connecting-pipe-inserting hole 65*a*. The other end of the seventh connecting pipe CP7 is inserted into the seventh lowest connecting-pipe-inserting hole 65*a*. The other end of the eighth connecting pipe CP8 is inserted into the eighth lowest connecting-pipe-inserting hole 65*a*. The other end of the ninth connecting pipe CP9 is inserted into the ninth lowest connecting-pipe-inserting hole 65*a*. The other end of the tenth connecting pipe CP10 is inserted into the tenth lowest connecting-pipe-inserting hole 65*a*. The other end of the eleventh connecting pipe CP11 is inserted into the eleventh lowest connecting-pipe-inserting hole 65*a*.

As described above, the connecting-pipe-inserting holes 65*a* are vertically aligned in staggered fashion, and thus vertical adjoining pipes from among the first connecting pipe CP1 through the eleventh connecting pipe CP11 are offset to the left and right with respect to an axis extending vertically. The plurality of the connecting pipes CP can thereby be compactly installed together, and making the second header collection tube 50 more compact is facilitated.

(5) Method for Manufacturing the Second Header Collection Tube 50

Figure 20:
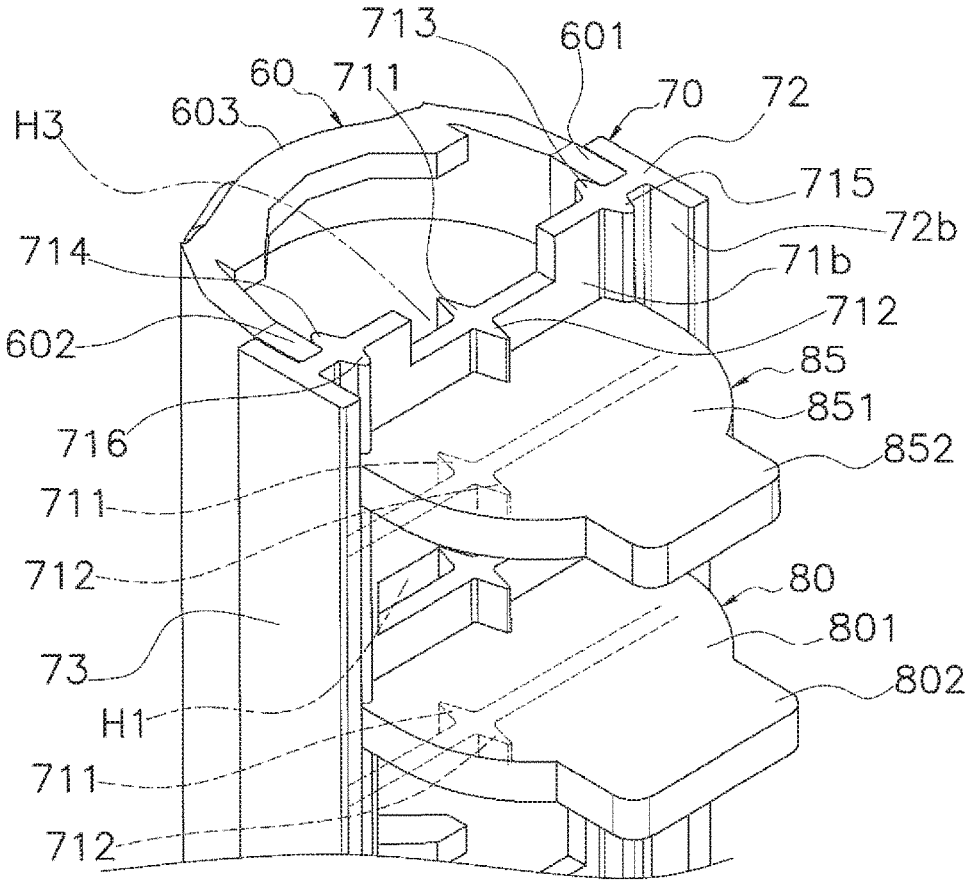
FIG. 20 is a partial enlargement of the cross-section in a state in which the first baffle and the second baffle have entered into the central vertical member while the right-side outline member is temporarily affixed to the central vertical member.
Figure 20:
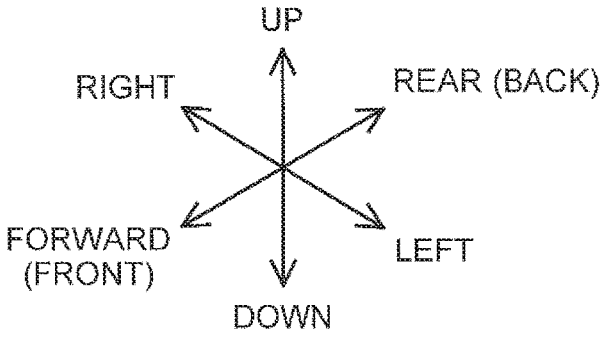
Figure 21:
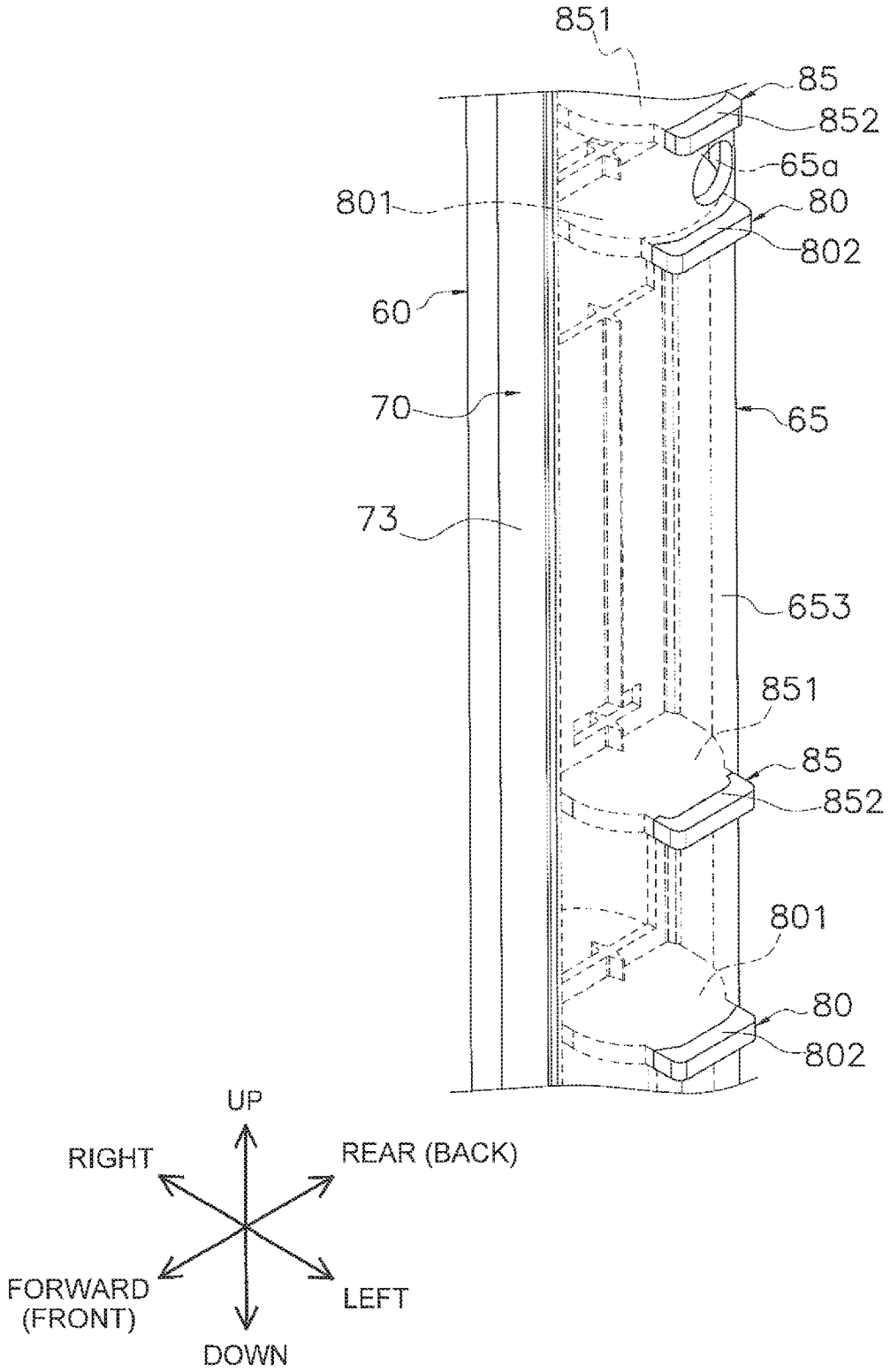
FIG. 21 is a partial enlarged view schematically showing a state in which the left-side outline member is temporarily affixed to the central vertical member in the state of FIG. 20.
Figure 22:
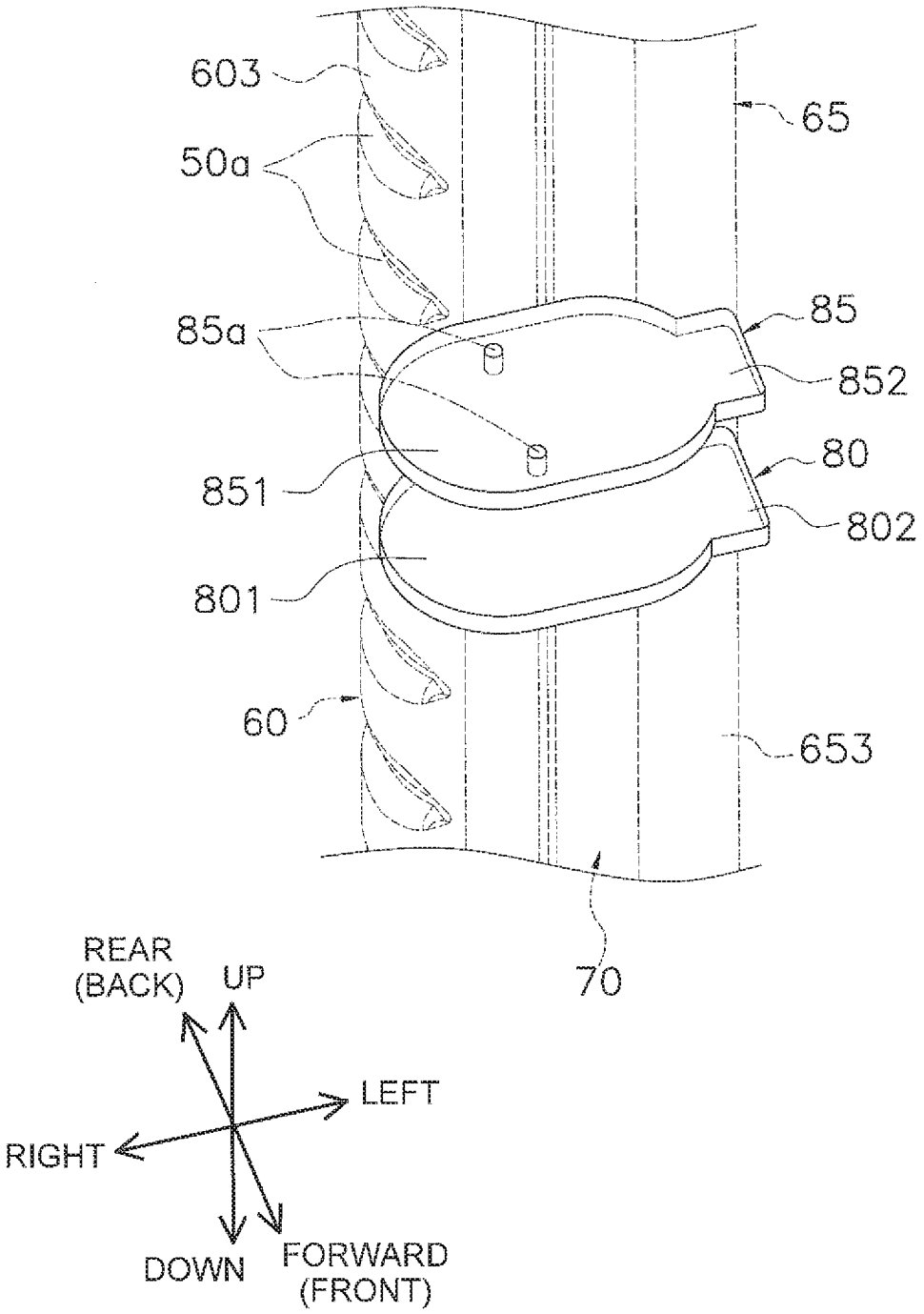
FIG. 22 is a partial enlarged view of the state in FIG. 21 as viewed from another direction (a display highlighting the first baffle and the second baffle)

FIG. 20 is a partial enlargement of the cross-section in a state in which the first baffle 80 and the second baffle 85 have entered into the central vertical member 70 while the right-side outline member 60 is temporarily affixed to the central vertical member 70. FIG. 21 is a partial enlarged view schematically showing a state in which the left-side outline member 65 is temporarily affixed to the central vertical member in the state of FIG. 20. FIG. 22 is a partial enlarged view of the state in FIG. 21 as viewed from another direction (a display highlighting the first baffle 80 and the second baffle 85).

The process for manufacturing the second header collection tube 50 is performed according to the flow below. The flow below is an example, and appropriate modifications are possible.

The right-side outline member 60, the left-side outline member 65, the central vertical member 70, a predetermined number of the first baffles 80 and the second baffles 85, and a predetermined number of the connecting pipes CP are prepared. These members will have been extrusion molded and then machined or the like, after which predetermined apertures will have been formed and/or predetermined processing will have been performed.

The right-side-outline-member-trailing-end part 601 is next pressed into the first entry part J1 of the central vertical member 70, the right-side-outline-member-leading-end part 602 is pressed into the second entry part J2, and the right-side outline member 60 is temporarily affixed to the central vertical member 70.

The plurality of the first baffles 80 and the plurality of the second baffles 85 are next made to enter into the central vertical member 70 via the first baffle entry holes H7 or the second baffle entry holes H8.

When the first baffle 80 and the second baffle 85 have been made to enter into the central vertical member 70, the upper and lower surfaces of the first horizontal part 801 and the second horizontal part 851 contact the right-side central protruding part 711 and the left-side central protruding part 712, whereby the orientations thereof can be readily and stably held in place.

In other words, in cases where the right-side central protruding part 711 and the left-side central protruding part 712 are not provided, when the first baffle 80 and the second baffle 85 have entered into the central vertical member 70, the first baffle 80 and the second baffle 85 readily wobble, and the orientations are not readily stably held in place. Assembly is therefore difficult.

However, in the present embodiment, the right-side central protruding part 711 and the left-side central protruding part 712 are provided to the central vertical member 70, and in the state where the first baffle 80 and the second baffle 85 have been made to enter into the central vertical member 70 (i.e., the state shown in FIG. 20), the upper and lower surfaces of the first horizontal part 801 and the second horizontal part 851 contact the upper and lower edges of the right-side central protruding part 711 and the left-side central protruding part 712, whereby the first baffle 80 and the second baffle 85 do not readily wobble, and the orientations can be readily and stably held in place.

The left-side-outline-member-trailing-end part 651 is next pressed into the third entry part J3 of the central vertical member 70, the left-side-outline-member-leading-end part 652 is pressed into the fourth entry part J4, and the left-side outline member 65 is temporarily affixed to the central vertical member 70. While the first ribs 802 of the first baffles 80 and the second ribs 852 of the second baffles 85 enter into the corresponding first rib entry holes 65*b* and the second rib entry holes 65*c* respectively, the left-side outline member 65 is temporarily affixed to central vertical member 70.

As described above, the cross-section of the central vertical member 70 is configured in a shape having axial symmetry with respect to the axis Z1 (see FIG. 17) extending along the forward-and-back direction. In other words, the central vertical member 70 is configured in a shape having axial symmetry with respect to the axis Z1 which extends from the first flange 72 to the second flange 73, or extends along the thickness direction of the heat transfer tubes 31. Assembly error is thereby restrained in the process to this point for temporarily affixing the right-side outline member 60 and the left-side outline member 65 to the central vertical member 70.

Brazing is performed in a state in which the temporary fixations have concluded (i.e., the state in FIGS. 21 and 22). The brazing material is positioned at the first baffles 80, the second baffles 85, the outer and inner surfaces of the right-side-outline-member-trailing-end part 601 and the right-side-outline-member-leading-end part 602, and the outer surface of the left-side-outline-member-trailing-end part 651 and the left-side-outline-member-leading-end part 652 before assembly.

As described above, the right-back protruding part 713, the right-front protruding part 714, the left-back protruding part 715, and the left-front protruding part 716 for forming the first entry part J1, the second entry part J2, the third entry part J3, and the fourth entry part J4 in the central vertical member 70 have curved surfaces at the distal-end portions. When the right-side-outline-member-trailing-end part 601 enters into the first entry part J1, the right-side-outline-member-leading-end part 602 enters into the second entry part J2, the left-side-outline-member-trailing-end part 651 enters into the third entry part J3, and the left-side-outline-member-leading-end part 652 enters into the fourth entry part J4 respectively, the parts are easily held and made to enter into place.

The right-back protruding part 713, the right-front protruding part 714, the left-back protruding part 715, and the left-front protruding part 716 are configured to become narrower toward the distal end. Therefore, the right-side-outline-member-trailing-end part 601 is readily pressed into the first entry part J1, the right-side-outline-member-leading-end part 602 is readily pressed into the second entry part J2, the left-side-outline-member-trailing-end part 651 is readily pressed into the third entry part J3, and the left-side-outline-member-leading-end part 652 is readily pressed into the fourth entry part J4 respectively.

The central vertical member 70 is brazed to the right-side outline member 60 and the left-side outline member 65 at the right-side-outline-member-trailing-end part 601, the right-side-outline-member-leading-end part 602, the left-side-outline-member-trailing-end part 651, the left-side-outline-member-leading-end part 652, the first flange 72, and the second flange 73, which are flat-surface portions. Brazing together the flat-surface portions in this way ensures a large area for brazing, and improves brazeability.

Brazing then concludes, and both ends of the first connecting pipe CP1 through the eleventh connecting pipe CP11 are inserted into the corresponding connecting-pipe-inserting holes 65*a* in descending order from the eleventh connecting pipe CP11. Brazing is performed in a state where insertion of all of the connecting pipes CP has concluded. The brazing material is positioned at the edge of the connecting-pipe-inserting holes 65*a* before assembly.

The second header collection tube 50 that has been manufactured using the flow above is affixed to a jig or the like along with the first header collection tube 45. Brazing is performed in a state where the left-side end parts of the plurality of the heat transfer tubes 31 are inserted via the heat-transfer-tube-inserting holes 50*a*. The ends of the heat transfer tubes 31 and the distal end of the right-side central protruding part 711 do not come into contact during such brazing. In other words, brazing is performed in a state where clearance of an appropriate size is ensured so that clearance CL1 (see FIG. 17) is formed between the ends of the heat transfer tubes 31 and the distal end of the right-side central protruding part 711 after brazing is completed. The brazing material is positioned at the edges of the heat-transfer-tube-inserting holes 50*a* before performing such brazing.

(6) Function of the Right-side Central Protruding Part 711 and the Left-side Central Protruding Part 712 in the Central Vertical Member 70

(6-1) Function by which the Right-side Central Protruding Part 711 Suppresses Decrease in Performance The right-side central protruding part 711 restrains decreases in performance of the outdoor heat exchanger 13 due to the joining of the left-side end part of the heat transfer tube 31 to the vertical plate 71 in the process for manufacturing the outdoor heat exchanger 13.

In other words, in the process for manufacturing the outdoor heat exchanger 13, brazing is performed in a state where the left-side end part of the heat transfer tube 31 has been inserted within the second header collection tube 50 (the right-side space RS). The heat transfer tube 31 may extend leftward due to thermal expansion during such brazing. When the right-side central protruding part 711 is not provided, the thermal expansion of the heat transfer tube 31 during brazing leads to contact between the left-side end part of the heat transfer tubes 31 and the right-side surface 71*a* of the vertical plate 71. When the brazing material has flowed onto the contacting portions in such cases, the left-side end part of the heat transfer tube 31 and the right-side surface 71*a* are strongly joined, and the two will not readily separate even when the thermal expansion of the heat transfer tubes 31 abates. Should such an event occur, the refrigerant flow channels in the right-side spaces RS within the second header collection tube 50 are blocked or extremely narrowed. The performance of the outdoor heat exchanger 13 decreases as a result. The right-side central protruding part 711 is provided to the vertical plate 71 in the present embodiment in order to restrain the occurrence of such events.

The right-side central protruding part 711, which protrudes rightward (toward the heat transfer tube 31) from the right-side surface 71*a*, is provided to the vertical plate 71 whereby the right-side central protruding part 711 is interposed between the heat transfer tube 31 and the right-side surface 71*a*, and the distal end of the right-side central protruding part 711 contacts the left-side end part of the heat transfer tubes 31 even in cases where the heat transfer tube 31 extends leftward due to thermal expansion of the heat transfer tubes 31 during brazing. Since the area of the distal end of the right-side central protruding part 711 is small, the contact area between the distal end of the right-side central protruding part 711 and the left-side end part of the heat transfer tube 31 does not readily become large, even in cases where the distal end of the right-side central protruding part 711 contacts the left-side end part of the heat transfer tube 31. As a result, strong joining of the distal end of the right-side central protruding part 711 and the left-side end part of the heat transfer tube 31 can be restrained, even when brazing material has flowed onto the contacting portion between the distal end of the right-side central protruding part 711 and the left-side end part of the heat transfer tube 31. The joining is readily broken once the thermal expansion of the heat transfer tube 31 abates and contraction begins.

The right-side central protruding part 711 is provided to a central portion of the right-side surface 71*a*, and therefore brazing material does not readily reach the right-side central protruding part 711 even in cases where the brazing material has flowed onto the right-side surface 71*a*. The brazing material therefore does not readily flow onto the contacting portions during brazing even in cases where the distal end of the right-side central protruding part 711 and the left-side end part of the heat transfer tube 31 are in contact. As a result, joining of the right-side central protruding part 711 and the left-side end part of the heat transfer tube 31 is more difficult.

Brazing is performed in a state where the clearance CL1, which has a predetermined length, is formed between the right-side central protruding part 711 and the left-side end part of the heat transfer tube 31. The size of the clearance CL1 is set to a value such that the right-side central protruding part 711 and the left-side end part of the heat transfer tube 31 do not readily come into contact, in consideration of the left-to-right size of the right-side central protruding part 711, the coefficient of thermal expansion of the material of the heat transfer tube 31, and other factors. The right-side central protruding part 711 and the left-side end part of the heat transfer tube 31 therefore do not readily come into contact during brazing.

(6-2) Function by which the Right-Side Central Protruding Part 711 and the Left-Side Central Protruding Part 712 Improve Ease of Assembly The right-side central protruding part 711 and the left-side central protruding part 712 improve the ease of assembly of the second header collection tube 50.

In other words, since the upper and lower surfaces of the first horizontal part 801 and the second horizontal part 851 contact the right-side central protruding part 711 and the left-side central protruding part 712 when the first baffle 80 and the second baffle 85 have entered into the central vertical member 70 in a state where the right-side outline member 60 is temporarily affixed to the central vertical member 70 during assembly of the second header collection tube 50, the orientations of the first baffle 80 and the second baffle 85 can be stably held in place.

In other words, in cases where the right-side central protruding part 711 and the left-side central protruding part 712 are not provided, the upper and lower surfaces of the first horizontal part 801 and the second horizontal part 851 are supported only by the edge portions of the first baffle entry hole H7 or the second baffle entry hole H8 when the first baffle 80 and the second baffle 85 have entered into the central vertical member 70, and therefore the first baffle 80 and the second baffle 85 readily wobble, and the orientations are not readily stably held in place. Assembly is therefore difficult.

However, in the present embodiment, the right-side central protruding part 711 and the left-side central protruding part 712 are provided to the central vertical member 70, whereby the upper and lower surfaces of the first horizontal part 801 and the second horizontal part 851 contact the upper and lower edges of the right-side central protruding part 711 and the left-side central protruding part 712, and supported area increases when the first baffle 80 and the second baffle 85 have been made to enter the central vertical member 70. As a result, the first baffle 80 and the second baffle 85 do not readily wobble, and the orientations are readily and stably held in place. Assembly is thereby facilitated. In other words, providing the right-side central protruding part 711 and the left-side central protruding part 712 in the present embodiment improves the ease of assembly.

(7) Function of the Second Header Collection Tube 50

(7-1) Function for Improving Ease of Assembly

The second header collection tube 50 configured as described above includes in the interior thereof the vertical plate 71 that extends from the upper end to the lower end and functions as the vertical partitioning part 51. The vertical partitioning part 51 is a space-forming member that forms a plurality of spaces or a flow-channel-forming member that forms a plurality of refrigerant flow channels within the second header collection tube 50. In other words, the second header collection tube 50 has in the interior thereof a space-forming member or a flow-channel-forming member extending along the longitudinal (vertical) direction.

The second header collection tube 50 also includes in the interior thereof a plurality of the first baffles 80 and a plurality of the second baffles 85 that extend along the horizontal direction and function as the first horizontal partitioning parts 52 or the second horizontal partitioning parts 53. The first horizontal partitioning parts 52 or the second horizontal partitioning parts 53 are space-forming members that form a plurality of spaces or flow-channel-forming members that form a plurality of flow channels within the second header collection tube 50. In other words, the second header collection tube 50 has in the interior thereof a space-forming member or a flow-channel-forming member extending along a direction (the horizontal direction) that intersects the longitudinal (vertical) direction.

Performing assembly while the space-forming member (or the flow-channel-forming member) that extends along the longitudinal direction and the space-forming member (or the flow-channel-forming member) that extends along a direction that intersects the longitudinal direction are positioned in the interior in a cylindrical header of a heat exchanger, where the header extends along the longitudinal direction, such as the second header collection tube 50, is generally not easy.

The second header collection tube 50 is configured from a plurality of assembled members, as described above. In particular, in the second header collection tube 50, the right-side outline member 60, the left-side outline member 65, the first baffle 80, and the second baffle 85 are assembled together centered on the central vertical member 70 which is the space-forming member (or the flow-channel-forming member). As a result, in the second header collection tube 50, performing assembly while the space-forming member (or the flow-channel-forming member) that extends along the longitudinal direction and the space-forming member (or the flow-channel-forming member) that extends along a direction that intersects the longitudinal direction are positioned in the interior in a cylindrical header of a heat exchanger, where the header extends along the longitudinal direction, becomes easy. In other words, ease of assembly is improved.

The central vertical member 70 is brazed to the right-side outline member 60 and the left-side outline member 65 at the right-side-outline-member-trailing-end part 601, the right-side-outline-member-leading-end part 602, the left-side-outline-member-trailing-end part 651, the left-side-outline-member-leading-end part 652, the first flange 72, and the second flange 73, which are flat surface portions. A large brazing area is thereby realized, and brazeability is superior. In other words, ease of assembly is further improved.

The right-back protruding part 713, the right-front protruding part 714, the left-back protruding part 715, and the left-front protruding part 716, which extend continuously from the upper end to the lower end of the vertical plate 71, are interrupted at portions where the first baffle entry holes H7 and the second baffle entry holes H8 are formed. The first baffle 80 and the second baffle 85 can thereby be readily inserted into the first baffle entry hole H7 and the second baffle entry hole H8, and ease of assembly is further improved.

(7-2) Function for Improving Reliability

The second header collection tube 50 configured as described above is configured as a result of assembling and joining together a plurality of members. There are generally concerns that the pressure resistance strength of the joined portions will decrease in a header collection tube configured from joining a plurality of members. Specifically, when the refrigerant pressure in the header becomes large, the joining portions may no longer be able to resist the pressure from the inside and could break.

In the second header collection tube 50, the joined portions are covered from the outside by the first flange 72 and the second flange 73 of the central vertical member 70. As a result, the pressure resistance strength of the joined portions is improved.

In the second header collection tube 50, the cross-sections of the right-side outline member 60 and the left-side outline member 65 curve into an arch shape. As a result, the pressure resistance strength of the second header collection tube 50 is improved.

The second header collection tube 50 thereby does not readily break even when the refrigerant pressure within the second header collection tube 50 exceeds normally considered values. In other words, reliability is improved.

(7-3) Function for Improving Corrosion Resistance

Figure 23:
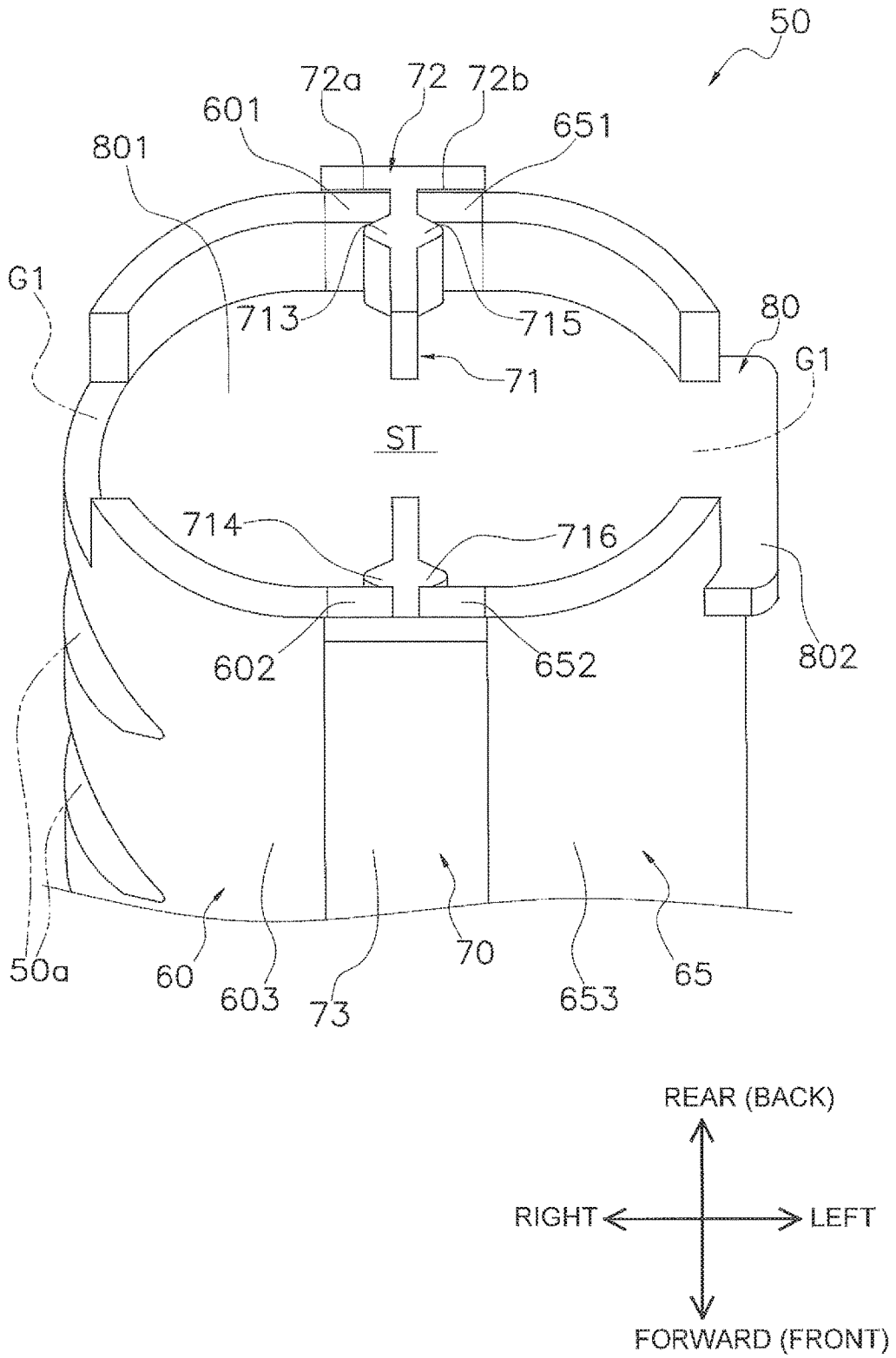
FIG. 23 is an enlarged perspective view of the top-surface portion of the second header collection tube.

FIG. 23 is an enlarged perspective view of the top-surface portion of the second header collection tube 50.

In the second header collection tube 50, the right-side outline member 60, the left-side outline member 65, and the central vertical member 70 extend further up at the upper-surface side of the first baffle 80 which configures the top surface. As a result, a ceiling space ST is formed encompassed by the inner surfaces of the right-side outline member 60 and the left-side outline member 65 as well as the right-side surface 71*a* and the left-side surface 71*b* of the central vertical member 70 at the upper-surface side of the first baffle 80.

A part of the upper-end portion of the right-side outline member 60 and the left-side outline member 65 is cut out. The ceiling space ST is thereby not completely surrounded, and a part of the circumference is open to the exterior. The open portion functions as a drain port G1. Specifically, even if drain water or other liquids are present in the ceiling space ST, the liquid will flow out from the drain port G1. The retention of the liquid in the ceiling space ST is therefore restrained.

A central portion of the central vertical member 70 is cut away in the ceiling space ST. The flow of liquid from the right side toward the left and from the left side toward the right in the ceiling space ST is thereby not readily blocked by the central vertical member 70, and the liquid is not readily retained. In other words, liquid present in the ceiling space ST passes through the central vertical member 70 and is readily guided to the drain port G1. Retention of liquid in the ceiling space ST is therefore further restrained.

As a result, in the second header collection tube 50, corrosion produced as a result of liquid retention in the ceiling space ST does not readily occur. In other words, corrosion resistance is improved in the second header collection tube 50.

(8) Characteristics (8-1)

In the aforedescribed embodiment, the second header collection tube 50 is configured from joining the right-side outline member 60 and the left-side outline member 65 to the central vertical member 70. The central vertical member 70 extends along the longitudinal (vertical) direction of the second header collection tube 50. The right-side outline member 60 extends along the longitudinal (vertical) direction and, along with the central vertical member 70, forms the right-side space RS. The left-side outline member 65 extends along the longitudinal (vertical) direction and, along with the central vertical member 70, forms the left-side space LS. In other words, the second header collection tube 50 is assembled by joining the right-side outline member 60 and the left-side outline member 65 to the central vertical member 70 which is a space-forming member that extends along the longitudinal direction. In other words, the second header collection tube 50 is assembled centered around the central vertical member 70 which is a space-forming member. Assembly in the second header collection tube 50, which extends along the longitudinal direction, can thereby be facilitated while the space-forming member that extends along the longitudinal direction is installed.

(8-2)

In the aforedescribed embodiment, the central vertical member 70 includes the first flange 72 which covers the right-side-outline-member-trailing-end part 601 and the left-side-outline-member-trailing-end part 651 from the outside when viewed in cross-section, and the second flange 73 which covers the right-side-outline-member-leading-end part 602 and the left-side-outline-member-leading-end part 652 from the outside when viewed in cross-section. The right-side outline member 60 and the left-side outline member 65 are joined to the central vertical member 70 in a state where the right-side-outline-member-trailing-end part 601 and the left-side-outline-member-trailing-end part 651 face the first-flange-right-side-inner surface 72*a* and the first-flange-left-side-inner surface 72*b*, and the right-side-outline-member-leading-end part 602 and the left-side-outline-member-leading-end part 652 face the second-flange-right-side-inner surface 73*a* and the second-flange-left-side-inner surface 73*b*. The joining portions of the central vertical member 70 with the right-side outline member 60 and the left-side outline member 65 are thereby covered from the outside by the first flange 72 and the second flange 73. As a result, the pressure resistance strength respect to pressure within the right-side space RS and the left-side space LS is improved at the joining portions of the central vertical member 70 with the right-side outline member 60 and the left-side outline member 65.

(8-3)

In the aforedescribed embodiment, the first-flange-right-side-inner surface 72*a*, the first-flange-left-side-inner surface 72*b*, the second-flange-right-side-inner surface 73*a*, and the second-flange-left-side-inner surface 73*b*, as well as the right-side-outline-member-trailing-end part 601, the left-side-outline-member-trailing-end part 651, the right-side-outline-member-leading-end part 602, and left-side-outline-member-leading-end part 652, which are the joining portions between the central vertical member 70 and the right-side outline member 60 as well as the left-side outline member 65, are all flat surfaces. In other words, the central vertical member 70 is joined to the right-side outline member 60 and the left-side outline member 65 at flat surfaces. Large joining surfaces are thereby realized between the central vertical member 70 and the right-side outline member 60 as well as the left-side outline member 65, and the two are stably joined.

(8-4)

In the aforedescribed embodiment, the central vertical member 70 further includes the right-back protruding part 713, the right-front protruding part 714, the left-back protruding part 715, and the left-front protruding part 716. As a result, the first entry part J1 into which the right-side-outline-member-trailing-end part 601 enters, the second entry part J2 into which the right-side-outline-member-leading-end part 602 enters, the third entry part J3 into which the left-side-outline-member-trailing-end part 651 enters, and the fourth entry part J4 into which the left-side-outline-member-leading-end part 652 enters are formed in the central vertical member 70. The central vertical member 70 is thereby readily temporarily affixed to the right-side outline member 60 and the left-side outline member 65 in the process for manufacturing the second header collection tube 50, and assembly is made easy.

(8-5)

In the aforedescribed embodiment, the right-back protruding part 713, the right-front protruding part 714, the left-back protruding part 715, and the left-front protruding part 716 of the central vertical member 70 are configured to become narrower toward the distal end. The right-side-outline-member-trailing-end part 601, the right-side-outline-member-leading-end part 602, the left-side-outline-member-trailing-end part 651, and the left-side-outline-member-leading-end part 652 thereby readily enter the entry parts (J1-J4).

(8-6)

In the aforedescribed embodiment, the cross-sectional shape has axial symmetry with respect to the axis Z extending from the first flange 72 to the second flange 73. Assembly error is thereby restrained when joining the central vertical member 70 to the right-side outline member 60 and the left-side outline member 65.

(8-7)

In the aforedescribed embodiment, the cross-sectional shape of the right-side outline member 60 and the left-side outline member 65 curves into an arch shape. The pressure resistance strength of the second header collection tube 50 is thereby improved.

(8-8)

In the aforedescribed embodiment, the central vertical member 70 is brazed to the right-side outline member 60 and the left-side outline member 65 in a state where brazing material is positioned on the outer and inner surfaces of the right-side-outline-member-trailing-end part 601 and the right-side-outline-member-leading-end part 602 and on the outer surfaces of the left-side-outline-member-trailing-end part 651 and the left-side-outline-member-leading-end part 652. The brazing quality when joining is thereby improved, and the central vertical member 70 is stably joined to the right-side outline member 60 and the left-side outline member 65.

(8-9)

In the aforedescribed embodiment, a plurality of the first baffle entry holes H7 and a plurality of the second baffle entry holes H8 are formed in the central vertical member 70. The first baffle 80 and the second baffle 85, which extend along a direction intersecting the longitudinal direction and function as space-forming members (or flow-channel-forming members), are thereby positioned passing through the central vertical member 70. As a result, a plurality of space-forming members that extend along the direction intersecting the longitudinal direction can be readily positioned while positioning the space-forming member that extends along the longitudinal direction.

(8-10)

In the aforedescribed embodiment, the right-back protruding part 713, the right-front protruding part 714, the left-back protruding part 715, and the left-front protruding part 716 that extend continuously from the upper end to the lower end of the vertical plate 71 are interrupted at portions where there first baffle entry hole H7 and the second baffle entry hole H8 are formed. The first baffle 80 and the second baffle 85 are thereby readily inserted into the first baffle entry hole H7 or the second baffle entry hole H8, and ease of assembly is improved.

(9) Modifications (9-1) Modification A

In the aforedescribed embodiment, the present invention is applied to the second header collection tube 50. However, no limitation is provided thereby, the present invention may also be applied to headers for other heat exchangers. The present invention may also be applied to, e.g., headers for heat exchangers where the longitudinal direction extends horizontally.

(9-2) Modification B

In the aforedescribed embodiment, the second header collection tube 50 is applied to the outdoor heat exchanger 13. However, the second header collection tube 50 can also applied to other heat exchangers. The second header collection tube 50 may also be applied to, e.g., the indoor heat exchanger 21.

(9-3) Modification C

In the aforedescribed embodiment, the outdoor unit 10 is configured so that air taken in during operation is blown out in the forward (horizontal) direction. However, the outdoor unit 10 is not limited thereby and may be configured, e.g., to blow out upward air that has been taken in.

(9-4) Modification D

In the aforedescribed embodiment, the cross-sectional shapes of the right-side outline member 60 and the left-side outline member 65 were configured so as to curve into an arch shape. However, the cross-sectional shapes of the right-side outline member 60 and the left-side outline member 65 need not necessarily curve into an arch shape.

(9-5) Modification E

In the aforedescribed embodiment, the cross-sectional shape of the central vertical member 70 is configured to have axial symmetry with respect to the axis Z1. However, the cross-sectional shape of the central vertical member 70 need not necessarily have axial symmetry with respect to the axis Z1.

(9-6) Modification F

In the aforedescribed embodiment, the first-flange-right-side-inner surface 72*a*, the first-flange-left-side-inner surface 72*b*, the second-flange-right-side-inner surface 73*a*, the second-flange-left-side-inner surface 73*b*, the outer surface of the right-side-outline-member-trailing-end part 601, the outer surface of the left-side-outline-member-trailing-end part 651, the outer surface of the right-side-outline-member-leading-end part 602, and the outer surface of the left-side-outline-member-leading-end part 652 were configured as flat surfaces. However, this is not given by way of limitation. These parts need not necessarily be configured as flat surfaces and may also be curved or bent.

(9-7) Modification G

In aforedescribed embodiment, the right-side central protruding part 711 and the left-side central protruding part 712 were configured at the center of the vertical plate 71 of the central vertical member 70. However, these parts may also be configured at a position removed from the center of the vertical plate 71 of the central vertical member 70.

(9-8) Modification H

In the aforedescribed embodiment, the cross-sectional shapes of the right-side central protruding part 711, the left-side central protruding part 712, the right-back protruding part 713, the right-front protruding part 714, the left-back protruding part 715, and the left-front protruding part 716 were configured as substantially triangular. However, these cross-sectional shapes need not necessarily be substantially triangular, and the cross-sectional shapes may be, e.g., square or semicircular.

(9-9) Modification I

In the aforedescribed embodiment, the right-back protruding part 713, the right-front protruding part 714, the left-back protruding part 715, and the left-front protruding part 716 were configured on the central vertical member 70. However, any or all of these parts may be omitted.

(9-10) Modification J

In the aforedescribed embodiment, the first baffle 80 had the first rib 802, and the second baffle 85 had the second rib 852. However, the first rib 802 or the second rib 852 can be omitted as appropriate. In such cases, the first rib entry hole 65*b* or the second rib entry hole 65*c* of the left-side outline member 65 are omitted, and the first baffle 80 and the second baffle 85 should be installed so that an outer circumferential surface of the first horizontal part 801 or the second horizontal part 851 is brought into contact with an inner circumferential surface of the left-side outline member 65.

(9-11) Modification K

In the aforedescribed embodiment, the size d1 in the forward-and-back direction of the first rib 802 of the first baffle 80 is configured to be larger than the size d2 in the forward-and-back direction of the second rib 852 of the second baffle 85. However, no limitation is provided thereby; the size d1 in the forward-and-back direction of the first rib 802 may be configured to be smaller than the size d2 in the forward-and-back direction of the second rib 852 of the second baffle 85. The size d1 in the forward-and-back direction of the first rib 802 may also be configured to be the same as the size d2 in the forward-and-back direction of the second rib 852 of the second baffle 85.

(9-12) Modification L

In the aforedescribed embodiment, the brazing material in the process of manufacture is positioned on the first baffles 80, the second baffles 85, the outer and inner surfaces of the right-side-outline-member-trailing-end part 601 and the right-side-outline-member-leading-end part 602, and the outer surfaces of the left-side-outline-member-trailing-end part 651 and the left-side-outline-member-leading-end part 652. However, the locations at which the brazing material is positioned are not provided by way of limitation, and may be changed as appropriate. The brazing material is not positioned on, e.g., the inner surface of the left-side-outline-member-leading-end part 652, but the brazing material may also be positioned on this portion. The brazing material is not positioned on the central vertical member 70, but may also be positioned on inner surfaces of the first flange 72 and the second flange 73 and/or on any of the right-back protruding part 713, the right-front protruding part 714, the left-back protruding part 715, and the left-front protruding part 716 of the central vertical member 70.

(9-13) Modification M

In aforedescribed embodiment, brazing is performed a plurality of times in the process for manufacturing the second header collection tube 50. However, no limitation is provided thereby; brazing may also be performed in a state where all of the configurational elements have been assembled.

INDUSTRIAL APPLICABILITY

The present invention can be used in a header of a heat exchanger.

What is claimed is:

1. A cylindrical header of a heat exchanger extending along a longitudinal direction, the cylindrical header comprising:

a central member extending along the longitudinal direction;

a front-side member extending along the longitudinal direction on a front side of the central member, the front-side member being configured and arranged to form a front-side space along with the central member; and a rear-side member extending along the longitudinal direction on a rear side of the central member, the rear-side member being configured and arranged to form a rear-side space along with the central member, the central member having a first flange covering a front-side-member-first-end part and a rear-side-member-first-end part from outside when viewed in cross-section, a second flange covering a front-side-member-second-end part and a rear-side-member-second-end part from outside when viewed in cross-section, a first convex part configured and arranged to form along with an inner surface of the first flange a first entry part into which the front-side-member-first-end part enters, a second convex part configured and arranged to form along with an inner surface of the second flange a second entry part into which the front-side-member-second-end part enters, a third convex part configured and arranged to form along with the inner surface of the first flange a third entry part into which the rear-side-member-first-end part enters, and a fourth convex part configured and arranged to form along with the inner surface of the second flange a fourth entry part into which the rear-side-member-second-end part enters, the front-side-member-first-end part being one end of the front-side member when viewed in cross-section, the rear-side-member-first-end part being one end of the rear-side member when viewed in cross-section, the front-side-member-second-end part being another end of the front-side member when viewed in cross-section, and the rear-side-member-second-end part being another end of the rear-side member when viewed in cross-section, the front-side member being joined to the central member in a state in which the front-side-member-first-end part faces the inner surface of the first flange, and the front-side-member-second-end part faces the inner surface of the second flange, and the rear-side member being joined to the central member in a state in which the rear-side-member-first-end part faces an inner surface of the first flange, and the rear-side-member-second-end part faces an inner surface of the second flange.

2. The header according to claim 1, wherein the inner surfaces of the first flange and the second flange are flat surfaces, and the front-side-member-first-end part, the front-side-member-second-and part, the rear-side-member-first-end part, and the rear-side-member-second-end part arc flat surfaces.

3. The header according to claim 2, wherein a cross-sectional shape of the central member has axial symmetry with respect to an axis extending from the first flange to the second flange.

4. The header according to claim 2, wherein cross-sectional shapes of the front-side member and the rear-side member curve into an arch shape.

5. The header according to claim 2, wherein a plurality of insertion holes are formed in the front-side member in order to receive a flat tube.

6. The header according to claim 2, wherein the front-side member and the rear-side member are joined by brazing to the central member, and a brazing material is positioned on outer surfaces of the front-side-member-first-end part, the front-side-member-second-end part, the rear-side-member-first-end part, and the rear-side-member-second-end part.

7. The header according to claim 1, wherein the first convex part, the second convex part, the third convex part, and the fourth convex part are configured and arranged to become narrower toward distal ends thereof.

8. The header according; to claim 1, wherein a cross-sectional shape of the central member has axial symmetry with respect to an axis extending from the first flange to the second flange.

9. The header according claim 1, wherein cross-sectional shapes of the front-side member and the rear-side member curve into an arch shape.

10. The header according to claim 1, wherein a plurality of insertion holes are formed in the front-side member in order to receive a flat tube.

11. The header according to claim 1, wherein the front-side member and the rear-side member are joined by brazing to the central member, and a brazing material is positioned on outer surfaces of the front-side-member-first-end part, the front-side-member-second-end part, the rear-side-member-first-end part, and the rear-side-member-second-end part.

12. The header according to claim 1, further comprising:

a plurality of partitioning members extending along a direction intersecting the longitudinal direction between an inner surface of the front-side member and an inner surface of the rear-side member a plurality of through-holes being formed in the central member in order to enable passage of the partitioning members, and the first convex part, the second convex part, the third convex part, and the fourth convex part being configured continuously along the longitudinal direction so as to be interrupted at locations where the through-holes are formed.

* * * * *